US006758932B2

(12) United States Patent
Yamamoto et al.

(10) Patent No.: US 6,758,932 B2
(45) Date of Patent: Jul. 6, 2004

(54) MULTICOLOR IMAGE FORMING MATERIAL AND METHOD FOR FORMING MULTICOLOR IMAGE

(75) Inventors: Mitsuru Yamamoto, Shizuoka (JP); Susumu Sugiyama, Shizuoka (JP); Akihiro Shimomura, Shizuoka (JP); Akira Hatakeyama, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 114 days.

(21) Appl. No.: 10/060,170

(22) Filed: Feb. 1, 2002

(65) Prior Publication Data

US 2003/0054142 A1 Mar. 20, 2003

(30) Foreign Application Priority Data

| | | |
|---|---|---|
| Feb. 2, 2001 | (JP) | P. 2001-027142 |
| Mar. 19, 2001 | (JP) | P. 2001-079551 |
| Mar. 19, 2001 | (JP) | P. 2001-079587 |
| Jan. 29, 2002 | (JP) | P. 2002-019846 |

(51) Int. Cl.[7] ..... B41M 5/40
(52) U.S. Cl. ..... 156/235; 428/32.76; 428/32.81
(58) Field of Search ..... 156/235; 428/32.76, 428/32.77, 32.81

(56) References Cited

U.S. PATENT DOCUMENTS

| | | | |
|---|---|---|---|
| 5,053,381 | A | 10/1991 | Chapman et al. |
| 5,126,760 | A | 6/1992 | DeBoer |
| 5,300,398 | A | 4/1994 | Kaszczuk |
| 5,512,931 | A | 4/1996 | Nakajima et al. |
| 5,580,693 | A | 12/1996 | Nakajima et al. |
| 5,593,808 | A | 1/1997 | Ellis |
| 5,611,881 | A | 3/1997 | Kimura et al. |
| 5,866,504 | A | 2/1999 | Okada et al. |
| 6,027,850 | A | 2/2000 | Kawakami et al. |

FOREIGN PATENT DOCUMENTS

| | | | |
|---|---|---|---|
| DE | 199 54 103 | A1 | 5/2000 |
| EP | 0 530 018 | A1 | 3/1993 |
| EP | 0 556 796 | A1 | 8/1993 |
| EP | 0 556 797 | A1 | 8/1993 |
| EP | 0 695 518 | A1 | 2/1996 |
| EP | 1 226 972 | A2 | 7/2002 |
| JP | 2000-71634 | | 3/2000 |
| JP | 2000-118144 | | 4/2000 |
| JP | 2000-127635 | | 5/2000 |
| JP | 2000-127636 | | 5/2000 |
| JP | 2001-10244 | | 1/2001 |
| WO | WO 98/47718 | A1 | 10/1998 |

OTHER PUBLICATIONS

Search Report dated Apr. 22, 2003.

*Primary Examiner*—B. Hamilton Hess
(74) *Attorney, Agent, or Firm*—Sughrue Mion, PLLC

(57) ABSTRACT

A multicolor image-forming material comprises: an image-receiving sheet having an image-receiving layer and a support; and at least four thermal transfer sheets each including a support, a light-to-heat converting layer and an image-forming layer, in which each of the thermal transfer sheets has a different color, wherein a multicolor image is formed by: superposing the image-forming layer in each of the at least four thermal transfer sheets on the image-receiving layer, such that the image-forming layer is opposed to the image-receiving layer; irradiating the image-forming layer with a laser beam; transferring the irradiated area of the image-forming layer onto the image-receiving layer to form an image; and transferring the image on the image-receiving layer onto an actual printing paper, and each of the at least four thermal transfer sheets has a recording area being defined by a product of a length of 515 mm or more and width of 728 mm or more, and each of the at least four thermal transfer sheets is larger in each of a length-wise and a width-wise direction than the image-receiving sheet by 20 mm to 80 mm, and the actual printing paper is larger in each of a length-wise and a width-wise direction than the image-receiving sheet by 5 mm to 100 mm.

14 Claims, 11 Drawing Sheets

ENLARGED VIEW OF DOTS IN PRINTED MATTER

MULTICOLOR IMAGE FORMING MATERIAL AND METHOD FOR FORMING MULTICOLOR IMAGE

FIELD OF THE INVENTION

The present invention relates to a multicolor image-forming material and a multicolor image formation method for forming a high resolution full color image by use of a laser beam. In particular, the invention relates to a multicolor image-forming material and a multicolor image formation method useful for preparing a color proof (DDCP: direct digital color proof) or a mask image in the printing field from a digital signal by laser recording.

BACKGROUND OF THE INVENTION

In the graphic art field, printing of a printing plate is carried out using a set of color separation films prepared from a color original by use of a lith film. In general, a color proof is prepared from the color separation films for checking errors in a color separation process and necessity of color correction before final printing (actual printing operation). The color proof has been desired to realize high resolving power which enables high reproducibility of a medium image, and to have performances such as high process stability. Further, for obtaining the color proof approximating to actual printed matter, materials used for the actual printed matter such as final print paper (an actual printing paper) as a substrate and a pigment as a colorant are preferably used as materials used for the color proof. As a method for preparing the color proof, a dry method using no developing solution is highly desired.

As the dry method for preparing the color proof, a recording system of directly preparing the color proof from a digital signal has been developed with the recent spread of the electronic system in the preliminary process of printing (prepress field). Such an electronic system is employed for preparing the color proof of particularly high quality, and generally reproduces a halftone dot image of 150 lines/inch. For recording the proof of high image quality from the digital signal, a laser beam which can be modulated by the digital signal and make recording light thin is used as a recording head. Accordingly, it becomes necessary to develop an image-forming material exhibiting high recording sensitivity to the laser beam and showing high resolving power which makes it possible to reproduce highly fine halftone dots.

As an image-forming material used in a transfer image formation method using a laser beam, there is known a heat melt transfer sheet comprising a support having provided thereon a light-heat conversion layer absorbing a laser beam to generate heat and an image formation layer in which a pigment is dispersed in a component such as heat-meltable wax or binder, in this order (Japanese Patent Laid-Open No. 58045/1993). In the image formation method using this image-forming material, heat generated in a laser beam-irradiated region of the light-heat conversion layer melts the image formation layer corresponding to the region to transfer an image onto an image receiving sheet arranged by lamination on the transfer sheet, thereby forming a transferred image on the image receiving sheet.

Further, Japanese Patent Laid-Open No. 219052/1994 discloses a heat transfer sheet comprising a support having provided thereon a light-heat conversion layer containing a light-heat conversion material, a heat release layer having an extremely thin thickness (0.03 $\mu$m to 0.3 $\mu$m) and an image formation layer containing a colorant, in this order. In this heat transfer sheet, irradiation of a laser beam reduces the bonding force between the image formation layer and the light-heat conversion layer bonded by intervention of the heat release layer to form a highly fine image on an image receiving sheet arranged by lamination on the transfer sheet. In the image formation method using the heat transfer sheet, so-called "ablation" is utilized. Specifically, the heat release layer is partly decomposed to vaporize in a region irradiated with the laser beam, which causes the bonding force between the image formation layer and the light-heat conversion layer in that region to be weakened to transfer the image formation layer of that region onto the image receiving sheet laminated thereon.

These image formation methods have the advantages that final print paper provided with an image receiving layer (adhesive layer) as an image receiving sheet material can be used, and that a multicolor image can be easily obtained by transferring images different in color one after another onto an image receiving sheet. In particular, the image formation method utilizing ablation has the advantage that a highly fine image can be easily obtained, and is useful for preparing a color proof (DDCP: direct digital color proof) or a highly fine mask image.

In the progress of DTP circumstances, an intermediate film taking-out process is removed in the use of CTP (computer to plate), and the need for a proof according to the DDCP system has become strong, rather than the need for proof printing or a proof of the analog system. In recent years, large-sized DDCP having higher quality and stability and excellent in print agreement has been desired.

According to laser heat transfer systems, printing at high resolution is possible, and the systems include (1) a laser sublimation system, (2) a laser ablation system and (3) a laser melt system.

However, all of the above-mentioned respective systems have the problem that the recording halftone dot form is not sharp. The laser sublimation system of (1) has the problems that the approximation to printed matter is insufficient, because a dye is used as a colorant, and that the contour of a halftone dot is blurred, resulting in insufficient resolution, because the colorant is sublimated. On the other hand, the laser ablation system of (2) is good in the approximation to printed matter, because a pigment is used as a colorant, but has the problem that the contour of a halftone dot is blurred, resulting in insufficient resolution, similarly to the sublimation system, because the colorant is scattered. Further, the laser melt system of (3) also has the problem that no clear contour is obtained, because a melt flows.

Furthermore, when the difference in size between the heat transfer sheet and the image receiving sheet is small, a proper vacuum adhesion state can not be maintained in fixing the respective sheets to a recording drum by vacuum suction, so that the degree of vacuum is decreased to deteriorate the transferring properties of the image formation layer. On the other hand, when the difference in size is large, air accumulation is developed between the transfer sheet and the recording drum, resulting in a failure to obtain a good vacuum adhesion state.

In addition, when the difference in size between final paper and the image receiving sheet is small, wrinkles caused by slippage between the samples are liable to be developed. Conversely, when the difference in size is large, there is much waste, resulting in disadvantageous cost.

In the multicolor image-forming material according to the invention, the high process stability has been desired as described above. For example, the image receiving sheet is required to have good conveying properties, and further to have good accumulation properties, because a plurality of recorded cut image receiving sheets need to be accumulated.

In the heat transfer sheet on which a color image is formed, a defect of the image significantly reduces the commercial value. One of the causes of the image defect is that a part of the image formation layer is broken by a scratch, resulting in a failure to transfer that portion of the image, which can cause the defect of the image itself. The reason for this is that a surface of the heat transfer sheet is rubbed with a back face in producing, processing and printing the heat transfer sheet to scratch it. In particular, when the area of the image is large, the probability of occurrence of the image defect increases with the size of the image. Accordingly, in the case of the heat transfer sheet having a large image area, it is required that the image defect is more difficult to develop.

For preventing such an image defect, Japanese Patent Laid-Open No. 270154/1993 describes a method of using a specific polyester-acrylic styrene copolymer as a binder for an image formation layer. Further, there is also used a method of providing a protective layer on an image formation layer, thereby preventing an image defect.

It is possible to decrease the frequency of occurrence of the image defect caused by the scratch to some degree. However, the number of the image defects in one image plane is proportional to the image area, so that when the image area is increased, a problem is practically encountered. Further, the employment of the method of providing the protective layer on the image formation layer for preventing the image defect has raised the problem that the sensitivity of a heat-transferred image is lowered.

SUMMARY OF THE INVENTION

It is therefore an object of the invention to provide a large-sized DDCP having high quality and stability and excellent in print agreement. Specifically, the object of the invention is to provide a multicolor image-forming material and a multicolor image formation method which achieve that (1) a heat transfer sheet is not affected by an illuminating light source, even compared with a pigment colorant and printed matter, and excellent in sharpness of a halftone dot and stability by transfer of a colorant film, (2) an image receiving sheet can stably, securely receive an image formation layer of a laser energy heat transfer sheet, (3) transfer to final paper is possible corresponding to paper of 64 g/m$^2$ to 157 g/m$^2$ such as art (coated) paper), mat paper and fine enamel paper, and delicate texture depiction and accurate reproduction of a paper white portion (high-key portion) are possible, and (4) extremely stable transfer releasability is obtained. Further, the object of the invention is to provide a multicolor image-forming material and a multicolor image formation method which can form an image good in image quality and stable in transfer density on an image receiving sheet, even when laser recording is conducted at high energy by multiple laser beams under different conditions of temperature and humidity. Still further, the object of the invention is to provide a multicolor image-forming material and a multicolor image formation method which can prevent poor vacuum adhesion and wrinkles developed depending on the difference in size between the heat transfer sheet and the image receiving sheet and the difference in size between final paper and the image receiving sheet.

Another object of the invention is to provide a multicolor image-forming material provided with an image receiving sheet excellent in conveying properties and accumulation properties, having high process stability, and easily providing a highly fine image such as a color proof or a highly fine mask, and a multicolor image formation method using the same.

A further object of the invention is to provide a multicolor image-forming material provided with a heat transfer sheet which can prevent an image defect caused by a scratch even when the area of an image is large, and can provide a heat-transferred image good in sensitivity.

According to the invention, there are provided:

(1) A multicolor image-forming material comprising:
an image-receiving sheet having an image-receiving layer and a support; and
at least four thermal transfer sheets each including a support, a light-to-heat converting layer and an image-forming layer, in which each of the thermal transfer sheets has a different color, wherein a multicolor image is formed by: superposing the image-forming layer in each of the at least four thermal transfer sheets on the image-receiving layer in the image-receiving sheet, in which the image-forming layer is opposed to the image-receiving layer; irradiating the image-forming layer in each of the at least four thermal transfer sheets with a laser beam; transferring the irradiated area of the image-forming layer onto the image-receiving layer in the image-receiving sheet to form an image; and transferring the image on the image-receiving layer onto an actual printing paper, and each of the at least four thermal transfer sheets has a recording area being defined by a product of a length of 515 mm or more and width of 728 mm or more, and each of the at least four thermal transfer sheets is larger in each of a length-wise and a width-wise direction than the image-receiving sheet by 20 mm to 80 mm, and the actual printing paper is larger in each of a length and a width than the image-receiving sheet by 5 mm to 100 mm.

(2) A multicolor image-forming material comprising:
an image-receiving sheet having an image-receiving layer and a support; and
at least four thermal transfer sheets each including a support, a light-to-heat converting layer and an image-forming layer, in which each of the thermal transfer sheets has a different color, wherein a multicolor image is formed by: superposing the image-forming layer in each of the at least four thermal transfer sheets on the image-receiving layer in the image-receiving sheet, in which the image-forming layer is opposed to the image-receiving layer; irradiating the image-forming layer in each of the at least four thermal transfer sheets with a laser beam; and transferring the irradiated area of the image-forming layer onto the image-receiving layer in the image-receiving sheet to form an image, and the dynamic frictional force between an image-receiving surface on the image-receiving sheet and a back surface on the opposite side thereof is 30 gf to 120 gf.

(3) The multicolor image-forming material according to the item (2), wherein the dynamic frictional force is 50 gf to 80 gf.

(4) The multicolor image-forming material according to the item (2), wherein each of the at least four thermal transfer sheets has a recording area being defined by a product of a length of 515 mm or more and width of 728 mm or more.

(5) The multicolor imaging-forming material according to any one of the items (1) to (4), wherein a surface of the image-forming layer in each of the at least four thermal transfer sheets has a scratch resistance of 30 g or more, when the surface is scratched at a rate of 1 cm/second with a needle having a curvature radius of 0.25 mm.

(6) The multicolor imaging-forming material according to the item (5), wherein the scratch resistance is 220 g or more.

(7) The multicolor image-forming material according to any one of the items (1) to (6), wherein the irradiated area of the image-forming layer is transferred onto the image-receiving layer in the image-receiving sheet in a thin film.

(8) The multicolor image-forming material according to any one of the items (1) to (7), wherein the at least four thermal transfer sheets contain yellow, magenta, cyan and black thermal transfer sheets.

(9) The multicolor image-forming material according to any one of the items (1) to (8), wherein each of the image-forming layers in the at least four thermal transfer sheets has a ratio of an optical density (OD) to a layer thickness: OD/layer thickness ($\mu$m unit) of 1.50 or more, and the transferred image onto the image-receiving layer has a resolution of 2400 dpi or more.

(10) The multicolor image-forming material according to any one of the items (1) to (9), wherein the transferred image onto the image-receiving layer has a resolution of 2600 dpi or more.

(11) The multicolor image-forming material according to any one of the items (1) to (10), wherein each of the image-forming layers in the at least four thermal transfer sheets has a ratio of an optical density (OD) to a layer thickness: OD/layer thickness ($\mu$m unit) of 1.80 or more.

(12) The multicolor image-forming material according to any one of the items (1) to (11), wherein the image-forming layer in each of the at least four thermal transfer sheets and the image-receiving layer in the image-receiving sheet each has a contact angle with water of from 7.0 to 120.0°.

(13) The multicolor image-forming material according to any one of the items (1) to (12), wherein each of the image-forming layers in the at least four thermal transfer sheets has a ratio of an optical density (OD) to a layer thickness: OD/layer thickness ($\mu$m unit) of 1.80 or more, and the image-receiving layer in the image-receiving sheet has a contact angle with water of 86° or less.

(14) The multicolor image-forming material according to any one of the items (1) to (13), wherein each of the image-forming layers in the at least four thermal transfer sheets has a ratio of an optical density (OD) to a layer thickness: OD/layer thickness ($\mu$m unit) of 2.50 or more.

(15) The multicolor image-forming material according to any one of the items (1) to (14), wherein each of the at least four thermal transfer sheets has a recording area being defined by a product of a length of 594 mm or more and width of 841 mm or more.

(16) A method for forming a multicolor image, which comprises:

preparing: an image-receiving sheet having an image-receiving layer and a support; and at least four thermal transfer sheets each including a support, a light-to-heat converting layer and an image-forming layer, in which the at least four thermal transfer sheets have at least four colors including yellow, magenta, cyan and black, in which each of the at least four thermal transfer sheets has a different color, and each of the at least four thermal transfer sheets has a recording area being defined by a product of a length of 515 mm or more and width of 728 mm or more, and each of the at least four thermal transfer sheets is larger in each of a length-wise and a width-wise direction than the image-receiving sheet by 20 mm to 80 mm;

superposing the image-forming layer in each of the at least four thermal transfer sheets on the image-receiving layer in the image-receiving sheet, in which the image-forming layer is opposed to the image-receiving layer;

irradiating the image-forming layer in each of the at least four thermal transfer sheets from the side of the support with a laser beam; and transferring the irradiated area of the image-forming layer onto the image-receiving layer in the image-receiving sheet to form a image; and transferring the image on the image-receiving layer onto an actual printing paper, wherein the actual printing paper is larger in each of a length-wise and a width-wise direction than the image-receiving sheet by 5 mm to 100 mm.

(17) A method for forming a multicolor image, which comprises:

preparing: an image-receiving sheet having an image-receiving layer and a support; and at least four thermal transfer sheets each including a support, a light-to-heat converting layer and an image-forming layer, in which the at least four thermal transfer sheets have at least four colors including yellow, magenta, cyan and black, and each of the at least four thermal transfer sheets has a different color, and the dynamic frictional force between an image-receiving surface on the image receiving sheet and a back surface on the opposite side thereof is 30 gf to 120 gf;

superposing the image-forming layer in each of the at least four thermal transfer sheets on the image-receiving layer in the image-receiving sheet, in which the image-forming layer is opposed to the image-receiving layer;

irradiating the image-forming layer in each of the at least four thermal transfer sheets from the side of the support with a laser beam; and transferring the irradiated area of the image-forming layer onto the image-receiving layer in the image-receiving sheet to form a image.

DETAILED DESCRIPTION OF THE INVENTION

Figure 1:
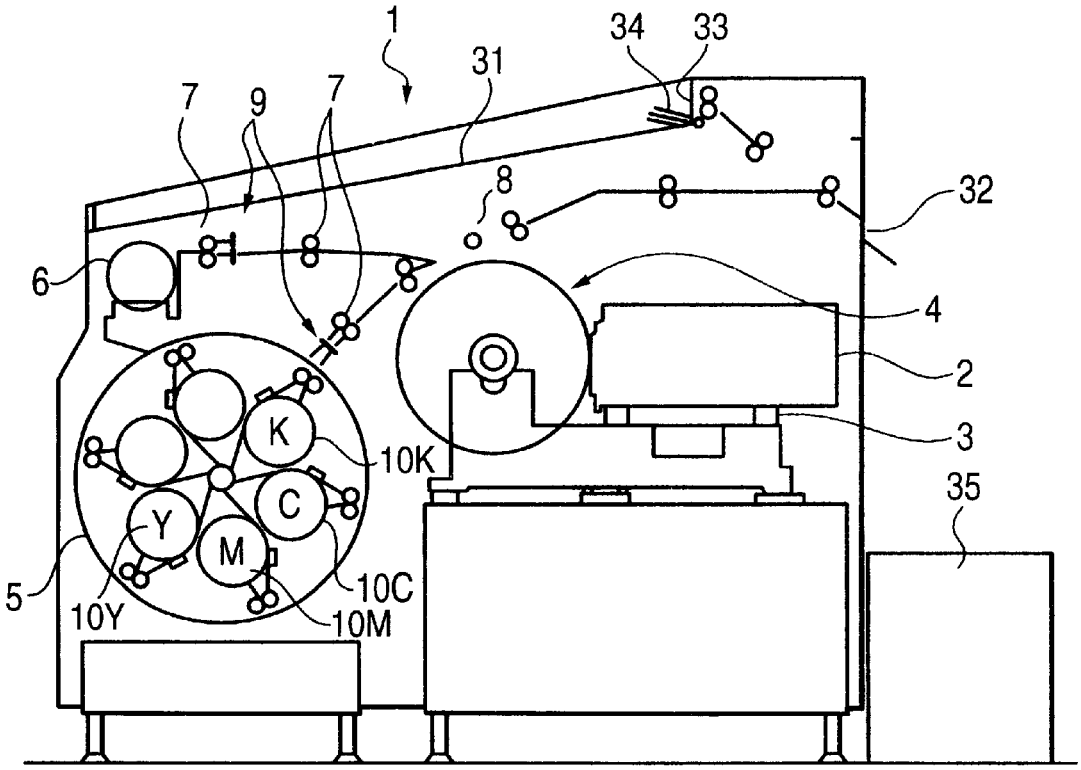
FIG. 1 is a schematic view showing a structural example of a recording device for laser heat transfer.

As a result of intensive studies of recording systems providing large-sized DDCPs of B2/A2 or more and further B1/A1 or more, which have high quality and stability and are excellent in print agreement, a final paper transfer-actual halftone dot output-pigment type image-forming material having a B2 or more size and a DDCP laser heat transfer recording system comprising an output device and a high-quality CMS soft have been obtained.

The outlines of the characteristics of performances, the system constitution and the technical points of this laser heat transfer recording system are as follows. The performances are characterized by (1) that the dot form is sharp, so that a halftone dot excellent in the approximation to printed matter can be reproduced, (2) that the hues are good in the approximation to printed matter, and (3) that the record quality is difficult to be influenced by environmental temperature and humidity, and the cyclic reproducibility is good, so that a stable proof can be prepared. The technical points of materials giving such characteristics of performances are the establishment of a thin film transfer process and improvements in vacuum adhesion retaining properties, following up to high resolution recording and heat resistance of the materials required for the laser heat transfer system. Specific examples thereof include (1) thinning of a light-heat conversion layer by introduction of an infrared absorption dye, (2) enhancement of the heat resistance of the light-heat conversion layer by introduction of a high Tg polymer, (3) intending to stabilize hues by introduction of a heat-resistant pigment, (4) control of adhesion and cohesion by addition of a low molecular weight component such as wax or an inorganic pigment and (5) imparting of vacuum adhesion without deterioration of image quality by addition of a mat material to the light-heat conversion layer. The technical points of the system include (1) air conveyance for continuous accumulation of a large number of sheets in a recoding device, (2) insertion on final paper for reducing curls after transfer in a heat transfer device and (3) connection of a general-purpose output driver allowed to have system connection expansion. As described above, the laser heat transfer recording system of the present invention is constituted by a variety of characteristics of performances, system constitution and technical points. However, these are for the purpose of illustration and not of limitation.

This system is developed based on the idea that individual materials, respective coating layers such as a light-to-heat converting layer (a light-heat conversion layer), a thermal transfer layer (a heat transfer layer) and an image-receiving layer (an image receiving layer), each of thermal transfer sheets (heat transfer sheets) and an image-receiving sheet (an image receiving sheet) should be arranged organically and overall, not existing individually and loosely, and the image information material exhibit the maximum performances in combination with a recording device and a heat transfer device. As described above, the respective coating layers of the image-forming material and the constituent materials have been examined closely, and the coating layers bringing out the maximum of features of these materials have been prepared to form the image-forming material. Such suitable ranges of various physical characteristics as this image-forming material exhibits the maximum performances have been discovered. As a result, the relationships among the respective materials, the respective coating layers, the respective sheets and the physical characteristics have been studied thoroughly, and further, the image-forming material has been allowed to act together with the recording device and the heat transfer device organically and overall, thereby being able to discover the high-quality image-forming material. Such positioning of the invention in this system results in an important technique for specifying the size relationships among the heat transfer sheets, the image receiving sheet and the final paper for bringing out the characteristics of the high-quality image-forming material supporting this system.

Specifically, when the difference in size between the heat transfer sheet and the image receiving sheet is 20 mm or less, a proper vacuum adhesion state can not be maintained to deteriorate the transferring properties of the image formation layer. Also when the difference in size is 80 mm or more, air accumulation is developed between the transfer sheet and the recording drum, resulting in a failure to obtain a good vacuum adhesion state. On the other hand, when the difference in size between the final paper and the image receiving sheet is small, there is the disadvantage that wrinkles caused by slippage between the samples are liable to be developed. When the difference in size is large, there is much waste, resulting in disadvantageous cost. Further, wrinkles become liable to develop by the difference in heat shrinkage between the final paper and the image receiving sheet.

Then, the invention is characterized by that the respective heat transfer sheets are 20 mm to 80 mm larger than the image receiving sheet, and that the final paper is 5 mm to 100 mm larger than the image receiving sheet. That is to say, taking the lateral length (a width) of the heat transfer sheet as Ha, the longitudinal length (a length) thereof as Hb, the lateral length of the image receiving sheet as Ra and the longitudinal length thereof as Rb, Ha-Ra and Hb-Rb are each from 20 mm to 80 mm. The relationship between the final paper and the image receiving sheet is the same.

The ratio (OD/thickness) of the optical density (OD) of the image formation layers of the respective heat transfer sheets to the thickness ($\mu$m) thereof is adjusted to 1.50 or more to thin the image formation layers, which is advantageous for color reproducibility such as secondary color. The effect can be more promoted by adjusting the ratio (OD/thickness) to 1.80 or more, and the transfer density and the resolution can be significantly increased by adjusting the ratio (OD/thickness) to 2.50 or more. The layer thickness for obtaining a definite optical density is decreased with an increase in the ratio (OD/thickness). Accordingly, shielding power of each layer is decreased, and when recorded in four full colors, an image excellent in color reproducibility such as secondary color can be obtained.

Further, the contact angles of the image formation layers of the respective heat transfer sheets and the image receiving layer of the image receiving sheet to water are from 7.0 degrees to 120.0 degrees. This is related to compatibility with the image formation layers, that is to say, transferring properties, and it is preferred that the contact angles are within this range. A lower contact angle results in an increase in humidity dependency, whereas a higher contact angle results in a reduction in image recording sensitivity.

Furthermore, another characteristic of the invention is a multicolor image formation method comprising transferring the image formation layer of the laser-irradiated region to the image receiving sheet in a thin film state.

In the invention, the multicolor image-forming material excellent in resolution in which the blur of the transferred image is 0.5 $\mu$m or less is obtained by the thin film transfer process according to this laser heat transfer recording system. This thin film transfer process is a process more excellent than conventional systems such as (1) the laser sublimation system, (2) the laser ablation system and (3) the laser melt system. However, the multicolor image-forming material of the invention is not naturally limited to the process. At the same time, many of various techniques incorporated into this system are also applied to the above-mentioned conventional systems to improve them, and can contribute to acquisition of the high-resolution multicolor image-forming material and the multicolor image formation method.

In the invention, the contact angles of the respective layer surfaces to water are values measured with a CA-A type contact angle meter (manufactured by Kyowa Kaimen Kagaku Co., Ltd.).

In performing multicolor image formation using the multicolor image-forming material of the invention, the heat transfer sheets thereof are overlaid with the image receiving sheet, allowing the image formation layers of the heat transfer sheets to face toward the image receiving layer of the image receiving sheet, and the multicolor image-forming material is irradiated with a laser beam to form laser beam-irradiated regions of the image formation layers, which are transferred onto the image receiving layer of the image receiving sheet, thereby recording an image. In this case, the dynamic frictional force of the image receiving sheet is controlled within a specific range as one embodiment for improving the conveying properties and accumulation properties of the image receiving sheet.

That is to say, in one embodiment of the multicolor image-forming material of the invention, the dynamic frictional force between a face having the image receiving layer (image receiving face) of the image receiving sheet and a face on the opposite side thereof (back face) is controlled within the range of 30 gf to 120 gf, preferably within the range of 50 gf to 80 gf.

The dynamic frictional force between the image receiving face and the back face is a predominant property when plural recorded image receiving sheets are accumulated on a discharge table in the recording device described later, and the image receiving sheets having a dynamic frictional force within the above-mentioned range are excellent in the conveying properties and accumulation properties.

A dynamic frictional force of less than 30 gf causes poor accumulation that the sheets are not orderly in place on the discharge table to jump out in accumulation, whereas exceeding 120 gf results in poor accumulation such as jamming, sticking, rolling up and projection.

A method for measuring the dynamic frictional force is described in the paragraph of "EXAMPLES" given later in detail.

Methods for adjusting the dynamic frictional force between the image receiving face and the back face within the above-mentioned range include the following methods.

That is to say, the surface is roughened by addition of a matte agent to the image receiving face, utilization of reticulation in coating and drying or embossing treatment. The dynamic frictional force between the image receiving face and the back face can be adjusted within the above-mentioned range by application of a lubricant or antistatic agent represented by a surfactant onto the image receiving layer, proper selection of properties such as the Tg of a binder for the image receiving layer and surface energy, application of a matte agent onto the back face, introduction of a matte agent into the support by kneading, roughening of the back face by embossing treatment, application of a lubricant or an antistatic agent onto the back face or introduction of a lubricant or an antistatic agent into the support by kneading. It is also effective to heat treat the support before coating or the image receiving sheet after coating to allow the lubricant or the antistatic agent to bleed to a surface of the image receiving layer and/or a surface of the back face.

Further, as one embodiment of the multicolor image-forming material of the invention, the scratch resistance of the surfaces of the heat transfer sheets on the side on which the image formation layers are formed is controlled to a definite value for obtaining a heat-transferred image in which an image defect caused by a scratch can be prevented even when the area of the image is large, and which has good sensitivity.

That is to say, in one embodiment of the multicolor image-forming material of the invention, when the surfaces of the heat transfer sheets on the side on which the image formation layers are formed are scratched with a needle having a curvature radius of 0.25 mm at a rate of 1 cm/second, the scratch resistance is 220 g or more.

In the invention, the term "scratch resistance" means, when the surface is scratched with a sapphire needle having a curvature radius of 0.25 mm at a rate of 1 cm/second, loading perpendicularly to the heat transfer sheet, gradually increasing the load, the minimum load required for the needle to break the image formation layer to reach the interface of the image formation layer and the light-heat conversion layer. This measurement is made under an atmosphere of 25° C. and 60% RH, and a sample stored under this atmosphere for 24 hours is used.

The scratch resistance is required to be 220 g or more, and preferably 270 g or more.

Although there is no particular limitation on the method for controlling the scratch resistance within the above-mentioned range, examples thereof include the following.

(1) Use of Lubricant

A lubricant is preferably added to a layer forming a surface of the heat transfer sheet (protective layer or image formation layer), and it is particularly preferred that the surfactant is added to at least the image formation layer. Further, in terms of sensitivity, the lubricant is preferably added to the image formation layer of the heat transfer sheet in which the image formation layer constitutes a surface.

The Lubricants used include waxes.

The waxes include mineral waxes, natural waxes and synthetic waxes. Examples of the mineral waxes include petroleum wax such as paraffin wax, microcrystalline wax, ester wax and oxide wax, montan wax, ozokerite and ceresin wax. Above all, paraffin wax is preferred. The paraffin wax is separated from petroleum, and variously on the market according to its melting point.

Examples of the natural waxes include plant waxes such as carnauba wax, Japan tallow, auricurie wax and espar wax, and animal waxes such as beeswax, insect wax, shellac wax and spermaceti.

Examples of the synthetic waxes include the following.

1) Fatty Acid Waxes

Straight chain saturated fatty acids represented by the following general formula:

$$CH_3(CH_2)_nCOOH$$

wherein n represents an integer of from 6 to 28, preferably from 10 to 30. Specific examples thereof include stearic acid, behenic acid, palmitic acid, 12-hydroxystearic acid and azelaic acid.

They further include metal salts (for example, K, Ca, Zn and Mg salts) of the above-mentioned fatty acids.

2) Fatty Acid Ester Waxes

Specific examples of esters of the above-mentioned fatty acids include ethyl stearate, lauryl stearate, ethyl behenate, hexyl behenate, behenyl myristate and glycerol esters.

3) Fatty Acid Amide Waxes

Specific examples of fatty acid amides include stearic acid amide and lauric acid amide.

4) Aliphatic Alcohol Waxes

Straight chain saturated aliphatic alcohols represented by the following general formula:

$$CH_3(CH_2)_nOH$$

wherein n represents an integer of from 6 to 28. Specific examples thereof include stearyl alcohol.

5) Polymer Waxes

Polymer waxes include polyethylene having a number average molecular weight of 200 to 10000.

Of the synthetic waxes of the above 1) to 5), suitable are behenic acid, glycerol monoesters of higher fatty acids, and higher fatty acid amides such as stearic acid amide and lauric acid amide.

Other lubricants include silicone oil and modified silicone oil. They have, for example, a molecular weight of 150 to 5000, and specific examples thereof include dimethyl silicone oil, alkyl-aralkyl-modified silicone oil, alkyl-modified silicone oil, methylhydrogen silicone oil, methylphenyl silicone oil, cyclic polydimethylsiloxane, polyether-modified silicone oil, carbinol-modified silicone oil, amino-modified silicone oil, alkyl/polyether-modified silicone oil, epoxy-modified silicone oil and fluorine-modified silicone oil.

The lubricants can be used either alone or as an appropriate combination of them as desired.

The lubricants are contained preferably in an amount of 0.01% to 15% by weight, and more preferably in an amount of 0.1% to 5% by weight, based on the total weight of the image formation layers or the protective layers.

The lubricants, particularly the waxes, also have the function of controlling the transferring properties to the image receiving sheet, as described later.

(2) Particle Size Control of Pigment

The scratch resistance can be adjusted by controlling the particle size of a pigment for image formation added to the image formation layer.

The average particle size of the pigment measured by the dynamic light scattering method (using an N-4 dynamic light scattering measuring device manufactured by Coulter) is preferably from 0.2 $\mu$m to 0.6 $\mu$m, and more preferably from 0.25 $\mu$m to 0.5 $\mu$m.

When the average particle size is less than 0.2 $\mu$m, dispersing cost rises, or sensitivity is lowered in some cases. On the other hand, when the average particle size exceeds 0.6 $\mu$m, the scratch resistance is decreased, and further, coarse particles contained in the pigment inhibit the adhesion between the image formation layer and the image receiving layer in some cases. Furthermore, the coarse particles inhibit the transparency of the image formation layer in some cases.

The image formation layer contains the pigment preferably in an amount of 30% to 70% by weight, and more preferably in an amount of 30% to 50% by weight. Further, the formation layer contains a resin preferably in an amount of 30% to 70% by weight, and more preferably in an amount of 40% to 70% by weight.

The whole system of the invention including the contents of the invention will be described below. In the system of the invention, the thin film heat transfer system has been invented and employed, thereby achieving high resolution and high image quality. The system of the invention is a system which can give a transferred image of 2400 dpi or more, preferably 2600 dpi or more. The thin film heat transfer system is a system of transferring the image formation layer having a thickness of 0.01 $\mu$m to 0.9 $\mu$m, not partly melted or little melted, to the image receiving sheet. That is to say, a recorded portion is transferred as a thin film, so that extremely high resolution is obtained. As a method for efficiently conducting thin film heat transfer, the inside of the light-heat conversion layer is deformed into a dome shape by optical recording to push up the image formation layer, which causes the adhesion between the image formation layer and the image receiving layer to be enhanced, thereby making it easy to transfer the image formation layer. When this deformation is large, the transfer becomes easy because a force to press the image formation layer onto the image receiving layer is large. On the other hand, when the deformation is small, some portions are not sufficiently transferred because a force to press the image formation layer onto the image receiving layer is small. Accordingly, the deformation preferred for the thin film transfer is expressed as follows. The dimensions of the deformation can be evaluated by the deformation rate calculated by adding the sectional area (a) of a recorded portion of the light-heat conversion layer increased after optical recording to the sectional area (b) of the recorded portion of the light-heat conversion layer before optical recording, dividing the sum by the sectional area (b) of the recorded portion of the light-heat conversion layer before optical recording, and multiplying the resulting value by 100. That is to say, the deformation rate is expressed by $\{((a)+(b))/(b)\}\times 100$. The deformation rate is 110% or more, preferably 125% or more, and more preferably 150% or more. When the breaking elongation is increased, the deformation rate may be more than 250%. However, it is usually preferred that the deformation rate is kept below about 250%.

The technical points of the image-forming material in the thin film transfer are as follows.

1. Compatibility of High Temperature Responsibility and Keeping Quality

For achieving high image quality, the transfer of a thin film of the submicronic order is necessary, whereas for obtaining desired density, it is required to form a layer in which a pigment is dispersed at high concentration. This conflicts with heat responsibility. The heat responsibility also conflicts with keeping quality (adhesion). These conflicting relations have been solved by development of a novel polymer additive.

2. Securing of High Vacuum Adhesion

In the thin film transfer pursuing high resolution, a smoother transfer interface is better, but does not provide sufficient vacuum adhesion. Not bound by usual common sense of imparting vacuum adhesion, a matte agent having a relatively small particle size is introduced into a lower layer of the image formation layers in a somewhat larger quantity, thereby keeping uniform a proper gap between the heat transfer sheet and the image receiving sheet, which has imparted vacuum adhesion while securing the characteristics of the thin film transfer without development of a blank area in an image caused by the matte agent.

3. Use of Heat-Resistant Organic Material

The light-heat conversion layer for converting laser light to heat in laser recording reaches a temperature as high as about 700° C., and the image formation layer containing the colorant reaches a temperature as high as about 500° C. A modified polyimide applicable as an organic solvent has been developed as the material for the light-heat conversion layer, and a pigment higher in heat resistance than a printing pigment, safety and matching in hues has been developed as the pigment colorant.

4. Securing of Surface Cleanability

In the thin film transfer, dust between the heat transfer sheet and the image receiving sheet causes an image defect, which poses an important problem. The dust enters from the outside of an instrument, or is produced in cutting the material, so that it is insufficient to prevent the dust only by the control of the material. Accordingly, it is necessary to equip the instrument with a dust removing mechanism. However, a material which can maintain suitable stickiness for cleaning a surface of the transfer material has been discovered, and the removal of the dust has been realized without a reduction in productivity by changing a material of a conveying roller.

The whole system of the invention will be described in detail below.

The invention realizes a heat-transferred image according to sharp halftone dots, and it is preferred that final paper transfer and recording of the B2 size or more (515 mm or more×728 mm or more) are made. Further, the B2 size is preferably 543 mm×765 mm, and a system in which recording is possible in a size larger than that (for example, 594 mm or more×841 mm or more).

One of the characteristics of the performances of the system of the invention is that a sharp dot form is obtained. The heat-transferred image obtained by this system has a resolution of 2400 dpi or more, and can be a halftone dot image depending on the number of print lines. Each halftone dot is scarcely blurred or broken, and the form thereof is sharp, so that halftone dots in the wide range from a highlight to a shadow can be clearly formed. As a result, the output of high-quality halftone dots at the same resolution as with an image setter or a CTP setter is possible, and halftone dots and gradation good in the approximation to printed matter can be reproduced.

The second of the characteristics of the performances of the system of the invention is that the cyclic reproducibility is good. This heat-transferred image can faithfully reproduce a halftone dot corresponding to a laser beam because of its sharp halftone dot form. Further, the environmental temperature and humidity dependency of recording characteristics is very low, so that the stable cyclic reproducibility can be obtained for both hues and density in the environment of temperature and humidity over a wide range.

Further, the third of the characteristics of the performances of the system of the invention is that the color reproduction is good. The heat-transferred image obtained by this system is formed using a coloring pigment used in print ink, and good in cyclic reproducibility. Accordingly, a high-accuracy CMS (color management system) can be realized.

This heat-transferred image can be allowed to approximately agree in hues with Japan color and SWOP color, that is to say, printed matter, and can show changes similar to those of printed matter, also with respect to how to look in color at the time when a light source is changed to a fluorescent lamp or a incandescent lamp.

The fourth of the characteristics of the performances of the system of the invention is that the character quality is good. The heat-transferred image obtained by this system is sharp in the dot form, so that a narrow line of a fine character can be sharply reproduced.

The characteristics of material techniques of the system of the invention will be further described in detail below.

The DDCP heat transfer systems include (1) a sublimation system, (2) an ablation system and (3) a melt system. In the systems of (1) and (2), a coloring material is sublimated or scattered, so that a contour of a halftone dot is blurred. On the other hand, also in the system of (3), a melt flows, so that a clear contour is not obtained. Then, based on the thin film transfer technique, techniques described below have been incorporated for solving new problems in the laser heat transfer system and obtaining high image quality. The first of the characteristics of the material techniques is to sharpen the dot form. Laser light is converted to heat by the light-heat conversion layer, and the heat is transmitted to the adjacent image formation layer, which causes the image information layer to adhere to the image receiving layer, thereby making a recording. For sharpening the dot form, the heat generated by the laser light is transmitted to a transfer interface without diffusion in a plane direction, and the image formation layer is sharply broken at a boundary of a heated area and an unheated area. Consequently, thinning of the light-heat conversion layer and mechanical properties of the image formation layer in the heat transfer sheet are controlled.

Technique 1 for sharpening the dot form is to thin the light-heat conversion layer. According to a simulation, the light-heat conversion layer is presumed to reach about 700° C. momentarily. When the layer is thin, deformation and destruction are liable to be developed. When the deformation and destruction are developed, the damage occurs that the light-heat conversion layer is transferred to the image sheet together with the image formation layer, or that a transferred image becomes non-uniform. On the other hand, for obtaining a specified temperature, a light-heat conversion material is required to exist in the layer at a high concentration, which also causes the problem of deposition of a dye or transfer thereof to the adjacent layer. As the light-heat conversion material, carbon has hitherto been used in many cases. However, in this material, the infrared absorption dye has been used which can be used in a smaller amount, compared with carbon. As the binder, the polyimide compound having a sufficient mechanical strength and good carrying properties for the infrared absorption dye has been introduced.

As described above, it is preferred that the light-heat conversion layer is thinned to about 0.5 μm or less by selecting the infrared absorption dye excellent in light-heat conversion characteristics and the heat-resistant binder such as the polyimide compound.

Technique 2 for sharpening the dot form is improvement in characteristics of the image formation layer. When the light-heat conversion layer is deformed, or the image formation layer itself is deformed by intense heat, thickness unevenness corresponding to a sub-scanning pattern of a laser beam is developed in the image formation layer transferred to the image receiving layer, resulting in a non-uniform image to reduce the apparent transfer density. This tendency is significant with a decrease in the thickness of the image formation layer. On the other hand, when the image formation layer is thick, the dot sharpness is impaired, and the sensitivity is lowered.

For allowing these conflicting performances to be compatible with each other, it is preferred that a low-melting material such as wax is added to the image formation layer, thereby improving transfer unevenness. Further, fine inorganic particles are added in place of the binder to properly increase the layer thickness, which causes the image formation layer to be sharply broken at the boundary of the heated area and the unheated area. Thus, the transfer unevenness can be improved while keeping the dot sharpness and sensitivity.

In general, the low-melting material such as wax tends to ooze out on a surface of the image formation layer or to crystallize, which poses a problem with regard to the aging stability of image quality or the heat transfer sheet in some cases.

For coping with this problem, the use of the low-melting material small in the Sp value difference from the polymer of the image formation layer is preferred. Improvement in compatibility with the polymer can prevent separation of the low-melting material from the image formation layer. It is also preferred that several kinds of low-melting materials different in structure are mixed to form a eutectic mixture, thereby preventing crystallization. As a result, the image having the sharp dot form and little unevenness is obtained.

The second of the characteristics of the material techniques is that the existence of the temperature and humidity dependency in recording sensitivity has been discovered. In general, a moisture absorption of a coating layer of the heat transfer sheet changes mechanical properties and thermal properties of the layer, resulting in the occurrence of humidity dependency of recording environment.

For decreasing this temperature and humidity dependency, the dye/binder system of the light-heat conversion layer and the binder system of the image formation layer are preferably converted to organic solvent systems. Further, it is preferred that polyvinyl butyral is selected as the binder for the image receiving layer, and a technique for making the polymer hydrophobic is introduced for reducing its hydrophilicity. The techniques for making the polymer hydrophobic include the reaction of a hydroxyl group with a hydrophobic group and crosslinking of two or more hydroxyl groups with a hardening agent, as described in Japanese Patent Laid-Open No. 238858/1996.

The third of the characteristics of the material techniques is that the hue approximation to printed matter is improved. In addition to color matching of a pigment in a thermal head type color proof (for example, First Proof manufactured by Fuji Photo Film Co., Ltd.) and a stable dispersing technique, the following problems newly encountered in the laser heat transfer system have been solved. That is to say, technique 1 for improving the hue approximation to printed matter is the use of a high heat-resistant pigment. Usually, in printing by laser exposure, heat of about 500° C. or more is also applied to the image formation layer, and some conventional pigments are decomposed by heat. However, this can be prevented by the adoption of the high heat-resistant pigment in the image formation layer.

Then, technique 2 for improving the hue approximation to printed matter is the diffusion prevention of the infrared absorption dye. For preventing changes in hues at the time when the infrared absorption dye moves from the light-heat conversion layer to the image formation layer by intense heat, it is preferred that the light-heat conversion layer is designed as a combination of the infrared absorption dye/binder having strong holding power as described above.

The fourth of the characteristics of the material techniques is an increase in sensitivity. In general, energy becomes insufficient in high-speed printing, and the spacing corresponding to the distance of laser sub-scanning is generated. As described above, an increase in the dye concentration of the light-heat conversion layer and thinning of the light-heat conversion layer and the image formation layer can increase the efficiency of generation/transfer of heat. Further, for achieving an effect of filling the spacing by a slight flow of the image formation layer in heating and improving the adhesion with the image receiving layer, the low-melting material is preferably added to the image formation layer. Furthermore, for improving the adhesion between the image formation layer and the image receiving layer and giving sufficient strength to a transferred image, it is preferred that for example, polyvinyl butyral used in the image formation layer is employed as a binder for the image receiving layer.

The fifth of the characteristics of the material techniques is improvement in vacuum adhesion. The image receiving sheet and the heat transfer sheet are preferably held on a drum by vacuum adhesion. This vacuum adhesion is important, because the image is formed by adhesion control of both sheets, so that the behavior of image transfer is very sensitive to a clearance between the image receiving layer of the image receiving sheet and the image formation layer of the transfer sheet. When the clearance between the materials is widened with foreign matter such as dust as a start, an image defect or image transfer unevenness is developed.

For preventing such an image defect or image transfer unevenness, it is preferred that uniform unevenness is formed on the heat transfer sheet, thereby making air passage well to obtain a uniform clearance.

Technique 1 for improving the vacuum adhesion is formation of unevenness on a surface of the heat transfer sheet. The unevenness is formed on the heat transfer sheet so that an effect of the vacuum adhesion is sufficiently achieved even in overprinting of two or more colors. Methods for imparting unevenness to the heat transfer sheet generally include after-treatment such as emboss treatment and addition of a matte agent to a coating layer. However, the addition of the matte agent is preferred in terms of simplification of the manufacturing process and the aging stability of the material. The matte agent is required to have a size larger than the thickness of a coating film, and addition of the matte agent to the image formation layer causes the problem that an image is broken at a portion where the matte agent exists. It is therefore preferred that the matte gent having the optimum size is added to the light-heat conversion layer, thereby resulting in the approximately uniform thickness of the image formation layer itself. Thus, an image having no defect can be obtained on the image receiving sheet.

Then, the characteristics of systematization techniques of the system of the invention will be described. Characteristic 1 of the systematization techniques is constitution of the recording device. For surely reproducing the sharp dots as described above, high-accuracy design is required on the recording device side. The basic constitution is the same as with the conventional laser heat transfer recording device. This constitution is a so-called heat mode outer drum recording system in which recording is made by irradiating the heat transfer sheet and the image receiving sheet fixed on a drum with a recording head having a plurality of high-power lasers. The following embodiments are preferred among others.

Constitution 1 of the recording device is to avoid contamination with dust. The image receiving sheet and the heat transfer sheet are supplied by a full automatic roll supply system. In the case of sheet supply in which a small number of sheets are supplied, the sheets are contaminated by a large amount of dust generated from the human body. Accordingly, roll supply has been employed.

There is one roll of the heat transfer sheet for each of four colors, so that the roll of each color is turned over by rotation of a loading unit. Each sheet is cut to a specified length with a cutter during loading, and then, fixed to a drum.

Constitution 2 of the recording device is to strengthen the adhesion between the image receiving sheet and the heat transfer sheet on a recording drum. The image receiving sheet and the heat transfer sheet are fixed on the recording drum by vacuum adhesion. Mechanical fixing can not strengthen the adhesion between the image receiving sheet and the heat transfer sheet, so that vacuum adhesion has been employed. A large number of vacuum adhesion holes are formed on the recording drum, and the inside of the drum is evacuated with a blower or a pressure reducing pump, thereby adhering the sheets by suction to the drum. The heat transfer sheet is further adhered by suction onto the image receiving sheet adhered by suction to the drum, so that the size of the heat transfer sheet is designed to be larger than that of the image receiving sheet. Air between the heat transfer sheet and the image receiving sheet, which exerts the greatest influence on the recording performance, is sucked from an area of only the heat transfer sheet outside the image receiving sheet.

Constitution 3 of the recording device is to stably accumulate the plural sheets on a discharge table. In this device, many sheets having a large area larger than B2 can be accumulated one over the other on the discharge table. When a subsequent sheet B is discharged on a heat-adhesive sheet A already accumulated, both can be adhered to each other. In this case, the next sheet is not discharged in good order to cause jamming. For preventing the adhesion, it is best to prevent the sheets A and B from coming into contact with each other. As means for preventing the contact, there are known some methods including (a) a method of forming a difference in level on the discharge table to make a sheet form uneven, thereby forming a clearance between the sheets, (b) a method of arranging a discharge outlet at a position higher than the discharge table, and dropping a discharged sheet downward, and (c) a method of blowing air between both sheets to float the sheet subsequently discharged. In this system, the sheet size is as large as B2, so that the methods of (a) and (b) require a very large construction. Accordingly, the air blowing method of (c) has been employed. That is to say, the method of blowing air between both sheets to float the sheet subsequently discharged is employed.

A structural example of this device is shown in FIG. 1.

A sequence of applying the image-forming material to this device as described above to form a full color image (hereinafter referred to as an image formation sequence of this system) will be illustrated.

1) A sub-scanning shaft of a recording head 2 of the recording device 1 returns to a starting position by means of sub-scanning rails 3, and a main scanning rotating shaft of a recording drum 4 and a heat transfer sheet loading unit 5 return to starting positions.

2) A image receiving sheet is unwound from a image receiving sheet roll 6 with a conveying roller 7, and a leading edge of the image receiving sheet is fixed by vacuum suction onto the recording drum 4 through suction holes formed on the recording drum.

3) A squeeze roller 8 comes down on the recording drum 4, and presses the image receiving sheet to the recording drum. The image receiving sheet is further conveyed by a specified amount by rotation of the drum while pressing the sheet, then stopped, and cut to a specified length with a cutter 9.

4) The recording drum 4 further makes one revolution to terminate loading of the image receiving sheet.

5) Then, a heat transfer sheet K of the first color, black, is unwound from a heat transfer sheet roll 10K by the same sequence as with the image receiving sheet, cut and loaded.

6) Then, the recording drum 4 starts to rotate at high speed, and the recording head 2 on the sub-scanning rails 3 starts to move. When the recording head arrives at a recording start position, a recording laser beam is irradiated on the recording drum 4 by the recording head 2 according to a recording signal. The irradiation is terminated at a recording termination position, and the operation of the sub-scanning rails and the rotation of the drum are stopped. The recording head on the sub-scanning rails is returned to the starting position.

7) Only the heat transfer sheet K is peeled off while leaving the image receiving sheet on the recording drum. For that purpose, the leading edge of the heat transfer sheet K is hooked with a claw, followed by pulling out in a discharge direction. Then, the heat transfer sheet K is discarded to a discarding box 35 through a discarding outlet 32.

8) 5) to 7) are repeated for remaining three colors. Recording is made in the order of cyan, magenta and yellow, subsequent to black. That is to say, a heat transfer sheet C of the second color, cyan, a heat transfer sheet M of the third color, magenta, and a heat transfer sheet Y of the fourth color, yellow, are in turn unwound from a heat transfer sheet roll 10C, a heat transfer sheet roll 10M and a heat transfer sheet roll 10Y, respectively. Although this order is the reverse of the general printing order, this is because the color order on final paper is reversed by final paper transfer in the subsequent process.

9) After the operation is completed for four colors, the recorded image receiving sheet is finally discharged to a discharge table 31. A method for peeling off the image receiving sheet from the drum is the same as with the heat transfer sheet described in 7). However, the image receiving sheet is not discarded, different from the heat transfer sheet, so that it is returned to the discharge table by switch back at the time when it has proceeded to the discarding outlet 32.

When the image receiving sheet is discharged to the discharge table, air 34 is blown from under the discharge outlet 33 to make it possible to accumulate the plural sheets.

As the conveying roller 7 of either of a supply site or a conveying site of the heat transfer sheet roll and the image receiving sheet roll, there is preferably used an adhesive roller on a surface of which an adhesive material is disposed.

The use of the adhesive roller allows cleaning of surfaces of the heat transfer sheet and the image receiving sheet.

The adhesive materials disposed on the surface of the adhesive roller include an ethylene-vinyl acetate copolymer, an ethylene-ethyl acrylate copolymer, a polyolefin resin, a polybutadiene resin, a styrene-butadiene copolymer (SBR), a styrene-ethylene-butene-styrene copolymer (SEBS), an acrylonitrile-butadiene copolymer (NBR), a polyisoprene resin (IR), a styrene-isoprene copolymer (SIS), an acrylic ester copolymer, a polyester resin, a polyurethane resin, an acrylic resin, butyl rubber and polynorbornene.

The adhesive roller comes into contact with the surfaces of the heat transfer sheet and the image receiving sheet to clean the surfaces thereof. There is no particular limitation on the contact pressure, as long as the adhesive roller is in contact with the surfaces thereof.

It is preferred that the adhesive material used in the adhesive roller has a Vickers hardness Hv of 50 kg/mm$^2$ (approximately equal to 490 MPa) or less, because dust which is foreign matter is sufficiently removed, and an image defect can be inhibited.

The term "Vickers hardness" means hardness measured by applying a static load onto a pyramid diamond indenter having an angle between the opposite faces of 136 degrees, and Vickers hardness Hv is determined from the following equation:

$$Hv=1.854\ P/d^2\ (kg/mm^2)=\text{approximately } 18.1692\ P/d^2\ (MPa)$$

wherein P is weight of a load (Kg) and d is length of a diagonal line of a square of a hollow.

Further, in the invention, it is preferred that the adhesive material used in the adhesive roller has an elastic coefficient at 20° C. of 200 kg/mm$^2$ (approximately equal to 19.6 MPa) or less, because dust which is foreign matter is sufficiently removed, and an image defect can be inhibited, similarly to the above.

Characteristic 2 of the systematization techniques is constitution of the heat transfer device.

For transferring the image sheet on which the image is printed with the recording device to an actual printing paper (referred to as "final paper" or "final print paper"), the heat transfer device is used. This process is entirely identical to that of First Proof$^{TD}$. When the image receiving sheet is overlaid with the final paper and heat and pressure are applied thereto, both are adhered to each other. Then, when the image receiving sheet is peeled off from the final paper, only the image and the adhesive layer remain on the final paper, and a support of the image receiving sheet and a cushion layer are separated. Accordingly, the image is practically transferred from the image receiving sheet to the final paper.

Figure 2:
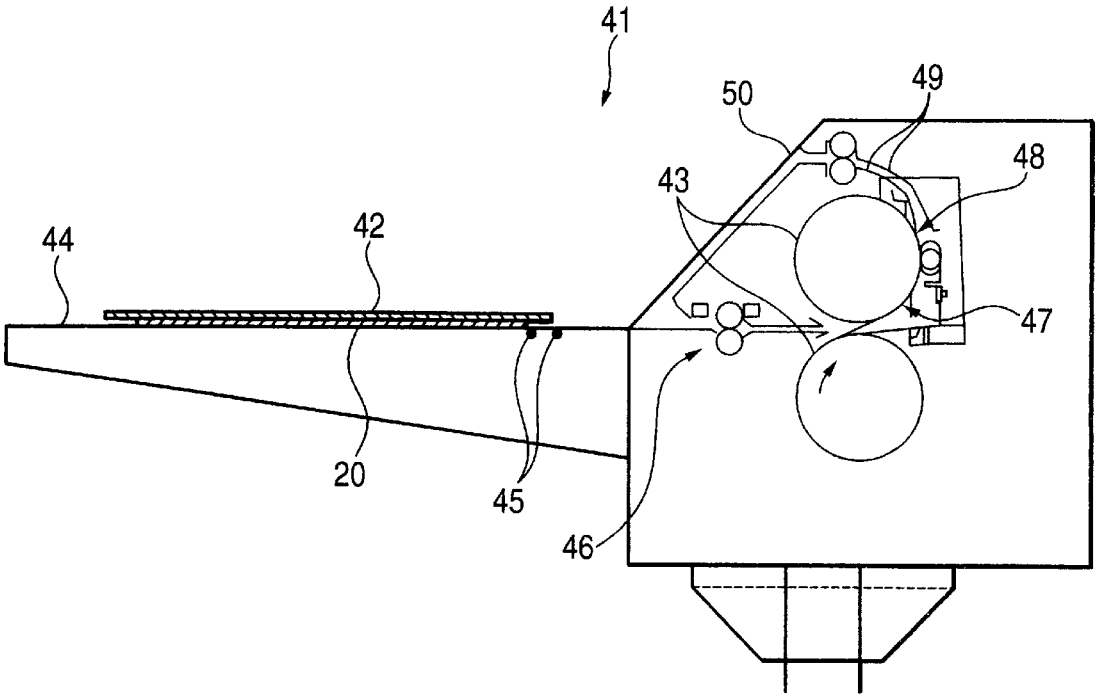
FIG. 2 is a schematic view showing a structural example of a heat transfer device.

In First Proof$^{TD}$, an aluminum guide plate is overlaid with final paper and an image receiving sheet, and passed between heat rollers to transfer an image. The aluminum guide plate is used for preventing deformation of the final paper. However, when this is employed in the system used in the invention, an aluminum guide plate larger in size than B2 becomes necessary, which poses the problem that the installation space of the devise is increased. Then, in this system, such a structure that no aluminum guide is used and further a conveying pass is turned at an angle of 180 degrees to discharge the final paper and the image receiving sheet to the insertion side is employed. Accordingly, the installation space of the devise has become very compact (FIG. 2). However, the use of no aluminum guide causes the problem that the final paper is deformed. Specifically, a pair of the final paper and the image receiving sheet discharged are curled with the image receiving sheet facing inside, resulting in rolling on the discharge table. It is very difficult as an operation to peel off the image receiving sheet from the rolled-up final paper.

Then, for preventing the rolling-up, there are considered a bimetal effect caused by the difference in shrinkage between the final paper and the image receiving sheet and an ironing effect due to a structure of winding around a heat roller. When the image receiving sheet is laid on the final paper and inserted as in a conventional method, the heat shrinkage of the image receiving sheet in the direction of insertion and movement is greater than that of the final paper, so that the upper sheet is disposed inside a curl caused by the bimetal effect. This curl direction agrees with the direction of a curl due to the ironing effect, so that the curl becomes increasingly strong by the synergistic effect. However, when the image receiving sheet and the final paper are inserted so that the image receiving sheet is placed under the final paper, the curl caused by the bimetal effect faces downward, and the curl due to the ironing effect faces upward. Accordingly, the problem of the curl has been solved by cancellation.

A sequence of final paper transfer (hereinafter referred to as a final paper transfer method used in this system) is as follows. A heat transfer device 41 used in this method, which is shown in FIG. 2, is a manually operated device, different from the recording device.

1) First, the temperature (100° C. to 110° C.) of heat rollers 43 and the conveying speed in transfer are set with a dial (not shown) corresponding to the kind of final paper 42.

2) Then, an image receiving sheet 20 is placed on an insertion table with an image facing upward, and dust on the image is removed with a static eliminating brush (not shown) The final paper 42 from which dust has been removed is placed thereon. In that case, the final paper 42 placed on the upper side is larger in size than the image receiving sheet 20 placed on the lower side, so that the position of the image receiving sheet 20 becomes invisible, resulting in the difficulty of positioning it. For improving this workability, marks 45 for indicating placing positions of the image receiving sheet and the final paper, respectively, are put on the insertion table 44. The reason why the final paper is larger in size is that the final paper 42 prevents the heat rollers 43 from being stained with an image receiving layer of the image receiving sheet 20 slipped out of the final paper 42.

3) When the image receiving sheet and the final paper are overlaid with each other and forced into an insertion inlet, insertion rollers 46 are driven for rotation to send out both toward the heat rollers 43.

4) When a leading edge of the final paper arrives at the position of the heat rollers 43, the heat rollers are nipped to start transfer. The heat rollers are heat-resistant silicone rubber rollers. Pressure and heat are applied here at the same time, thereby adhering the image receiving sheet and the final paper to each other. A guide 47 made of a heat-resistant sheet is mounted downstream from the heat rollers, and the image receiving sheet/final paper pair is conveyed upward between the upper heat roller and the guide 47, while applying heat. The pair is peeled off from the heat roller at position of a stripping claw 48, and introduced to a discharge outlet 50 along a guide plate 49.

5) The image receiving sheet/final paper pair coming out of the discharge outlet 50 is discharged onto the insertion table. Subsequently, the image receiving sheet 20 is manually peeled off form the final paper 42.

Characteristic 3 of the systematization techniques is constitution of a system.

The function as a color proof can be exhibited by connecting the device described above to a plate making system. As the system, printed matter having image quality extremely close to that of printed matter supplied from certain plate making data is required to be supplied from the proof. Then, a software for bringing color and halftone dots close to the printed matter is necessary. A specific connecting example will be introduced.

When a proof of printed matter from a plate making system, Celebra™ manufactured by Fuji Photo Film Co., Ltd., is taken, system connection is as follows. A CTP (computer to plate) system is connected to Celebra. A printing plate supplied therefrom is subjected to a printing machine, thereby obtaining final printed matter. As the color proof, Luxel FINALPROOF 5600 (hereinafter also referred to as FINALPROOF) manufactured by Fuji Photo Film Co., Ltd., which is the above-mentioned recording device, is connected to Celebra. During that, PD system$^{TD}$ manufactured by Fuji Photo Film Co., Ltd. is connected as a proof drive software for bringing color and halftone dots close to the printed matter.

Figure 3:
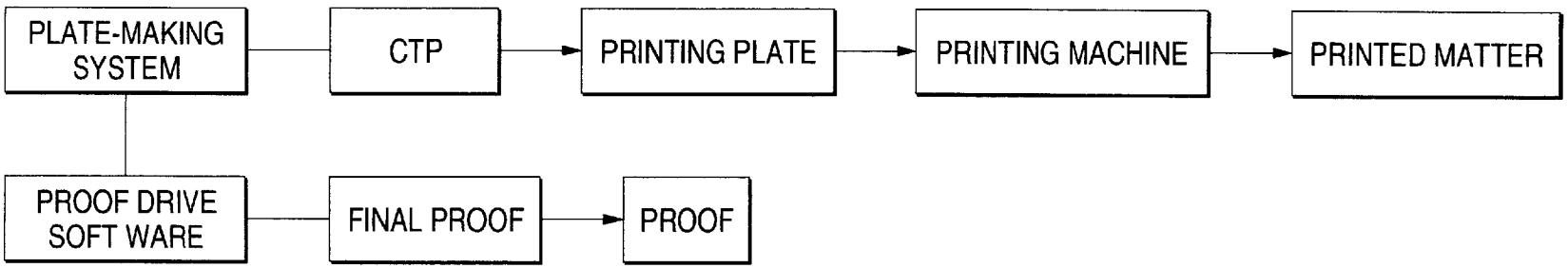
FIG. 3 is a diagram showing a structural example of a system using a recording device for laser heat transfer, FINALPROOF.

Contone (continuous tone) data converted to luster data by Celebra are converted to binary data for halftone dots, supplied to the CTP system, and finally printed. On the other hand, the same contone data are also supplied to the PD system. The PD system converts the received data by a four-dimensional (black, cyan, magenta and yellow) table so that color agrees with the above-mentioned printed matter. Finally, the data are converted to binary data for halftone dots so that they agree with halftone dots of the above-mentioned printed matter, and supplied to FINALPROOF (FIG. 3).

The four-dimensional table is previously experimentally prepared, and stored in the system. An experiment for preparing the table is as follows. An image in which important color data are printed through the CTP system and an image in which the data are supplied to FINALPROOF through the PD system are prepared, and colorimetric values thereof are compared with each other. Then, the table is prepared so that the difference between them is minimized.

As described above, according to the invention, system constitution can be realized which can fully exhibit the ability of the high-resolution material.

The heat transfer sheet, a material used in the system of the invention, will be described below.

It is preferred that the absolute value of the difference between the surface roughness Rz of a surface of the image formation layer of the heat transfer sheet and the surface roughness Rz of a surface of a back layer thereof is 3.0 $\mu$m or less, and that the absolute value of the difference between the surface roughness Rz of a surface of the image receiving layer of the image receiving sheet and the surface roughness Rz of a surface of a back layer thereof is 3.0 $\mu$m or less. Such constitution, coupled with the above-mentioned cleaning means, can prevent an image defect, prevent a conveying jam, and further improve dot gain stability.

In this specification, the term "surface roughness Rz" means an average surface roughness from ten measurements corresponding to Rz (maximum height) of JIS, and a value obtained by inputting and converting a distance between the average value of the heights of the highest to the fifth mountains and the average value of the depths of the deepest to the fifth valleys, taking as a reference plane an average plane of portions sampled from a curved surface of roughness by a reference area. A contact finger type three-dimensional roughness tester (Surfcom 570A-3DF) manufactured by Tokyo Seimitsu Co. Ltd. is used for measurement. The measuring direction is a longitudinal direction, the cutoff value is 0.08 mm, the measuring area is 0.6 mm×0.4 mm, the feed pitch is 0.005 mm, and the measuring speed is 0.12 mm/s.

From the viewpoint of more improving the above-mentioned effect, it is preferred that the absolute value of the difference between the surface roughness Rz of the surface of the image formation layer of the heat transfer sheet and the surface roughness Rz of the surface of the back layer thereof is 1.0 $\mu$m or less, and that the absolute value of the difference between the surface roughness Rz of the surface of the image receiving layer of the image receiving sheet and the surface roughness Rz of the surface of the back layer thereof is 1.0 $\mu$m or less.

Further, as another embodiment, it is preferred that the surface roughness Rz of the surface of the image formation layer of the heat transfer sheet and the surface of the back layer thereof, and/or the surface of the image receiving layer of the image receiving sheet and the surface of the back layer thereof is from 2 $\mu$m to 30 $\mu$m. Such constitution, coupled with the above-mentioned cleaning means, can prevent an image defect, prevent a conveying jam, and further improve dot gain stability.

The glossiness of the image formation layer of the heat transfer sheet is also preferably from 80 to 99.

The glossiness greatly depends on the smoothness of the surface of the image formation layer, and can exert an influence on the uniformity of the thickness of the image formation layer. The higher glossiness results in the uniform image formation layer, which is more suitable for the application to highly fine images. However, the higher glossiness results in more increased resistance in conveying, and both are in the trade-off relationship. When the glossiness is within the range of 80 to 99, both are compatible and balanced.

Figure 4:
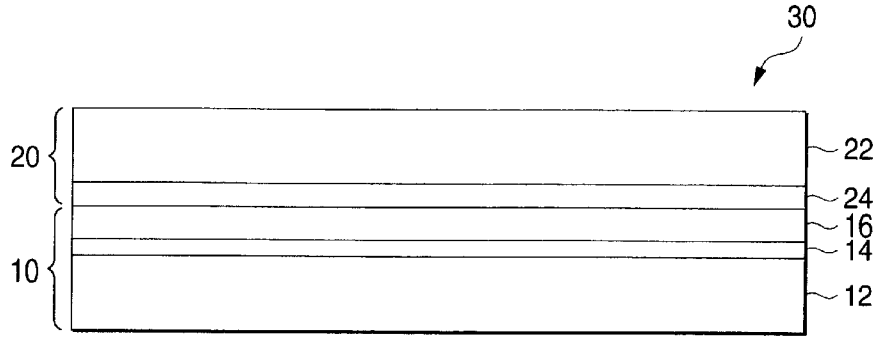
FIG. 4 shows views for illustrating an outline of a mechanism of multicolor image formation by thin film heat transfer using a laser beam.
Figure 4:
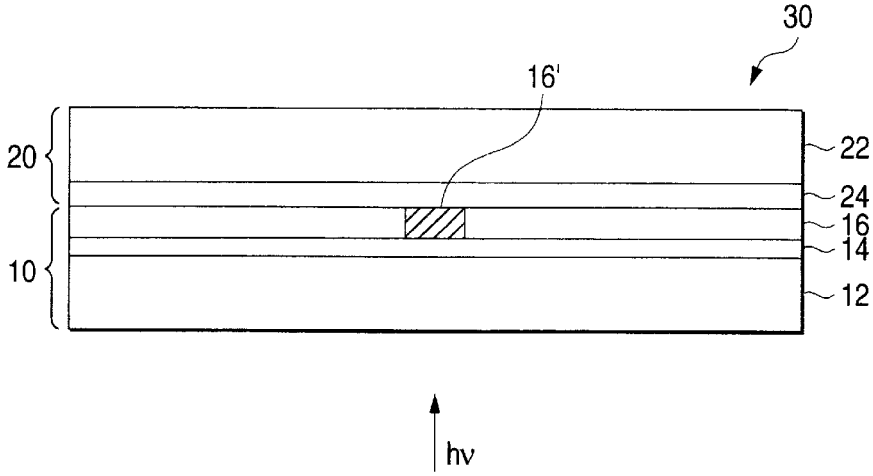
Figure 4:
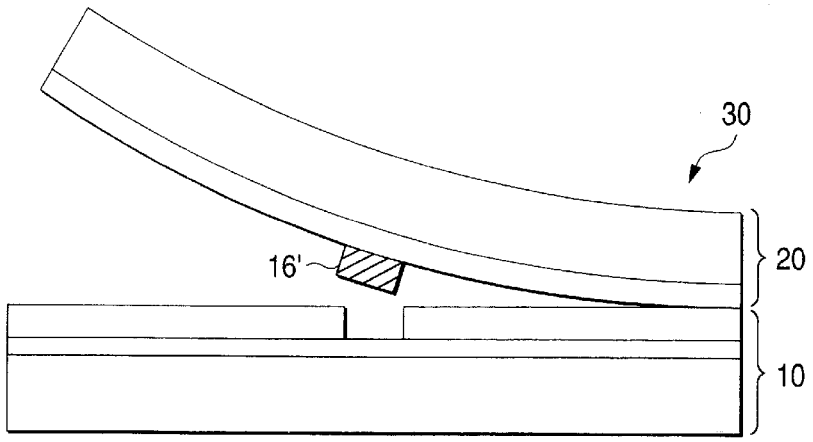
Figure 5:
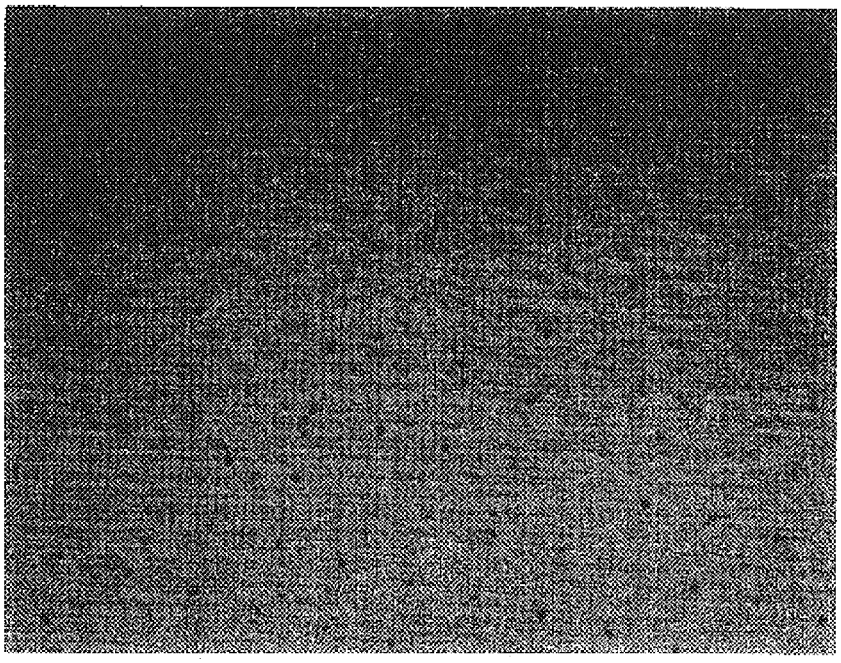
FIG. 5 shows a dot form of an image obtained in an example, and the distance between dot centers is 125 μm.
Figure 6:
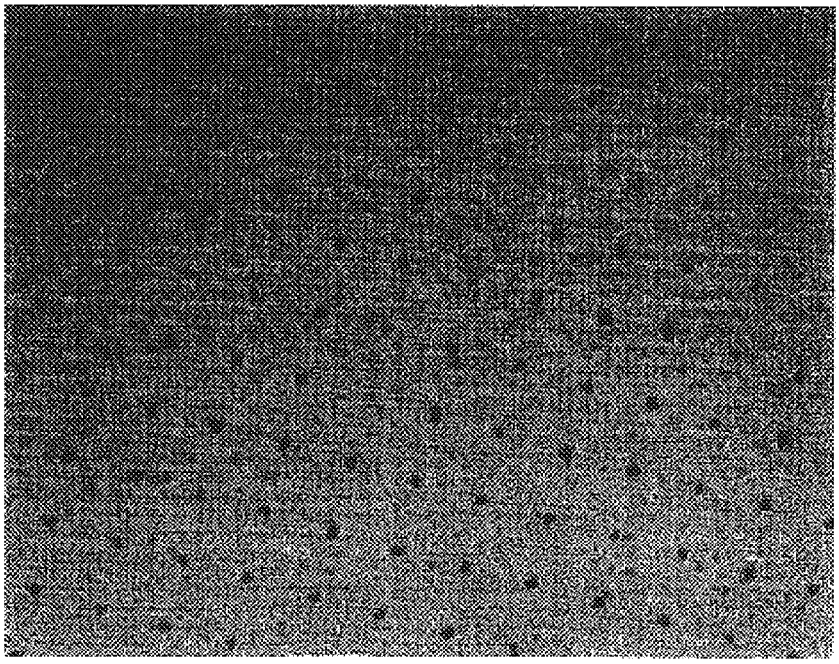
FIG. 6 shows a dot form of an image obtained in an example, and the distance between dot centers is 125 μm.
Figure 7:
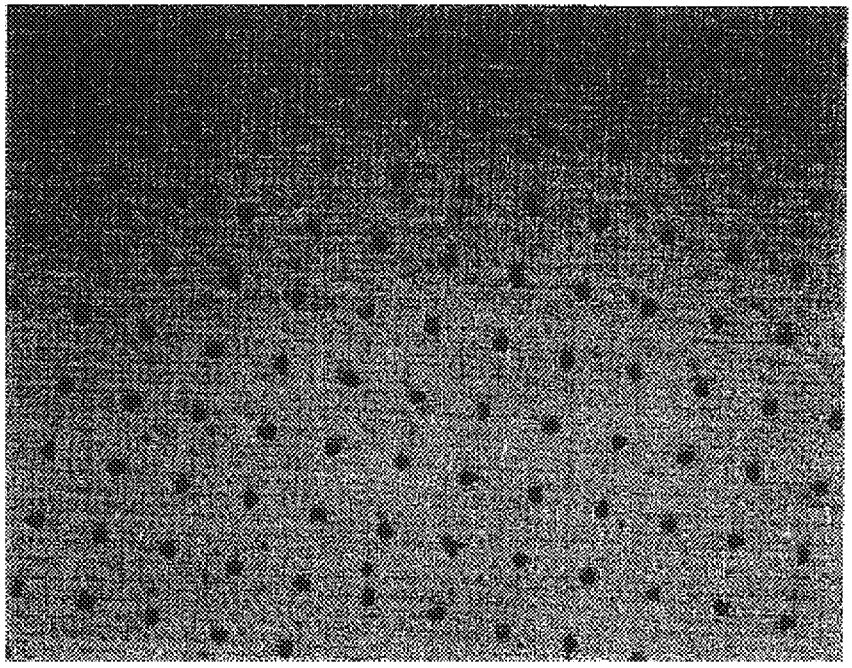
FIG. 7 shows a dot form of an image obtained in an example, and the distance between dot centers is 125 μm.
Figure 8:
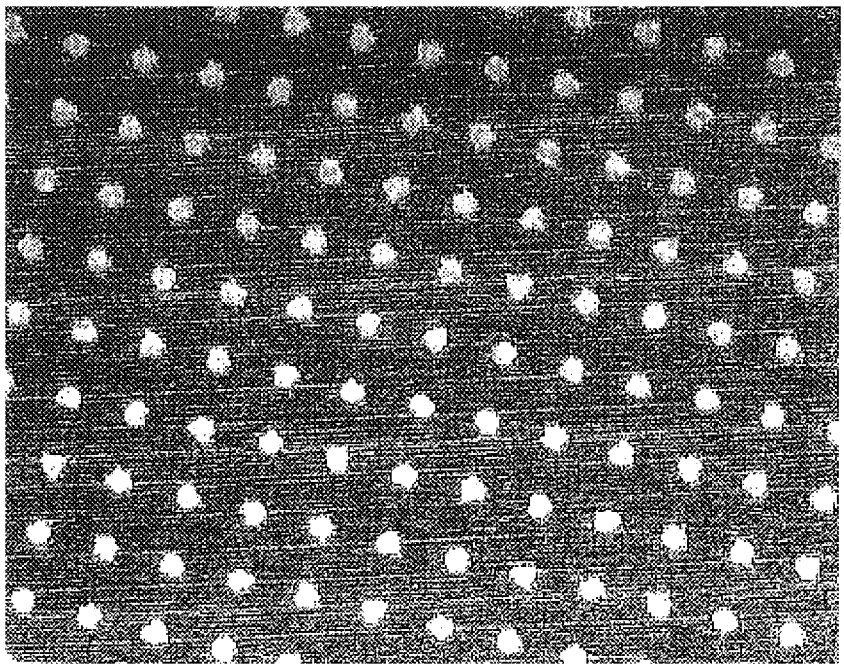
FIG. 8 shows a dot form of an image obtained in an example, and the distance between dot centers is 125 μm.
Figure 9:
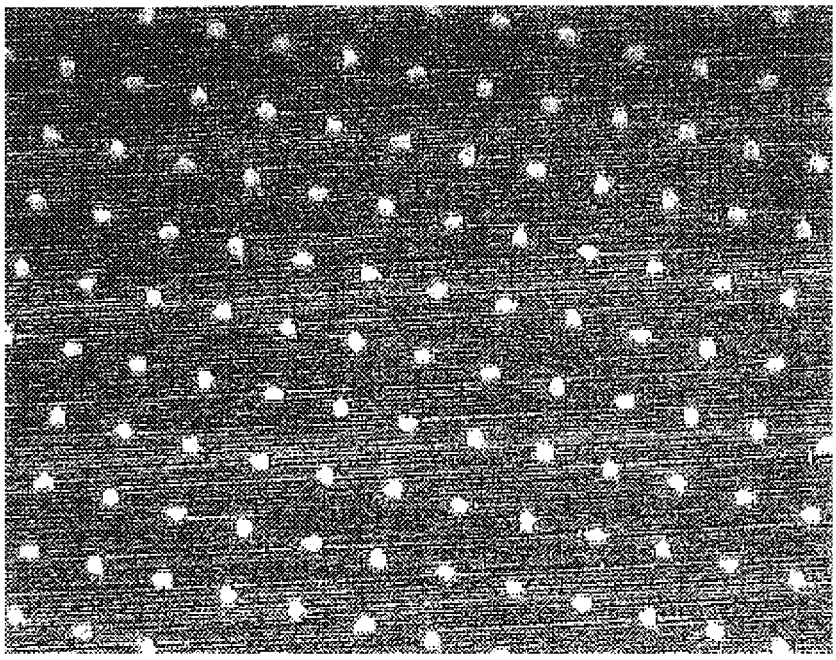
FIG. 9 shows a dot form of an image obtained in an example, and the distance between dot centers is 125 μm.
Figure 10:
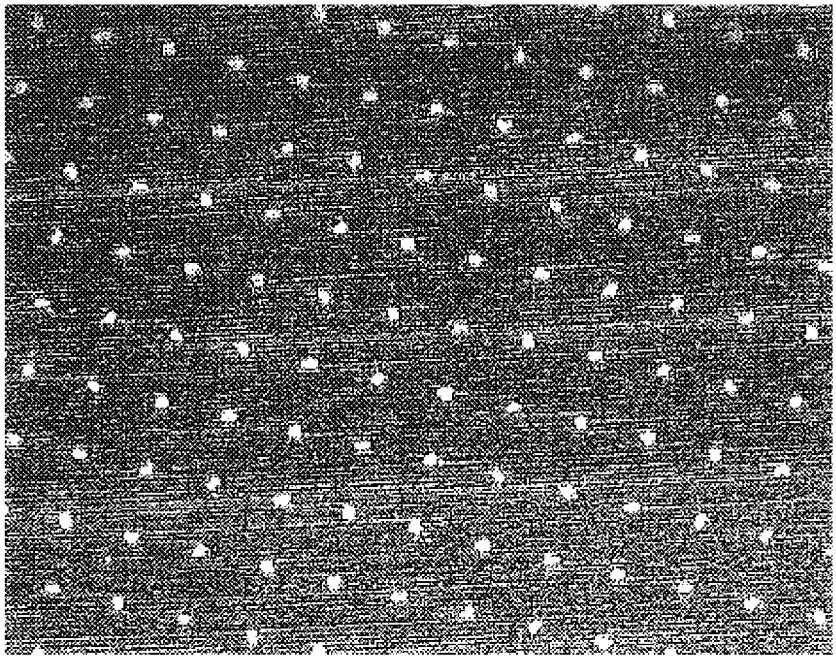
FIG. 10 shows a dot form of an image obtained in an example, and the distance between dot centers is 125 μm.
Figure 11:
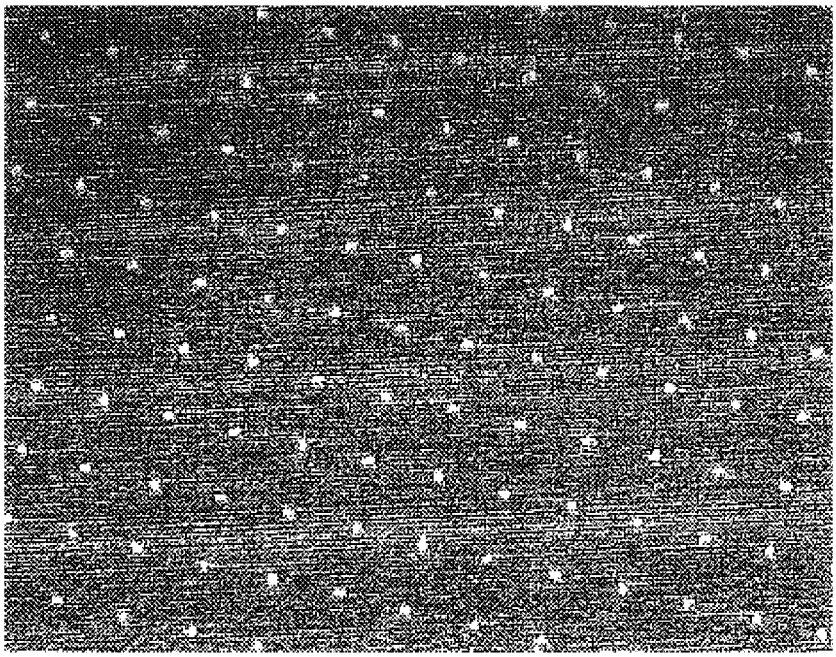
FIG. 11 shows a dot form of an image obtained in an example, and the distance between dot centers is 125 μm.
Figure 12:
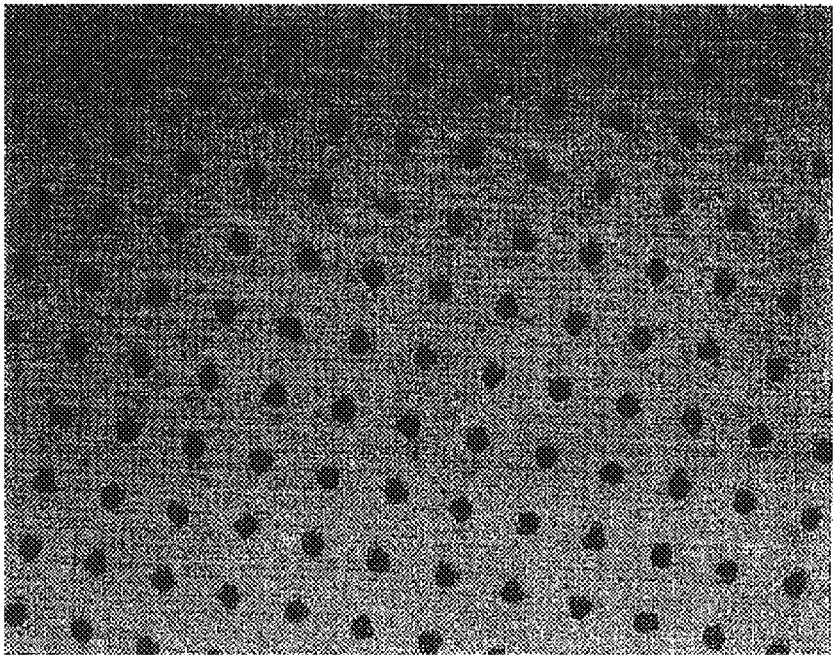
FIG. 12 shows a dot form of an image obtained in an example, and the distance between dot centers is 125 μm.

Then, the outline of a mechanism of multicolor image formation by thin film heat transfer using a laser beam will be described with reference to FIG. 4.

An image receiving sheet 20 is laminated on a surface of an image formation layer 16 of a heat transfer sheet 10, the layer 16 containing a black (K), cyan (C), magenta (M) or yellow (Y) pigment, thereby preparing a laminate 30 for image formation. The heat transfer sheet 10 comprises a support 12 having provided thereon a light-heat conversion layer 14 and an image formation layer 16 in this order. The image receiving layer 20 comprises a support 22 having provided thereon an image receiving layer 24. The image receiving sheet 20 is laminated with the heat transfer sheet 10 in such a manner that the image receiving layer 24 comes in contact with the image formation layer 16 of the heat transfer sheet 10 (FIG. 4(*a*)). When the laminate 30 is irradiated imagewise with a laser beam time-sequentially from the side of the support 12 of the heat transfer sheet 10, a laser beam-irradiated region of the light-heat conversion layer 14 of the heat transfer sheet 10 develops heat to reduce adhesion with the image formation layer 16 (FIG. 4(*b*)). Then, the heat transfer sheet 10 is separated from the image receiving sheet 20, and at this time, a laser beam-irradiated region 16' of the image formation layer 16 is transferred onto the image receiving layer 24 of the image receiving sheet 20 (FIG. 4(*c*)).

In the multicolor image formation, multiple laser beams are preferably used for light irradiation, and a multiple-beam two-dimensional arrangement is particularly preferred. The term "multiple-beam two-dimensional arrangement" means that plural laser beams are used in recording by laser irradiation, and that a spot arrangement of these laser beams is a two-dimensional plane arrangement comprising plural columns along a main scanning direction and plural rows along a sub-scanning direction.

The use of laser beams of the multiple-beam two-dimensional arrangement can decrease the time required for laser recording.

There is no particular limitation on the laser beam used. The available laser beams include gas laser beams such as argon ion laser beams, helium neon laser beams and helium cadmium laser beams, solid laser beams such as YAG laser beams, direct laser beams such as semiconductor laser beams, dye laser beams and excimer laser beams. Laser beams in which the wavelength is converted to half by passing these laser beams through a secondary harmonic element can also be used. In the multicolor image formation method, the use of semiconductor laser beams is preferred, considering output power and the ease of modulation. In the multicolor image formation method, the laser beams are preferably irradiated under such conditions that the beam diameter on the light-heat conversion layer is within the range of 5 μm to 50 μm (particularly 6 μm to 30 μm), and the scanning speed is preferably 1 m/second or more (particularly 3 m/second or more).

Further, in the multicolor image formation, the thickness of the image formation layer in the heat transfer sheet of black is preferably thicker than that of each heat transfer sheet of yellow, magenta and cyan, and from 0.5 μm to 0.7 μm. This can inhibit a decrease in density caused by transfer unevenness when the heat transfer sheet of black is subjected to laser irradiation.

When the thickness of the image formation layer in the heat transfer sheet of black is adjusted to 0.5 μm or more, no transfer unevenness is developed and image density is maintained in recording at high energy. Thus, image density necessary for a print proof can be achieved. This tendency becomes more significant under conditions of high humidity, so that changes in density according to the environment can be inhibited. On the other hand, transfer sensitivity in laser recording can be maintained, and small points and thin lines are also improved, by adjusting the above-mentioned thickness to 0.7 μm or less. This tendency is more significant under conditions of low humidity. Further, resolving power can also be improved. The thickness of the image formation layer in the heat transfer sheet of black is more preferably from 0.55 μm to 0.65 μm, and particularly preferably 0.60 μm.

Further, it is preferred that the thickness of the image formation layer in the heat transfer sheet of black is 0.5 μm to 0.7 μm, and that the thickness of the image formation layer in each heat transfer sheet of yellow, magenta and cyan is from 0.2 μm to less than 0.5 μm.

When the thickness of the image formation layer in each heat transfer sheet of yellow, magenta and cyan is adjusted to 0.2 μm or more, no transfer unevenness is developed and image density is maintained in recording. On the other hand, when the thickness is adjusted to 0.5 μm or less, transfer sensitivity and resolving power can be improved. More preferably, the thickness is from 0.3 μm to 0.45 μm.

It is preferred that the image formation layer in the heat transfer sheet of black contains carbon black. The carbon black preferably comprises at least two kinds of carbon blacks different in coloring power, because reflection density can be controlled while keeping the P/B (pigment/binder) ratio within the constant range.

The coloring power of carbon black is represented by various methods, which include, for example, PVC blackness described in Japanese Patent Laid-Open No. 140033/1998. The PVC blackness is evaluated by adding carbon black to a PVC resin, dispersing it with a twin-roll mill, forming the resulting product into a sheet, and visually judging the blackness of a sample, compared with the blackness of each of carbon blacks "#40" and "#45" manufactured by Mitsubishi Chemical Corporation, which is graded into 1 to 10 and a reference value. Two or more kinds of carbon blacks different in PVC blackness can be appropriately selected for use depending on the purpose.

A specific method for preparing a sample will be described below.

<Method for Preparing Sample>

In a 250-cc Banbury mixer, 40% by weight of sample carbon black is mixed with a LDPE (low-density polyethylene) resin, followed by kneading at 115° C. for 4 minutes.

| Compounding Conditions | |
|---|---|
| LDPE Resin | 101.89 g |
| Calcium Stearate | 1.39 g |
| Irganox 1010 | 0.87 g |
| Sample Carbon Black | 69.43 g |

Then, the kneaded product is diluted to a carbon black concentration of 1% by weight at 120° C. by use of a twin-roll mill.

| Conditions for Preparing Diluted Compound | |
|---|---|
| LDPE Resin | 58.3 g |
| Calcium Stearate | 0.2 g |
| Resin Containing 40% by Weight Carbon Black | 1.5 g |

The compound is formed into a sheet at a slit width of 0.3 mm, and the resulting sheet is cut to chips. Then, the chips are formed into a film having a thickness of 65±3 μm on a hot plate of 240° C.

As a method for forming the multicolor image, many image layers (image formation layers on which images are formed) may be repeatedly overlaid on the same image receiving sheet, using the heat transfer sheet as described above, thereby forming the multicolor image, or images may be once formed on the image receiving layers of the plural image receiving sheets and then transferred again to final print paper, thereby forming the multicolor image.

As to the latter, for example, the heat transfer sheets having the image formation layers containing colorants different from each other in hues are prepared, and combined with the image receiving sheets to independently produce four kinds (four colors, cyan, magenta, yellow and black) of laminates for image formation. Each laminate is subjected to laser irradiation according to a digital signal based on the image, for example, through a color separation filter, and subsequently, each heat transfer sheet is separated from each image receiving sheet to independently form a color separation image of each color on the image receiving sheet. Then, each color separation image formed can be in turn laminated on an actual support such as final print paper separately prepared or a support similar thereto, thereby forming the multicolor image.

In the heat transfer recording using laser beam irradiation, it is preferred that the image is formed on the image receiving sheet by the thin film transfer system in which the laser beam is converted to heat, and the pigment-containing image formation layer is transferred to the image receiving sheet by utilizing the heat energy thus generated. However, the technique used for the development of the image-forming material comprising the heat transfer sheet and the image receiving sheet is appropriately applicable to the development of heat transfer sheets and/or image receiving sheets used in the melt transfer system, ablation transfer system and the sublimation transfer system, and the system of the invention also includes image-forming materials used in these systems.

The heat transfer sheet and the image receiving sheet will be described in details below.

[Heat Transfer Sheet]

The heat transfer sheet comprises the support having provided thereon the light-heat conversion layer and the image formation layer, and further another layer as needed.

(Support)

There is no particular limitation on the material for the support of the heat transfer sheet. Various support materials can be used depending on the purpose. The support materials are preferably ones having rigidity, good in dimensional stability and resistant to heat in image formation. Preferred examples of the support materials include synthetic resin materials such as polyethylene terephthalate, polyethylene 2,6-naphthalate, a polycarbonate, polymethyl methacrylate, polyethylene, polypropylene, polyvinyl chloride, polyvinylidene chloride, polystyrene, a styrene-acrylonitrile copolymer, a polyamide (aromatic or aliphatic), a polyimide, a polyamideimide and a polysulfone. Above all, a biaxially stretched polyethylene terephthalate film is preferred, considering mechanical strength and dimensional stability to heat. When used for the preparation of the color proof utilizing laser recording, the support for the heat transfer sheet is preferably formed from a transparent synthetic resin material transmitting the laser beam. The thickness of the support is preferably from 25 $\mu$m to 130 $\mu$m, and particularly preferably from 50 $\mu$m to 120 $\mu$m. The center line average height Ra of the support on the image formation layer side (measured based on JIS B0601 using a surface roughness tester (Surfcom manufactured by Tokyo Seimitsu Co. Ltd.) is preferably less than 0.1 $\mu$m. Longitudinal Young's modulus of the support is preferably from 200 kg/mm$^2$ to 1200 kg/mm$^2$ (approximately equal to 2 GPa to 12 GPa), and lateral Young's modulus thereof is preferably from 250 kg/mm$^2$ to 1600 kg/mm$^2$ (approximately equal to 2.5 GPa to 16 GPa). The longitudinal F-5 value of the support is preferably from 5 kg/mm$^2$ to 50 kg/mm$^2$ (approximately equal to 49 MPa to 490 MPa), and the lateral F-5 value of the support is preferably from 3 kg/mm$^2$ to 30 kg/mm$^2$ (approximately equal to 29.4 MPa to 294 MPa). The longitudinal F-5 value of the support is generally higher than the lateral F-5 value of the support. However, when it is particularly necessary to increase the lateral strength, this does not apply to the case. The degrees of heat shrinkage of the support in longitudinal and lateral directions at 100° C. for 30 minutes are preferably 3% or less, and more preferably 1.5% or less, and those at 80° C. for 30 minutes are preferably 1% or less, and more preferably 0.5% or less. The breaking strengths are preferably from 5 kg/mm$^2$ to 100 kg/mm$^2$ (approximately equal to 49 MPa to 980 MPa) in both directions, and the elasticities are preferably from 100 kg/mm$^2$ to 2000 kg/mm$^2$ (approximately equal to 0.98 GPa to 19.6 GPa).

For improving the adhesion between the support of the heat transfer sheet and the light-heat conversion layer provided thereon, the support may be subjected to surface activation treatment and/or provided with one or more undercoat layers. The surface activation treatment includes, for example, glow discharge treatment and corona discharge treatment. A material for the undercoat layer is preferably high in adhesion to both surfaces of the support and the light-heat conversion layer, low in heat conductivity and excellent in heat resistance. Examples of such materials include styrene, a styrene-butadiene copolymer and gelatin. The thickness of the whole undercoat layer is usually 0.01 $\mu$m to 2 $\mu$m. Further, a surface on the side opposite to the light-heat conversion layer side of the heat transfer sheet can also be provided with various functional layers such as an antireflection layer and an antistatic layer, or surface treated, as needed.

(Back Layer)

A back layer is preferably provided on the surface on the side opposite to the light-heat conversion layer side of the heat transfer sheet. It is preferred that the support has a first back layer adjacent to the support and a second back layer provided on the side opposite to the first back layer side. In the invention, the ratio of a weight A of an antistatic agent contained in the first back layer to a weight B of that contained in the second back layer (B/A) is preferably less than 0.3. When the B/A ratio is 0.3 or more, lubricity and powdering from the back layer tend to deteriorate.

The thickness C of the first back layer is preferably 0.01 $\mu$m to 1 $\mu$m, and more preferably from 0.01 $\mu$m to 0.2 $\mu$m. The thickness D of the second back layer is preferably 0.01 $\mu$m to 1 $\mu$m, and more preferably from 0.01 $\mu$m to 0.2 $\mu$m. The ratio of the thickness of the first back layer to the thickness of the second back layer (C:D) is preferably from 1:2 to 5:1.

The antistatic agents used in the first and second back layers include nonionic surfactants such as polyoxyethylene-alkylamines and glycerol esters of fatty acids, cationic surfactants such as quaternary ammonium salts, and anionic surfactants such as alkyl phosphates, amphoteric surfactants and compounds such as conductive resins.

Fine conductive particles can also be used as the antistatic agent. Such conductive particles include, for example, Oxides such as ZnO, $TiO_2$, $SnO_2$, $Al_2O_3$, $In_2O_3$, MgO, BaO, CoO, CuO, $Cu_2O$, CaO, SrO, $BaO_2$, PbO, $PbO_2$, $MnO_3$, $MoO_3$, $SiO_2$, $ZrO_2$, $Ag_2O$, $Y_2O_3$, $Bi_2O_3$, $Ti_2O_3$, $Sb_2O_3$, $Sb_2O_5$, $K_2Ti_6O_{13}$, $NaCaP_2O_{18}$ and $MgB_2O_5$; sulfides such as Cus and ZnS; carbides such as SiC, TiC, ZrC, VC, NbC, MoC and WC; nitrides such as $Si_3N_4$, TiN, ZrN, VN, NbN and $Cr_2N$; borides such as $TiB_2$, $ZrB_2$, $NbB_2$, $TaB_2$, CrB, MoB, WB and $LaB_5$; suicides such as $TiSi_2$, $ZrSi_2$, $NbSi_2$, $TaSi_2$, $CrSi_2$, $MoSi_2$ and $WSi_2$; metal salts such as $BaCO_3$, $CaCO_3$, $SrCO_3$, $BaSO_4$ and $CaSO_4$; and complexes such as $SiN_4$—SiC and $9Al_2O_3$—$2B_2O_3$. They may be used either alone or as a combination of two or more of them. Of these, $SnO_2$, ZnO, $Al_2O_3$, $TiO_2$, $In_2O_3$, MgO, BaO and $MoO_3$ are preferred, $SnO_2$, ZnO, $In_2O_3$ and $TiO_2$ are more preferred, and $SnO_2$ is particularly preferred.

When the heat transfer material of the invention is used in the laser heat transfer recording system, it is preferred that the antistatic agent used in the back layer is transparent so that the laser beam can be transmitted.

When the conductive metal oxide is used as the antistatic agent, it is preferred that the particle size thereof is smaller, for minimizing light scattering. This is to be determined using the ratio of the refractive index of the particles to that of a binder as a parameter, and can be determined by using the theory of Mie. In general, the average particle size is within the range of 0.001 μm to 0.5 μm, and preferably within the range of 0.003 μm to 0.2 μm. The term "average particle size" as used herein means a value including not only a primary particle size of the conductive metal oxide, but also a particle size of a higher-order structure.

In addition to the antistatic agent, various additives such as a surfactant, a lubricant and a matte agent and a binder can be added to the first and second back layers. The amount of the antistatic agent contained in the first back layer is preferably from 10 parts to 1000 parts by weight, and more preferably from 200 parts to 800 parts by weight, based on 100 parts by weight of binder. Further, the amount of the antistatic agent contained in the second back layer is preferably from 0 parts to 300 parts by weight, and more preferably from 0 parts to 100 parts by weight, based on 100 parts by weight of binder.

The binders used for formation of the first and second back layers include homopolymers and copolymers of acrylic acid monomers such as acrylic acid, methacrylic acid, acrylates and methacrylates, cellulose esters such as nitrocellulose, methyl cellulose, ethyl cellulose and cellulose acetate, vinyl polymers and copolymers of vinyl compounds such as polyethylene, polypropylene, polystyrene, vinyl chloride copolymers, vinyl chloride-vinyl acetate copolymers, polyvinylpyrrolidone, polyvinyl butyral and polyvinyl alcohol, condensation polymers such as polyesters, polyurethanes and polyamides, rubber thermoplastic polymers such as butadiene-styrene copolymers, polymers obtained by polymerization or crosslinking of photopolymerizable or thermopolymerizable compounds such as epoxy compounds, and melamine compounds.

(Light-Heat Conversion Layer)

The light-heat conversion layer contains a light-heat conversion material and a binder, a matte agent as needed, and further another component as needed.

The light-heat conversion material is a material having the function of converting irradiated light energy to heat energy. In general, it is a dye (including a pigment, hereinafter the same) which can absorb a laser beam. When an image is recorded with an infrared laser, an infrared absorption dye is preferably used as the light-heat conversion material. Examples of the dyes include black pigments such as carbon black, pigments of macrocyclic compounds having absorption in a region from the visible to the near infrared region such as phthalocyanine and naphthalocyanine, organic dyes used as laser absorption materials for high-density laser recording on optical disks (cyanine dyes such as indolenine dyes, anthraquinone dyes, azulene dyes and phthalocyanine dyes), and organic metal compound dyes such as thiol nickel complexes. Above all, the cyanine dyes are preferred, because they show high absorbance index to light in the infrared region, so that the use thereof as the light-heat conversion materials can thin the light-heat conversion layer, resulting in more improvement in the recording sensitivity of the heat transfer sheet.

As the light-heat conversion materials, there can also be used inorganic materials including granular metal materials such as blackened silver.

The binder contained in the light-heat conversion layer is preferably a resin having at least strength enough to form a layer on the support, and high heat conductivity. Further, a heat-resistant resin which is not decomposed even by heat generated from the light-heat conversion material in image recording is preferred, because the smoothness of the surface of the light-heat conversion layer after light irradiation can be maintained even when high-energy light irradiation is carried out. Specifically, a resin having a thermal decomposition temperature (a temperature at which the weight is decreased by 5% in a stream of air at a rate of temperature rise of 10° C./minute by the TGA method (thermal mass spectrometric analysis)) of 400° C. or more is preferred, and a resin having a thermal decomposition temperature of 500° C. or more is more preferred.

It is preferred that the binder has a glass transition temperature of 200° C. to 400° C., and it is more preferred that the binder has a glass transition temperature of 250° C. to 350° C. A glass transition temperature of lower than 200° C. results in development of fogging on an image formed in some cases, whereas exceeding 400° C. results in deterioration of solubility of the resin, which causes production efficiency to decrease in some cases.

It is preferred that the binder used in the light-heat conversion layer is higher in heat resistance (for example, thermal deformation temperature and thermal decomposition temperature) than the materials used in the other layers provided on the light-heat conversion layer.

Specific examples thereof include acrylic acid resins such as polymethyl methacrylate, a polycarbonate, vinyl resins such as polystyrene, a vinyl chloride/vinyl acetate copolymer and polyvinyl alcohol, polyvinyl butyral, polyesters, polyvinyl chloride, polyamides, polyimides, polyetherimides, polysulfones, polyethersulfones, alamid, polyurethanes, epoxy resins and urea/melamine resins. Of these, polyimide resins are preferred.

In particular, polyimide resins represented by the following general formulas (I) to (VII) are soluble in organic solvents, and the use of these polyimide resins is preferred because of improvement in productivity of the heat transfer sheet. Further, the use thereof is preferred also in terms of improvements in viscosity stability, long-term keeping quality and moisture resistance of a coating solution for the light-heat conversion layer.

(I)

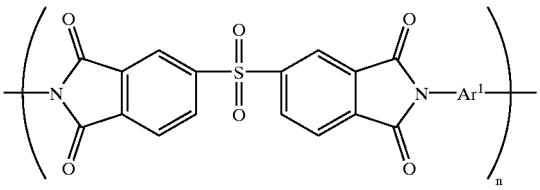

(II)

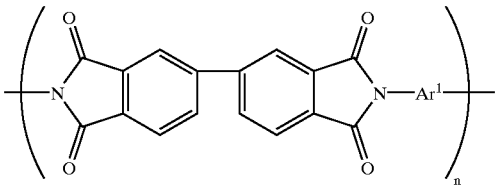

In general formulas (I) and (II), $Ar^1$ represents an aromatic group represented by any one of the following structural formulas (1) to (3), and n represents an integer of from 10 to 100.
(1)
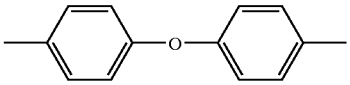
(2)
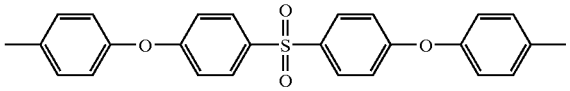
(3)
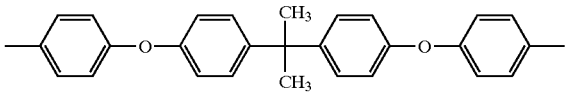
-continued
(III)
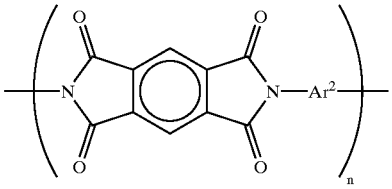
(IV)
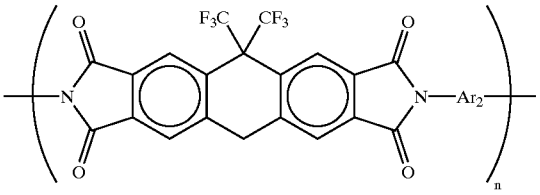
In general formulas (III) and (IV), $Ar^2$ represents an aromatic group represented by any one of the following structural formulas (4) to (7), and n represents an integer of from 10 to 100.
(4)
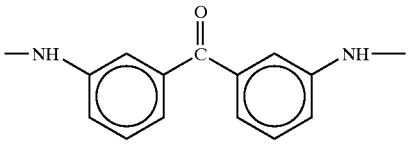
(5)
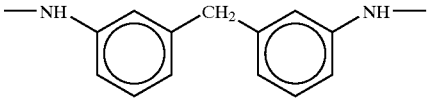
(6)
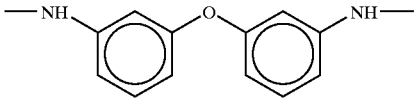
(7)
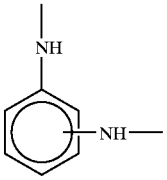
(V)
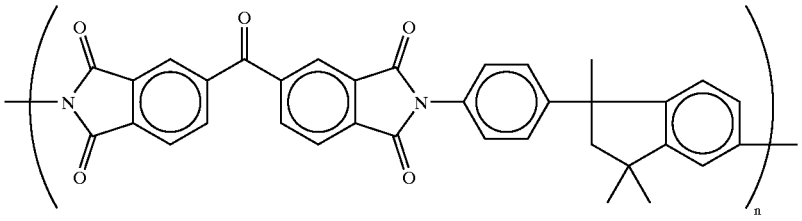
(VI)
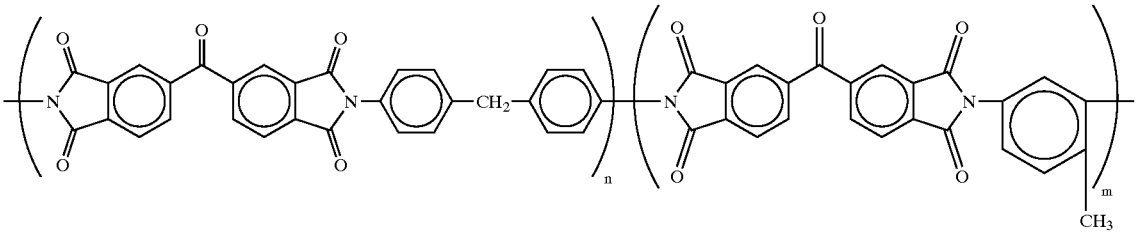
(VII)
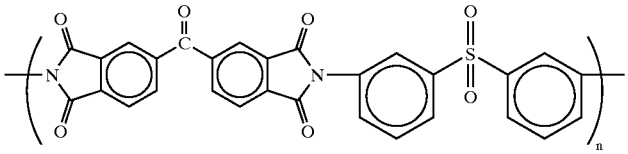

In general formulas (V) to (VII) n and m each represents an integer of from 10 to 100. In general formula (VI), the n:m ratio is from 6:4 to 9:1.

As a measure for judging whether the resin is soluble in the organic solvent or not, the basis that 10 parts by weight or more of the resin is dissolved in 100 parts by weight of N-methylpyrrolidone at 25° C. is used. When the resin is dissolved in an amount of 10 parts by weight or more, it is preferably used as the resin for the light-heat conversion layer. When the resin is dissolved in an amount of 100 parts by weight or more based on 100 parts by weight of N-methylpyrrolidone, that resin is more preferably used.

The matte agents contained in the light-heat conversion layer include fine inorganic particles and fine organic particles. The fine inorganic particles include metal salts such as silica, titanium oxide, aluminum oxide, zinc oxide, magnesium oxide, barium sulfate, magnesium sulfate, aluminum hydroxide, magnesium hydroxide and boron nitride, kaolin, clay, talc, zinc white, white lead, zeaklite, quartz, diatomaceous earth, pearlite, bentonite, mica and synthetic mica. The fine organic particles include resin particles such as fluororesin particles, guanamine resin particles, acrylic resin particles, styrene-acrylic copolymer resin particles, silicone resin particles, melamine resin particles and epoxy resin particles.

The particle size of the matte agent is usually from 0.3 $\mu$m to 30 $\mu$m, and preferably from 0.5 $\mu$m to 20 $\mu$m. The amount thereof added is preferably from 0.1 mg/m$^2$ to 100 mg/m$^2$.

The light-heat conversion layer may further contain a surfactant, a thickening agent and an antistatic agent as needed.

The light-heat conversion layer can be formed by dissolving the light-heat conversion material and the binder, adding thereto the matte agent and other components as needed to prepare a coating solution, applying the solution onto the support, and drying it. organic solvents for dissolving the polyimide resins include, for example, n-hexane, cyclohexane, diglime, xylene, toluene, ethyl acetate, tetrahydrofuran, methyl ethyl ketone, acetone, cyclohexanone, 1,4-dioxane, 1,3-dioxane, dimethyl acetate, N-methyl-2-pyrrolidone, dimethyl sulfoxide, dimethylformamide, dimethylacetoamide, γ-butyrolactone, ethanol and methanol. Coating and drying can be conducted by conventional methods. Drying is conducted usually at a temperature of 300° C. or lower, and preferably at a temperature of 200° C. or lower. When polyethylene terephthalate is used as the support, drying is preferably conducted at a temperature of 80° C. to 150° C.

When the amount of the binder contained in the light-heat conversion layer is too small, the cohesive force of the light-heat conversion layer is decreased, and when the formed image is transferred to the image receiving sheet, the light-heat conversion layer becomes liable to be transferred together, which causes color mixture. Further, when the amount of the polyimide is too large, the thickness of the light-heat conversion layer for achieving a definite light absorption rate is increased to be liable to cause a reduction in sensitivity. The solid weight ratio of the light-heat conversion material to the binder in the light-heat conversion layer is preferably from 1:20 to 2:1, and more preferably from 1:10 to 2:1.

When the light-heat conversion layer is thinned, the sensitivity of the heat transfer sheet is preferably enhanced. The thickness of the light-heat conversion layer is preferably from 0.03 $\mu$m to 1.0 $\mu$m, and more preferably from 0.05 $\mu$m to 0.5 $\mu$m. It is preferred that the light-heat conversion layer has an optical density of 0.90 to 1.41 to a peak wavelength of a laser beam, for example, a wavelength of 808 nm, because the transfer sensitivity of the image formation layer is improved. It is more preferred that the light-heat conversion layer has an optical density of 1.03 to 1.29 to the above-mentioned wavelength. When the optical density at the peak wavelength of the laser beam is less than 0.90, conversion of irradiated light to heat becomes insufficient, sometimes resulting ina reduction in transfer sensitivity. On the other hand, when it exceeds 1.41, the function of the light-heat conversion layer is influenced in recording to cause fogging in some cases.

In the invention, the optical density of the light-heat conversion layer of the heat transfer sheet means the absorbance of the light-heat conversion layer at a peak wavelength of a laser beam used in recording the image-forming material, and can be measured with a known spectrophotometer. In the invention, there is used an UV spectrophotometer, UV-240, manufactured by Shimadzu Corp. The above-mentioned optical density is a value obtained by subtracting a value of the support alone from a value including the support.

(Image Formation Layer)

The image formation layer contains at least a pigment transferred to the image receiving sheet to form an image and further a binder for forming the layer, and another component as needed.

The pigments can be generally classified roughly into organic pigments and inorganic pigments. The former are particularly excellent in transparency of a coating film, and the later are generally excellent in opacifying properties. Accordingly, they may be appropriately selected depending on the purpose. When the above-mentioned heat transfer sheet is used for a print color proof, organic pigments agree with or close in hues to yellow, magenta, cyan and black generally used in print ink are suitably used. Besides, metal powders and fluorescent pigments are also used in some cases. Examples of the pigments suitably used include azo pigments, phthalocyanine pigments, anthraquinone pigments, dioxazine pigments, quinacridone pigments, isoindolinone pigments and nitro pigments. The pigments used for the image formation layer are enumerated below, classified by hue, but are not limited thereto.

1) Yellow Pigments

- Pigment Yellow 12 (C.I. No. 21090)
  - Examples: Permanent Yellow DHG (manufactured by Clariant Japan K.K.), Lionol Yellow 1212B (manufactured by Toyo Ink Mfg. Co. Ltd.), Irgalite Yellow LCT (manufactured by Ciba Specialty Chemicals K.K.) and Symuler Fast Yellow GTF 219 (manufactured by Dainippon Ink & Chemicals Inc.)
- Pigment Yellow 13 (C.I. No. 21100)
  - Examples: Permanent Yellow GR (manufactured by Clariant Japan K.K.) and Lionol Yellow 1313 (manufactured by Toyo Ink Mfg. Co. Ltd.)
- Pigment Yellow 14 (C.I. No. 21095)
  - Examples: Permanent Yellow G (manufactured by Clariant Japan K.K.), Lionol Yellow 1401-G (manufactured by Toyo Ink Mfg. Co. Ltd.), Seika Fast Yellow 2270 (manufactured by Dainichiseika Colour & Chemicals Mfg. Co., Ltd.) and Symuler Fast Yellow GTF4400 (manufactured by Dainippon Ink & Chemicals Inc.)
- Pigment Yellow 17 (C.I. No. 21105)
  - Examples: Permanent Yellow GG02 (manufactured by Clariant Japan K.K.) and Symuler Fast Yellow 8GF (manufactured by Dainippon Ink & Chemicals Inc.)

Pigment Yellow 155
Examples: Graphtol Yellow 3GP (manufactured by Clariant Japan K.K.)
Pigment Yellow 180 (C.I. No. 21290)
Examples: Novoperm Yellow P-HG (manufactured by Clariant Japan K.K.) and PV Fast Yellow HG (manufactured by Clariant Japan K.K.)
Pigment Yellow 139 (C.I. No. 56298)
Examples: Novoperm Yellow M2R 70 (manufactured by Clariant Japan K.K.)

2) Magenta Pigments
Pigment Red 57:1 (C.I. No. 15850:1)
Examples: Graphtol Rubine L6B (manufactured by Clariant Japan K.K.), Lionol Red 6B-4290G (manufactured by Toyo Ink Mfg. Co. Ltd.), Irgalite Rubine 4BL (manufactured by Ciba Specialty Chemicals K.K.) and Symuler Brilliant Carmine 6B-229 (manufactured by Dainippon Ink & Chemicals Inc.)
Pigment Red 122 (C.I. No. 73915)
Examples: Hosterperm Pink E (manufactured by Clariant Japan K.K.), Lionogen Magenta 5790 (manufactured by Toyo Ink Mfg. Co. Ltd.) and Fastogen Super Magenta RH (manufactured by Dainippon Ink & Chemicals Inc.)
Pigment Red 53:1 (C.I. No. 15585:1)
Examples: Permanent Lake Red LCY (manufactured by Clariant Japan K.K.) and Symuler Lake Red C conc (manufactured by Dainippon Ink & Chemicals Inc.)
Pigment Red 48:1 (C.I. No. 15865:1)
Examples: Lionogen Red 2B 3300 (manufactured by Toyo Ink Mfg. Co. Ltd.) and Symuler Red NRY (manufactured by Dainippon Ink & Chemicals Inc.)
Pigment Red 48:2 (C.I. No. 15865:2)
Examples: Permanent Red W2T (manufactured by Clariant Japan K.K.), Lionol Red LX235 (manufactured by Toyo Ink Mfg. Co. Ltd.) and Symuler Red 3012 (manufactured by Dainippon Ink & Chemicals Inc.)
Pigment Red 48:3 (C.I. No. 15865:3)
Examples: Permanent Red 3RL (manufactured by Clariant Japan K.K.) and Symuler Red 2BS (manufactured by Dainippon Ink & Chemicals Inc.)
Pigment Red 177 (C.I. No. 65300)
Examples: Cromophtal Red A2B (manufactured by Ciba Specialty Chemicals K.K.)

3) Cyan Pigments
Pigment Blue 15 (C.I. No. 74160)
Examples: Lionol Blue 7027 (manufactured by Toyo Ink Mfg. Co. Ltd.) and Fastogen Blue BB (manufactured by Dainippon Ink & Chemicals Inc.)
Pigment Blue 15:1 (C.I. No. 74160)
Examples: Hosterperm Blue A2R (manufactured by Clariant Japan K.K.) and Fastogen Blue 5050 (manufactured by Dainippon Ink & Chemicals Inc.)
Pigment Blue 15:2 (C.I. No. 74160)
Examples: Hosterperm Blue AFL (manufactured by Clariant Japan K.K.), Irgalite Blue BSP (manufactured by Ciba Specialty Chemicals K.K.) and Fastogen Blue GP (manufactured by Dainippon Ink & Chemicals Inc.)
Pigment Blue 15:3 (C.I. No. 74160)
Examples: Hosterperm Blue B2G (manufactured by Clariant Japan K.K.), Lionol Blue FG7330 (manufactured by Toyo Ink Mfg. Co. Ltd.), Cromophtal Blue 4GNP (manufactured by Ciba Specialty Chemicals K.K.) and Fastogen Blue FGF (manufactured by Dainippon Ink & Chemicals Inc.)
Pigment Blue 15:4 (C.I. No. 74160)
Examples: Hosterperm Blue BFL (manufactured by Clariant Japan K.K.), Cyanine Blue 700-10FG (manufactured by Toyo Ink Mfg. Co. Ltd.), Irgalite Blue GLNF (manufactured by Ciba Specialty Chemicals K.K.) and Fastogen Blue FGS (manufactured by Dainippon Ink & Chemicals Inc.)
Pigment Blue 15:6 (C.I. No. 74160)
Examples: Lionol Blue ES (manufactured by Toyo Ink Mfg. Co. Ltd.)
Pigment Blue 60 (C.I. No. 69800)
Examples: Hosterperm Blue RL01 (manufactured by Clariant Japan K.K.) and Lionogen Blue 6501 (manufactured by Toyo Ink Mfg. Co. Ltd.)

4) Black Pigments
Pigment Black 7 (Carbon Black C.I. No. 77266)
Examples: Mitsubishi Carbon Black MA100 (manufactured by Mitsubishi Chemical Corporation), Mitsubishi Carbon Black #5 (manufactured by Mitsubishi Chemical Corporation) and Black Pearls 430 (manufactured by Cabot Co.).

As the pigments which can be used in the invention, commercial products can be appropriately selected by reference to "Ganryo Binran (Pigment Handbook)" edited by Nippon Ganryo Gijutsu Kyokai, Seibundo Shinkosha, 1989 and "Colour Index" Third Edition, The Society of Dyes & Colourist, 1987.

The average particle size of the above-mentioned pigment is preferably from 0.03 μm to 1 μm, and more preferably from 0.05 μm to 0.5 μm.

When the particle size is 0.03 μm or more, neither dispersion cost rises, nor the dispersion solution gels. On the other hand, when the particle size is 1 μm or less, no coarse particles exist in the pigment, so that the adhesion between the image formation layer and the image receiving layer is good, and the transparency of the image formation layer can also be improved.

As the binder for the image formation layer, an amorphous organic polymer having a softening point of 40° C. to 150° C. is preferred. The amorphous organic polymers which can be used include, for example, butyral resins, polyamide resins, polyethyleneimine resins, sulfonamide resins, polyesterpolyol resins, petroleum resins, homopolymers or copolymers of styrene and derivatives thereof such as styrene, vinyltoluene, α-methylstyrene, 2-methylstyrene, chlorostyrene, vinylbenzoic acid, sodium vinylbenzenesulfonate and aminostyrene, and homopolymers of vinyl monomers such as methacrylates such as methyl methacrylate, ethyl methacrylate, butyl methacrylate and hydroxyethyl methacrylate, methacrylic acid, acrylates such as methyl acrylate, ethyl acrylate, butyl acrylate and α-ethylhexyl acrylate, acrylic acid, dienes such as butadiene and isoprene, acrylonitrile, vinyl ethers, maleic acid and maleates maleic anhydride, cinnamic acid, vinyl chloride and vinyl acetate, or copolymers thereof with other monomers. These resins can also be used as a mixture of two or more of them.

The image formation layer contains the pigment preferably in an amount of 30% to 70% by weight, and more preferably in an amount of 30% to 50% by weight. Further, the image formation layer contains the resin in an amount of 30% to 70% by weight, and more preferably in an amount of 40% to 70% by weight.

The image formation layer can contain the following components of (1) to (3) as the other components.

(1) Waxes

A wax is used not only as a lubricant used for controlling the scratch resistance constant on the side of the heat transfer sheet on which the image formation layer is formed, but also for improvement of coating film performance of the image formation layer. The waxes used in this case include the same ones as used as the above-mentioned lubricants. That is to say, the waxes include mineral waxes, natural waxes and synthetic waxes. Examples of the mineral waxes include petroleum wax such as paraffin wax, microcrystalline wax, ester wax and oxide wax, montan wax, ozokerite and ceresin wax. Above all, paraffin wax is preferred. The paraffin wax is separated from petroleum, and variously on the market according to its melting point.

Examples of the natural waxes include plant waxes such as carnauba wax, Japan tallow, auricurie wax and espar wax, and animal waxes such as beeswax, insect wax, shellac wax and spermaceti.

The synthetic wax is generally used as a lubricant, and usually comprises higher fatty acid compounds. Examples of the synthetic waxes include the following.

1) Fatty Acid Waxes

Straight chain saturated fatty acids represented by the following general formula:

$$CH_3(CH_2)_nCOOH$$

wherein n represents an integer of from 6 to 28, preferably from 10 to 30. Specific examples thereof include stearic acid, behenic acid, palmitic acid, 12-hydroxystearic acid and azelaic acid.

They further include metal salts (for example, K, Ca, Zn and Mg salts) of the above-mentioned fatty acids.

2) Fatty Acid Ester Waxes

Specific examples of esters of the above-mentioned fatty acids include ethyl stearate, lauryl stearate, ethyl behenate, hexyl behenate and behenyl myristate.

3) Fatty Acid Amide Waxes

Specific examples of fatty acid amides include stearic acid amide and lauric acid amide.

4) Aliphatic Alcohol Waxes

Straight chain saturated aliphatic alcohols represented by the following general formula:

$$CH_3(CH_2)_nOH$$

wherein n represents an integer of from 6 to 28. Specific examples thereof include stearyl alcohol.

Of the synthetic waxes of the above 1) to 4), particularly suitable are higher fatty acid amides such as stearic acid amide and lauric acid amide. The above-mentioned wax compounds can be used either alone or as a combination of two or more of them as desired.

(2) Plasticizers

As the plasticizers, preferred are ester compounds, which include known plasticizers, for example, phthalates such as dibutyl phthalate, di-n-octyl phthalate, di(2-ethylhexyl) phthalate, dinonyl phthalate, dilauryl phthalate, butyllauryl phthalate and butylbenzyl phthalate, aliphatic dibasic acid esters such as di(2-ethylhexyl) adipate and di(2-ethylhexyl) sebacate, phosphoric triesters such as tricresyl phosphate and tri(2-ethylhexyl) phosphate, polyolpolyesters such as polyethylene glycol esters, and epoxy compounds such as epoxy fatty acid esters. Of these, esters of vinyl monomers, particularly esters of acrylic acid or methacrylic acid, are preferred because addition thereof improves transfer sensitivity and gives the great effects of improving transfer unevenness and controlling breaking elongation.

The ester compounds of acrylic acid or methacrylic acid include polyethylene glycol dimethacrylate, 1,2,4-butanetriol trimethacrylate, trimethylolethane triacrylate, pentaerythritol acrylate, pentaerythritol tetraacrylate and dipentaerythritol polyacrylate.

The plasticizers may be polymers. Above all, the polyesters are preferred because they have the great addition effect and are difficult to diffuse under storage conditions. The polyesters include, for example, sebacic acid polyesters and adipic acid polyesters. The above-mentioned additives contained in the image formation layer are not limited thereto. The plasticizers may be used alone or as a combination of two or more of them.

When the amount of the above-mentioned additive contained in the image formation layer is too large, the resolution of the transferred image is deteriorated, the film strength of the image formation layer itself is decreased, or an unexposed area is transferred to the image receiving sheet due to a reduction in adhesion between the light-heat conversion layer and the image formation layer in some cases. From the above-mentioned viewpoint, the content of the wax is preferably from 0.1% to 30% by weight, and more preferably from 0.1% to 10% by weight, based on the total solid matter contained in the image formation layer.

(3) Others

The image receiving layer may further contain a surfactant, fine inorganic or organic particles, oils (such as linseed oil and mineral oil), a thickening agent and an antistatic agent, in addition to the above-mentioned components. Except for the case that a black image is obtained, energy necessary for transfer can be decrease by containing a substance absorbing the wavelength of a light source used for image recording. The substance absorbing the wavelength of a light source may be either a pigment or a dye. For obtaining a color image, it is preferred in respect to color reproduction that an infrared light source such as a semiconductor laser is used for image recording, and that a dye low in absorption in the visible region and high in absorption of the wavelength of the light source is used. Examples of the near infrared dyes include compounds described in Japanese Patent Laid-Open No. 103476/1991.

The image formation layer can be formed by dissolving or dispersing the pigment and the binder to prepare a coating solution, applying the solution onto the light-heat conversion layer (when a heat-sensitive release layer described below is provided on the light-heat conversion layer, applying the solution onto the heat-sensitive release layer) and drying it. Solvents used for preparing the coating solutions include n-propyl alcohol, methyl ethyl ketone, propylene glycol monomethyl ether (MFG), methanol and water. Coating and drying can be conducted by conventional methods.

The heat-sensitive release layer can be provided on the light-heat conversion layer of the heat transfer sheet. The heat-sensitive release layer contains a heat-sensitive material generating gas or releasing water of adhesion by the action of heat developed in the light-heat conversion layer, thereby weakening the bonding strength between the light-heat conversion layer and the image formation layer. As such a heat-sensitive material, there can be used a compound (polymer or low molecular weight compound) which itself is decomposed or deteriorated by heat to generate gas, or a compound (polymer or low molecular weight compound) by which a considerable amount of easily volatile gas such as moisture is absorbed or adsorbed. These may be used in combination.

Examples of the polymers decomposed or deteriorated by heat to generate gas include self-oxidative polymers such as nitrocellulose, halogen-containing polymers such as chlorinated polyolefin, chlorinated rubber, polychlorinated rubber, polyvinyl chloride and polyvinylidene chloride, acrylic polymers such as polyisobutyl methacrylate by which a volatile compound such as moisture is adsorbed, cellulose esters such as ethyl cellulose by which a volatile compound such as moisture is adsorbed and natural polymers such as gelatin by which a volatile compound such as moisture is adsorbed. Examples of the low molecular weight compounds decomposed or deteriorated by heat to generate gas include compounds decomposed by heat generation to generate gas such as diazo compounds and azide compounds.

The decomposition or deterioration of the heat-sensitive materials by heat as described above occurs preferably at a temperature of 280° C. or less, particularly preferably at a temperature of 230° C. or less.

When the low molecular weight compound is used as the heat-sensitive material of the heat-sensitive release layer, it is desirable to use the compound in combination with a binder. As the binder, there can also be used the above-mentioned polymer which itself is decomposed or deteriorated by heat to generate gas. However, a general binder not having such a property can also be used. When the low molecular weight compound and the binder are used in combination, the weight ratio of the former to the latter is preferably from 0.02:1 to 3:1, and more preferably from 0.05:1 to 2:1. It is desirable that almost the whole surface of the light-heat conversion layer is covered with the heat-sensitive release layer, the thickness of which is generally from 0.03 μm to 1 μn, and preferably within the range of 0.05 μm to 0.5 μm.

In the case of the heat transfer sheet in which the light-heat conversion layer, the heat-sensitive release layer and the image formation layer are provided on the support in this order, the heat-sensitive release layer is decomposed or deteriorated by heat transmitted from the light-heat conversion layer to generate gas. Then, this decomposition or gas generation causes the heat-sensitive release layer to partly disappear or causes cohesive failure to occur in the heat-sensitive release layer, which decreases the bonding force between the light-heat conversion layer and the image formation layer. Accordingly, depending on the behavior of the heat-sensitive release layer, a part of the heat-sensitive release layer adheres to the image formation layer, and appears on a surface of a finally formed image to cause color mixture of the image in some cases. It is therefore desirable that the heat-sensitive release layer is scarcely colored, that is to say, has high transparency to visible light so that no visible color mixture appears on the image formed even when such transfer of the heat-sensitive release layer occurs. Specifically, the light absorption rate of the heat-sensitive release layer is 50% or less, and preferably 10% or less, based on that of visible light.

In stead of the heat-sensitive release layer independently formed on the heat transfer sheet, the above-mentioned heat-sensitive material may be added to a coating solution for the light-heat conversion layer to form the light-heat conversion layer which serves both as the light-heat conversion layer and the heat-sensitive release layer.

The coefficient of static friction of the uppermost layer on the side of the heat transfer sheet on which the image formation layer is provided is preferably 0.35 or less, and more preferably 0.20 or less. Roll contamination in conveying the heat transfer sheet can be prevented and the image quality of the image formed can be improved by adjusting the coefficient of static friction of the uppermost layer to 0.35 or less. The coefficient of static friction is measured according to a method described in Japanese Patent Application No. 2000-85759, paragraph (0011).

The smooster value [means a value measured by apparatus called smooster: Digital Smooster DSM-2 Type manufactured by TOKYO ELECTRONIC INDUSTRY CO., LTD.] of the surface of the image formation layer is preferably from 0.5 mmHg to 50 mmHg (approximately equal to 0.0665 kPa to 6.65 kPa) at 23° C. and 55% RH, and Ra is preferably from 0.05 μm to 0.4 μm. This can decrease a large number of micro voids which prevent the image receiving layer and the image formation layer from coming contact with each other at contact surfaces thereof, and is preferred in terms of transfer and further image quality. The above-mentioned Ra value can be measured based on JIS B0601 using a surface roughness tester (Surfcom manufactured by Tokyo Seimitsu Co. Ltd.). When the heat transfer sheet is charged according to the Federal Government Test Standard 4046, followed by grounding of the heat transfer sheet, the charged potential is preferably from −100 V to 100 V, one second after grounding. The surface resistance of the image formation layer is preferably $10^{9}\Omega$ or less at 23° C. and 55% RH.

Then, the image receiving sheet will be described which can be used in combination with the above-mentioned heat transfer sheet.

[Image Receiving Sheet]

(Layer Constitution)

The image receiving sheet usually comprises a support having provided thereon one or more image receiving layers. One or more layers of any of a cushion layer, a release layer and an intermediate layer are provided between the support and the image receiving layer as desired. It is preferred in respect to conveying properties that the support has a back layer on the side opposite to the image receiving layer.

(Support)

The supports include usual sheet-like base materials such as plastic sheets, metal sheets, glass sheets, resin-coated paper, paper and various composite materials. Examples of the plastic sheets include polyethylene terephthalate sheets, polycarbonate sheets, polyethylene sheets, polyvinyl chloride sheets, polyvinylidene chloride sheets, polystyrene sheets, styrene-acrylonitrile sheets and polyester sheets. As the paper, there can be used final print paper and coated paper.

It is preferred that the support has minute voids, because the image quality can be improved. Such a support can be prepared, for example, by mixing a thermoplastic resin with a filler comprising an inorganic pigment or a polymer incompatible with the above-mentioned thermoplastic resin to prepare a mixed melt, forming the melt into a monolayer or multilayer film through a melt extruder, and stretching the film uniaxially or biaxially. In this case, the percentage of voids is determined depending on the selection of the resin and the filler, the mixing ratio and the stretching conditions.

As the thermoplastic resins, preferred are polyethylene terephthalate resins and polyolefin resins such as polypropylene, because of their good crystallinity, good stretchability and easy formation of voids. It is preferred that the polyolefin resin or the polyethylene terephthalate resin is used as a main component, appropriately in combination with a small amount of another thermoplastic resin. As an inorganic pigment used as the filler, one having an average particle size of 1 μm to 20 μm is preferred. Such inorganic pigments include calcium carbonate, clay, diatomaceous earth, titanium oxide, aluminum hydroxide and silica. As the incompatible resin used as the filler, when polypropylene is used as the thermoplastic resin, polyethylene terephthalate is preferably used as the filler in combination. Details of the support having minute voids are described in Japanese Patent Application No. 290570/1999.

The content of the filler such as the inorganic pigment in the support is generally from about 2% to about 30% by volume.

The thickness of the support of the image receiving sheet is usually from 10 μm to 400 μm, and preferably from 25 μm to 200 μm. A surface of the support may be subjected to surface treatment such as corona discharge treatment and glow discharge treatment for enhancing adhesion to the image receiving layer (or the cushion layer) or adhesion to the image formation layer of the heat transfer sheet.

(Image Receiving Layer)

For transferring the image formation layer onto a surface of the image receiving sheet and fixing it, one or more image receiving layers are preferably provided on the support. The image receiving layer is preferably a layer mainly composed of an organic polymer binder. The binder is preferably a thermoplastic resin. Examples thereof include homopolymers and copolymers of acrylic monomers such as acrylic acid, methacrylic acid, acrylates and methacrylates, cellulose polymers such as methyl cellulose, ethyl cellulose and cellulose acetate, homopolymers and copolymers of vinyl monomers such as polystyrene, polyvinylpyrrolidone, polyvinyl butyral, polyvinyl alcohol and polyvinyl chloride, condensation polymers such as polyesters and polyamides, and rubber polymers such as butadiene-styrene copolymers.

Above all, for adjusting the dynamic frictional force between the image receiving face of the image receiving sheet and the back face opposite thereto to 30 gf to 120 gf, it is desirable to use at least one polymer binder selected from a half-esterified product of a styrene-maleic acid copolymer, a half-esterified product of a styrene-fumaric acid copolymer and an esterified product of a styrene-acrylic acid copolymer.

The above-mentioned binder polymers may be used as a combination of two or more of them. However, it is preferred that at least one selected from a half-esterified product of a styrene-maleic acid copolymer, a half-esterified product of a styrene-fumaric acid copolymer and an esterified product of a styrene-acrylic acid copolymer amounts to 10% to 40% by weight of the binder polymers.

The binder of the image receiving layer is preferably a polymer having a glass transition temperature (Tg) of 90° C. or less for obtaining the proper adhesion between the image receiving layer and the image formation layer. For this purpose, it is also possible to add a plasticizer to the image receiving layer. Further, it is preferred that the binder polymer has a Tg of 30° C. or more for preventing blocking between the sheets. As the binder polymer of the image receiving layer, a polymer identical to or similar to the binder polymer of the image formation layer is particularly preferably used in terms of improvement in adhesion with the image formation layer in laser recording and improvement in sensitivity and image strength.

The smooster value of the surface of the image receiving layer is preferably from 0.5 mmHg to 50 mmHg (approximately equal to 0.0665 kPa to 6.65 kPa) at 23° C. and 55% RH, and Ra is preferably from 0.05 μm to 0.4 μm. This can decrease a large number of micro voids which prevent the image receiving layer and the image formation layer from coming contact with each other at contact surfaces thereof, and is preferred in terms of transfer and further image quality. The above-mentioned Ra value can be measured based on JIS B0601 using a surface roughness tester (Surfcom manufactured by Tokyo Seimitsu Co. Ltd.). When the image receiving sheet is charged according to the Federal Government Test Standard 4046, followed by grounding of the image receiving sheet, the charged potential is preferably from −100 V to 100 V, one second after grounding. The surface resistance of the image receiving layer is preferably $10^9\Omega$ or less at 23° C. and 55% RH. The coefficient of static friction of the surface of the image receiving layer is preferably 0.2 or less. The surface energy of the surface of the image receiving layer is preferably from 23 mg/m$^2$ to 35 mg/m$^2$.

When the image once formed on the image receiving layer is transformed again to final print paper, it is also preferred that at least one image receiving layer is formed of a photo-curing material. The composition of such a photo-curing material include, for example, a combination of a) a photo-curing monomer comprising at least one multifunctional vinyl or vinylidene compound which can form a photopolymer by addition polymerization, b) an organic polymer, c) a photopolymerization initiator, and an additive such as a thermopolymerization inhibitor as needed. As the multifunctional vinyl monomer, there is used an unsaturated ester of a polyol, particularly an acrylate or methacrylate (for example, ethylene glycol diacrylate or pentaerythritol tetraacrylate).

The organic polymer includes the above-mentioned image receiving layer forming polymer. As the photopolymerization initiator, a conventional photoradical polymerization initiator such as benzophenone or Michler's ketone is used in an amount of 0.1% to 20% by weight in the layer.

The thickness of the image receiving layer is from 0.3 μm to 7 μm, and preferably 0.7 μm to 4 μm. In the case of 0.3 μm or more, the film strength is secured when the image is transferred again to final print paper. Adjustment to 4 μm or less lowers the glossiness of the image transferred again to the final paper, thereby improving the approximation to printed matter.

(Other Layers)

A cushion layer may be provided between the support and the image receiving layer. The use of the cushion layer improves the adhesion between the image formation layer and the image receiving layer in laser heat transfer to improve image quality. Further, even when foreign matter enters between the heat transfer sheet and the image receiving sheet in recording, the clearance between the image receiving layer and the image formation layer is decreased by the deformation action of the cushion layer. As a result, the size of an image defect such as a blank are a canal so be decreased. Furthermore, when the image formed by transfer is transferred again to final print paper separately prepared, the image receiving surface is deformed depending on the uneven surface of the paper, so that the transferring properties of the image receiving layer can be improved, and the approximation to printed matter can also be improved by lowering the glossiness of the image transferred.

The cushion layer is easily deformable when the image receiving layer is stressed. For achieving the above-mentioned effect, the cushion layer is preferably formed of a material having low elasticity, a material having rubber elasticity or a thermoplastic resin easily softened by heating. The elasticity of the cushion layer is preferably from 0.5 MPa to 1.0 GPa, more preferably from 1 MPa to 0.5 GPa, and still more preferably 10 MPa to 100 MPa, at room temperature. Further, for allowing foreign matter such as dust to sink into the cushion layer, the penetration (25° C., 100 g, 5 seconds) defined by JIS K2530 is preferably 10 or more. Furthermore, the glass transition temperature of the cushion layer is preferably 80° C. or less, and more preferably 25° C. or less. The softening point thereof is preferably from 50° C. to 200° C. For controlling these properties, for example, Tg, it is also suitable to add a plasticizer to the binder.

Specific materials used as the binders of the cushion layers include polyethylene, polypropylene, polyesters, styrene-butadiene copolymers, ethylene-vinyl acetate copolymers, ethylene-acrylic copolymers, vinyl chloride-vinyl acetate copolymers, vinylidene chloride resins, plasticizer-containing vinyl chloride resins, polyamide resins and phenol resins, as well as rubbers such as urethane rubber, butadiene rubber, nitrile rubber, acrylic rubber and natural rubber.

Although the thickness of the cushion layer varies depending on the resin used and other conditions, it is usually from 3 μm to 100 μm, and preferably from 10 μm to 52 μm.

The image receiving layer and the cushion layer are required to be adhered to each other until the step of laser recording. However, for transferring the image to the final print paper, they are preferably releasable from each other. For making the release easy, it is also preferred that a release layer having a thickness of about 0.1 μm to about 2 μm is provided between the cushion layer and the image receiving layer. Too thick a layer thickness results in the difficulty of exhibiting the performance of the cushion layer, so that it is necessary to adjust by the kind of release layer.

Specific examples of binders for the release layer include polyolefin, a polyester, polyvinyl acetal, polyvinyl formal, polyparabanic acid, polymethyl methacrylate, a polycarbonate, ethyl cellulose, nitrocellulose, methyl cellulose, carboxymethyl cellulose, hydroxypropyl cellulose, polyvinyl alcohol, polyvinyl chloride, a urethane resin, a fluororesin, polystyrene, styrene derivatives such as acrylonitrilestyrene, crosslinked products of these resins, thermosetting resins having a Tg of 65° C. or more such as a polyamide, a polyimide, a polyether imide, a polysulfone, a polyethersulfone and alamid, and cured products of these resins. As a curing agent, there can be used a general curing agent such as an isocyanate or melamine.

When the binders for the release layer are selected to the above-mentioned properties, a polycarbonate, acetal and ethyl cellulose are preferred in terms of keeping properties, and the use of an acrylic resin in the image receiving layer is particularly preferred, because the releasability is improved in transferring again the image after laser heat transfer.

Separately, a layer extremely decreased in the adhesion with the image receiving layer in cooling can be utilized as the release layer. Specifically, a layer mainly composed of a thermoplastic resin or a heat-meltable compound such as wax or binder can be used.

The heat-meltable compounds are described in Japanese Patent Laid-Open No. 193886/1988. In particular, microcrystalline wax, paraffin wax and carnauba wax are preferably used as the thermoplastic resins, there are preferably used ethylenic copolymers such as ethylene-vinyl acetate resins, and cellulose resins.

A higher fatty acid, a higher alcohol, a higher fatty acid ester, an amide or a higher amine can be added as an additive to the release layer as needed.

Another constitution of the release layer is a layer having releasability by cohesive failure of itself developed by melting or softening in heating. It is preferred that a supercooling material is added to such a release layer.

The supercooling materials include poly-ε-caprolactone, polyoxyethylene, benzotriazole, tribenzylamine and vanillin.

Further, in still another constitution of the release layer, a compound decreasing the adhesion with the image receiving layer is contained. Such compounds include silicone resins such as silicone oil; fluororesins such as Teflon and fluorine-containing acrylic resins; polysiloxane resins; acetal resins such as polyvinyl butyral, polyvinyl acetal and polyvinyl formal; solid waxes such as polyethylene wax and amide wax; and surfactants of the fluorine family or the phosphate family.

As to methods for forming the release layer, the above-mentioned material is dissolved or dispersed in the latex form in a solvent, and applied onto the cushion layer by coating methods such as blade coating, roll coating, bar coating, curtain coating and gravure coating, or extrusion lamination by hot melt. Alternatively, the above-mentioned material is dissolved or dispersed in the latex form in a solvent, and applied onto a temporary base by the above-mentioned methods. Then, the cushion layer is laminated therewith, followed by separation of the temporary base to form the release layer.

In the image receiving sheet combined with the heat transfer sheet, the image receiving layer may also serve as the cushion layer. In this case, the image receiving sheet may have the constitution of a support/a cushioning image receiving layer, or a support/an undercoat layer/a cushioning image receiving layer. Also in this case, it is preferred that the cushioning image receiving layer is provided releasably so that the image can be transferred again to the final print paper. In this case, the image transferred again to the final print paper is excellent in glossiness.

The thickness of the cushioning image receiving layer is from 5 μm to 100 μm, and preferably from 10 μm to 40 μm.

It is preferred that the image receiving sheet is provided with a back layer on the side opposite to the face on which the image receiving layer is formed, because the conveying properties of the image receiving sheet are improved. For improving the conveying properties in the recording device, it is also preferred that an antistatic agent such as a surfactant or fine tin oxide particles or a matte agent such as silicon oxide or PMMA particles is added to the back layer.

The above-mentioned additive can be added not only to the back layer, but also to the image receiving layer and the other layers as needed. The kind of additive can not be defined indiscriminately depending on the purpose thereof. For example, in the case of the matte agent, particles having an average particle size of 0.5 μm to 10 μm can be added to the layer in an amount of about 0.5% to 80% by weight the antistatic agent can be selected from various surfactants and conductive agents for use so as to give a layer surface resistance of $10^{12}\Omega$ or less, preferably $10^{9}\Omega$ or less, at 23° C. and 50% RH.

Binders used for the back layer include general-purpose polymers such as gelatin, polyvinyl alcohol, methyl cellulose, nitrocellulose, acetyl cellulose, an aromatic polyamide, a silicone resin, an epoxy resin, an alkyd resin, a phenol resin, a melamine resin, a fluororesin, a polyimide resin, a urethane resin, an acrylic resin, a urethane-modified silicone resin, a polyethylene resin, a polypropylene resin, a polyester resin, a Teflon resin, a polyvinyl butyral resin, a vinyl chloride resin, polyvinyl acetate, a polycarbonate, an organic boron compound, an aromatic ester, polyurethane fluoride and a polyethersulfone.

It is effective for prevention of powdering of the matte agent and improvement in scratch resistance of the back layer that a crosslinkable water-soluble binder is used as the binder for the back layer and crosslinked. This also has the great effect of preventing a blocking in storage.

As the crosslinking means, any one of heat, active light and pressure or a combination thereof can be employed without limitation depending on the characteristics of the crosslinking agent used. Depending on the circumstances, any adhesive layer may be provided on the back layer side of the support for imparting the adhesion to the support.

As the matte agent preferably added to the back layer, there can be used fine organic or inorganic particles. The organic matte agents include fine particles of polymethyl methacrylate (PMMA), polystyrene, polyethylene, polypropylene and other radical polymerization polymers, and fine particles of condensation polymers such as a polyester and a polycarbonate.

The back layer is preferably provided in an amount of 0.5 $g/m^2$ to 5 $g/m^2$. Less than 0.5 $g/m^2$ results in unstable coating properties to be liable to cause the problem of powdering of the matte agent. On the other hand, coating largely exceeding 5 $g/m^2$ results in the extremely large particle size of the suitable matte agent. Consequently, a surface of the back layer is embossed by the back layer in storage, so that particularly, in heat transfer in which the thin image formation layer is transferred, a blank area and unevenness of the recorded image become liable to occur.

The number average particle size of the matte agent is preferably 2.5 $\mu$m to 20 $\mu$m larger than the film thickness of the back layer composed of the binder alone. The matte agent is required to contain particles having a particle size of 8 $\mu$m or more in an amount of 5 $mg/m^2$, preferably in an amount of 6 $mg/m^2$ to 600 $mg/m^2$, thereby particularly improving the foreign matter failure. The use of the particles having such a narrow particle size distribution that the value of the standard deviation of the particle distribution divided by the number average particle size ($\sigma$/rn, the coefficient of variation of particle distribution) is 0.3 or less can improve defects developed by particles having an abnormally large particle size, and moreover, gives the desired performance with the less amount thereof added. This coefficient of variation is more preferably 0.15 or less.

An antistatic agent is preferably added to the back layer for preventing the adhesion of foreign matter caused by frictional electrification with the conveying roll. As the antistatic agents, there are widely used compounds described in "Chemical Commercial Products of 11290", pages 875 to 876, Kagaku Kogyo Nipposha, as well as cationic surfactants, anionic surfactants, nonionic surfactants, polymer antistatic agents and fine conductive particles.

Of the above-mentioned materials, fine conductive particles of carbon black, metal oxides such as zinc oxide, titanium oxide and tin oxide, and organic semiconductors are preferably used as the antistatic agents used in combination in the back layer. in particular, the use of the fine conductive particles is preferred because the antistatic agents are not dissociated from the back layer, and the stable antistatic effect is obtained not depending on the circumstances.

It is also possible to add various surfactants and releasing agents such as silicone oil and fluororesins to the back layer for imparting coating properties and releasability.

The use of the back layer is particularly preferred when the softening point of the cushion layer and the image receiving layer measured by the TMA (thermomechanical analysis) is 70° C. or less.

The TMA softening point is determined by observing a phase of a sample to be measured, elevating the temperature of the sample while loading a definite load at a definite rate of temperature rise. In the invention, the temperature at which the phase of the sample to be measured starts to change is defined as the TMA softening point. The measurement of the softening point by the TMA can be made by use of a device such as Thermoflex manufactured by Rigaku Corporation.

The heat transfer sheet(s) is overlaid with the image receiving sheet, allowing the image formation layer(s) of the heat transfer sheet(s) to face toward the image receiving layer of the image receiving sheet, to form a laminate which is utilized for image formation.

The laminate of the heat transfer sheet(s) and the image receiving sheet can be formed by various methods. For example, the heat transfer sheet(s) is overlaid with the image receiving sheet, allowing the image formation layer(s) of the heat transfer sheet(s) to face toward the image receiving layer of the image receiving sheet, and passed through heated pressure rolls, thereby easily obtaining the laminate. In this case, the heating temperature is preferably 160° C. or less, or 130° C. or less.

As another method for obtaining the laminate, the above-mentioned vacuum suction method is also preferably used. The vacuum suction method is a method in which the image receiving sheet is first wound around a drum provided with suction holes for vacuum suction, and then, the heat transfer sheet(s) having a size somewhat larger than that of the image receiving sheet is vacuum adhered to the image receiving sheet while uniformly ejecting air from a squeeze roller. As still another method, there is also a method in which the image receiving sheet is mechanically adhered onto a metal drum with stretching, and the heat transfer sheet(s) is further similarly mechanically adhered onto it with stretching. Of these methods, the vacuum adhesion method is particularly preferred, because no temperature control of heat rolls is required, and rapid and uniform lamination is easily performed.

EXAMPLES

The invention will be illustrated with reference to examples below, but the following examples are not intended to limit the scope of the invention. Parts and percentages in examples, comparative examples and reference examples are on a weight basis, unless otherwise specified.

Example 1

Preparation of Heat Transfer Sheet K (Black)

| [Preparation of Coating Solution for First Back Layer] | |
|---|---|
| Aqueous Dispersion of Acrylic Resin (Jurimer ET410, 20% by weight, manufactured by Nippon Junyaku Co., Ltd.) | 2 parts |
| Antistatic Agent (An aqueous dispersion of tin oxide-antimony oxide, average particle size: 0.1 $\mu$m, 17% by weight) | 7.0 parts |
| Polyoxyethylene Phenyl Ether | 0.1 part |

-continued

| [Preparation of Coating Solution for First Back Layer] | |
|---|---|
| Melamine Compound (Sumitex Resin M-3, manufactured by Sumitomo Chemical Co., Ltd.) | 0.3 part |
| Distilled Water to make | 100 parts |

[Formation of First Back Layer]

Corona treatment was conducted on one face (back face) of a biaxially stretched polyethylene terephthalate film having a thickness of 75 μm (Ra on both faces is 0.01 μm), and the coating solution for a first back layer was applied thereto so as to give a dry layer thickness of 0.03 μm, followed by drying at 180° C. for 30 seconds to form a first back layer. The support has a longitudinal Young's modulus of 450 kg/mm$^2$ (approximately equal to 4.4 GPa) and a lateral Young's modulus of 500 kg/mm$^2$ (approximately equal to 4.9 GPa). The support has a longitudinal F-5 value of 10 kg/mm$^2$ (approximately equal to 98 MPa) and a lateral F-5 value of 13 kg/mm$^2$ (approximately equal to 127 MPa). The degrees of heat shrinkage of the support in longitudinal and lateral directions at 100° C. for 30 minutes are 0.3% and 0.1%, respectively. The longitudinal breaking strength is 20 kg/mm$^2$ (approximately equal to 196 MPa), the lateral breaking strength is 25 kg/mm$^2$ (approximately equal to 245 MPa), and the elasticity is 400 kg/mm$^2$ (approximately equal to 3.9 GPa).

| [Preparation of Coating Solution for Second Back layer] | |
|---|---|
| Polyolefin (Chemipearl S-120, 27% by weight, manufactured by Mitsui Petrochemical Industries, Ltd.) | 3.0 parts |
| Antistatic Agent (An aqueous dispersion of tin oxide-antimony oxide, average particle size: 0.1 μm, 17% by weight) | 2.0 parts |
| Colloidal Silica (Snowtex C, 20% by weight, manufactured by Nissan Chemical Industries, Ltd.) | 2.0 parts |
| Epoxy Compound (Dinacol Ex614B, manufactured by Nagase Kasei Co., Ltd.) | 0.3 part |
| Sodium Polysutyrenesulfonate | 0.1 part |
| Distilled Water to make | 100 parts |

[Formation of Second Back Layer]

The coating solution for a second back layer was applied onto the first back layer so as to give a dry layer thickness of 0.03 μm, followed by drying at 170° C. for 30 seconds to form a second back layer.

[Formation of Light-Heat Conversion Layer]

[Preparation of Coating Solution for Light-Heat Conversion Layer]

The following respective components were mixed with stirring by a stirrer to prepare a coating solution for a light-heat conversion layer.

| [Composition of Coating Solution for Light-Heat Conversion Layer] | |
|---|---|
| Infrared Absorption Dye | 7.6 parts |

(NK-2014, manufactured by Nippon Kanko Sikiso Co., Ltd., a cyanine dye having the following structure)

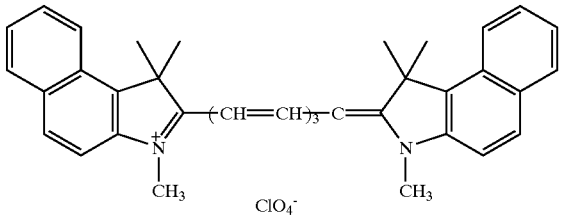

Polyimide Resin Having the Following Structure 29.3 parts (Rikacoat SN-20F, manufactured by Shin-Nippon Rika Co., Ltd., thermal decomposition temperature: 510° C.)

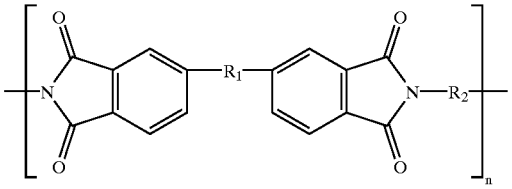

wherein $R_1$ represents $SO_2$, and $R_2$ represents

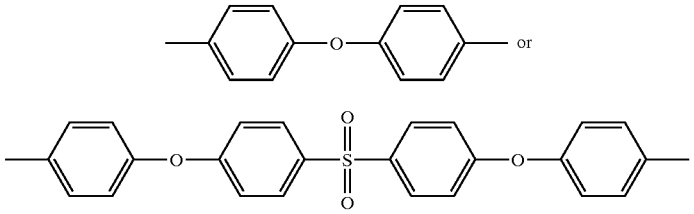

| | |
|---|---|
| EXXON Naphtha | 5.8 parts |
| N-Methylpyrrolidone (NMP) | 1500 parts |
| Methyl Ethyl Ketone | 360 parts |
| Surfactant | 0.5 part |

(Megafac F-176PF, manufactured by Dainippon Ink & Chemicals Inc.)

[Preparation of Matte Agent Dispersion]

Ten parts of fine spherical silica particles having a particle size of 1.5 μm (Seahoster KE-P150, manufactured by Nippon Shokubai Kagaku Kogyo Co., Ltd.), 2 parts of a dispersing agent polymer (an acrylate-styrene copolymer, Juncril 611, manufactured by Johnson Polymer Co., Ltd.), 16 parts of methyl ethyl ketone and 64 parts of N-methylpyrrolidone were mixed, and the resulting mixture and 30 parts of glass beads having a diameter of 2 mm were placed in a polyethylene container having a volume of 200 ml, followed by dispersing for 2 hours by use of a paint shaker (manufactured by Toyoseikiseisaku-sho, Ltd.) to obtain a dispersion of fine silica particles.

[Formation of Light-Heat Conversion Layer on Surface of Support]

The coating solution for a light-heat conversion layer prepared above was applied onto one surface of a 75-μm thick polyethylene terephthalate film (support) with a wire bar, followed by drying in an oven at 120° C. for 2 minutes to form a light-heat conversion layer on the support. The optical density of the resulting light-heat conversion layer in the vicinity of a wavelength of 808 nm was measured with an UV spectrophotometer, UV-240, manufactured by Shimadzu Corp. As a result, the optical density (OD) was 1.03. Observation of a cross section of the light-heat conversion layer under a scanning electron microscope showed that the layer thickness was 0.3 μm on average.

[Formation of Image Formation Layer]

[Preparation of Coating Solution for Black Image Formation Layer]

The following respective components were placed in a mill of a kneader, and a shear force was applied thereto while adding a small amount of a solvent to conduct dispersion pre-treatment. The solvent was further added to the resulting dispersion to adjust so as to finally give the following composition, followed by sand mill dispersion for 2 hours to obtain a pigment dispersion mother liquor.

| [Composition of Black Pigment Dispersion Mother Liquor] | |
|---|---|
| Composition 1 | |
| Polyvinyl Butyral (Esreck B BL-SH, manufactured by Sekisui Chemical Co., Ltd.) | 12.6 parts |
| Pigment Black 7 (carbon black, C.I. No. 77266) (Mitsubishi Carbon Black #5, manufactured by Mitsubishi Chemical Corporation, PVC blackness: 1) | 4.5 parts |
| Dispersing Assistant (Solsperse S-20000, manufactured by I.C.I.) | 0.8 part |
| n-Propyl Alcohol | 79.4 parts |
| Composition 2 | |
| Polyvinyl Butyral (Esreck B BL-SH, manufactured by Sekisui Chemical Co., Ltd.) | 12.6 parts |
| Pigment Black 7 (carbon black, C.I. No. 77266) (Mitsubishi Carbon Black MA100, manufactured by Mitsubishi Chemical Corporation, PVC blackness: 10) | 10.5 parts |
| Dispersing Assistant (Solsperse S-20000, manufactured by I.C.I.) | 0.8 part |
| n-Propyl Alcohol | 79.4 parts |

The following components were mixed with stirring by a stirrer to prepare a coating solution for a black image formation layer.

-continued

| [Composition of Coating Solution for Black Image Formation Layer] | |
|---|---|
| Above-Mentioned Black Pigment Dispersion Mother Liquo (Composition 1:Composition 2 = 70:30 (parts)) | 185.7 parts |
| Polyvinyl Butyral (Esreck B BL-SH, manufactured by Sekisui Chemical Co., Ltd.) | 11.9 parts |
| Wax Compounds | |
| (Stearic acid amide, Newtron 2, manufactured by Nippon Fine Chemical Co., Ltd.) | 1.7 parts |
| (Behenic acid amide, Diamid BM, manufactured by Nippon Kasei Chemical Co., Ltd.) | 1.7 parts |
| (Lauric acid amide, Diamid Y, manufactured by Nippon Kasei Chemical Co., Ltd.) | 3.4 parts |
| (Erucic acid amide, Diamid L-200, manufactured by Nippon Kasei Chemical Co., Ltd.) | 1.7 parts |
| (Oleic acid amide, Diamid O-200, manufactured by Nippon Kasei Chemical Co., Ltd.) | 1.7 parts |
| Rosin (KE-311, manufactured by Arakawa Kagaku Co., Ltd., component: resin acid 80–97%; resin acid component: abietic acid 30–40%, neoabietic acid 10–20%, dihydroabietic acid 14%, tetrahydroabietic acid 14%) | 11.4 parts |
| Surfactant (Megafac F-176PF, solid content: 20%, manufactured by Dainippon Ink & Chemicals Inc.) | 2.1 parts |
| Inorganic Pigment (MEK-ST, 30% methyl ethyl ketone solution, manufactured by Nissan Chemical Industries, Ltd.) | 7.1 parts |
| n-Propyl Alcohol | 1050 parts |
| Methyl Ethyl Ketone | 295 parts |

Particles in the resulting coating solution for a black image formation layer were measured by using a laser diffusion type particle size distribution measuring device. As a result, the average particle size was 0.25 μm, and the ratio of particles having a size of 1 μm or more was 0.5%.

[Formation of Black Image Formation Layer on Surface of Light-Heat Conversion Layer]

The coating solution for a black image formation layer prepared above was applied onto a surface of the light-heat conversion layer with a wire bar for 1 minute, followed by drying of the coated product in an oven at 100° C. for 2 minutes to form a black image formation layer on the light-heat conversion layer. By the above-mentioned process, a heat transfer sheet was prepared in which the light-heat conversion layer and the black image formation layer were provided on the support in this order (hereinafter referred to as heat transfer sheet K). Similarly, a sheet having a yellow image formation layer is referred to as heat transfer sheet Y, a sheet having a magenta image formation layer is referred to as heat transfer sheet M, and a sheet having a cyan image formation layer is referred to as heat transfer sheet C.

The transmission optical density of the black image formation layer of heat transfer sheet K was measured with a Macbeth densitometer TD-904 (W filter). As a result, the optical density was 0.91. Further, the layer thickness of the black image formation layer was measured. As a result, the thickness was 0.60 μm on average.

The properties of the resulting image formation layer were as follows.

The surface resistance of the image-forming layer was 200 g.

The smooster value of the surface is preferably from 0.5 mmHg to 50 mmHg (approximately equal to 0.0665 kPa to 6.65 kPa) at 23° C. and 55% RH, and specifically, it was 9.3 mmHg (approximately equal to 1.24 kPa).

The coefficient of static friction of the surface is preferably 0.2 or less, and specifically, it was 0.08.

The surface energy was 29 mJ/m$^2$. The contact angle of water was 94.8 degrees.

The deformation rate of the light-heat conversion layer at the time when an image is recorded at a linear speed of 1 m/sec or more with a laser beam having an optical intensity of 1000 W/mm$^2$ on an exposed face was 168%.

Preparation of Heat Transfer Sheet Y

Heat transfer sheet Y was prepared in the same manner as with the preparation of heat transfer sheet K described above with the exception that a coating solution for a yellow image formation layer having the following composition was used instead of the coating solution for the black image formation layer. The image formation layer of heat transfer sheet Y thus obtained had a layer thickness of 0.42 $\mu$m.

[Composition of Yellow Pigment Dispersion Mother Liquor]

| | |
|---|---|
| Yellow Pigment Composition 1: | |
| Polyvinyl Butyral (Esreck B BL-SH, manufactured by Sekisui Chemical Co., Ltd.) | 7.1 parts |
| Pigment Yellow 180 (C.I. No. 21290) (Novoperm Yellow P-HG, manufactured by Clariant Japan K.K.) | 12.9 parts |
| Dispersing Assistant (Solsperse S-20000, manufactured by I.C.I.) | 0.6 part |
| n-Propyl Alcohol | 79.4 parts |
| Yellow Pigment Composition 2: | |
| Polyvinyl Butyral (Esreck B BL-SH, manufactured by Sekisui Chemical Co., Ltd.) | 7.1 parts |
| Pigment Yellow 139 (C.I. No. 56298) (Novoperm Yellow M2R 70, manufactured by Clariant Japan K.K.) | 12.9 parts |
| Dispersing Assistant (Solsperse S-20000, manufactured by I.C.I.) | 0.6 part |
| n-Propyl Alcohol | 79.4 parts |

[Composition of Coating Solution for Yellow Image Formation Layer]

| | |
|---|---|
| Above-Mentioned Yellow Pigment Dispersion Mother Liquor (Yellow pigment composition 1:Yellow pigment composition 2 = 95:5 (parts)) | 126 parts |
| Polyvinyl Butyral (Esreck B BL-SH, manufactured by Sekisui Chemical Co., Ltd.) | 4.6 parts |
| Wax Compounds | |
| (Stearic acid amide, Newtron 2, manufactured by Nippon Fine Chemical Co., Ltd.) | 0.7 part |
| (Behenic acid amide, Diamid BM, manufactured by Nippon Kasei Chemical Co., Ltd.) | 0.7 part |
| (Lauric acid amide, Diamid Y, manufactured by Nippon Kasei Chemical Co., Ltd.) | 1.4 parts |
| (Erucic acid amide, Diamid L-200, manufactured by Nippon Kasei Chemical Co., Ltd.) | 0.7 part |
| (Oleic acid amide, Diamid O-200, manufactured by Nippon Kasei Chemical Co., Ltd.) | 0.7 part |
| Nonionic Surfactant (Chemistat 1100, manufactured by Sanyo Chemical Industries, Ltd.) | 0.4 part |
| Rosin (KE-311, manufactured by Arakawa Kagaku Co., Ltd.) | 2.4 parts |
| Surfactant (Megafac F-176PF, solid content: 20%, manufactured by Dainippon Ink & Chemicals Inc.) | 0.8 parts |
| n-Propyl Alcohol | 793 parts |
| Methyl Ethyl Ketone | 198 parts |

The properties of the resulting image formation layer were as follows.

The surface resistance of the image formation layer was 200 g.

The smooster value of the surface is preferably from 0.5 mmHg to 50 mmHg (approximately equal to 0.0665 kPa to 6.65 kPa) at 23° C. and 55% RH, and specifically, it was 2.3 mmHg (approximately equal to 0.31 kPa).

The coefficient of static friction of the surface is preferably 0.2 or less, and specifically, it was 0.1.

The surface energy was 24 mJ/m$^2$. The contact angle of water was 108.1 degrees.

The deformation rate of the light-heat conversion layer at the time when an image is recorded at a linear speed of 1 m/sec or more with a laser beam having an optical intensity of 1000 W/mm$^2$ on an exposed face was 150%.

Preparation of Heat Transfer Sheet M

Heat transfer sheet M was prepared in the same manner as with the preparation of heat transfer sheet K described above with the exception that a coating solution for a magenta image formation layer having the following composition was used instead of the coating solution for the black image formation layer. The image formation layer of heat transfer sheet M thus obtained had a layer thickness of 0.38 $\mu$m.

[Composition of Magenta Pigment Dispersion Mother Liquor]

| | |
|---|---|
| Magenta Pigment Composition 1: | |
| Polyvinyl Butyral (Denka Butyral #2000-L, manufactured by Denki Kagaku Kogyo K. K. , Vicat softening point: 57° C.) | 12.6 parts |
| Pigment Red 57:1 (C.I. No. 15850:1) (Symuler Brilliant Carmine 6B-229, manufactured by Dainippon Ink & Chemicals Inc.) | 15.0 parts |
| Dispersing Assistant (Solsperse S-20000, manufactured by I.C.I.) | 0.6 part |
| n-Propyl Alcohol | 80.4 parts |
| Magenta Pigment Composition 2: | |
| Polyvinyl Butyral (Denka Butyral #2000-L, manufactured by Denki Kagaku Kogyo K. K. , Vicat softening point: 57° C.) | 12.6 parts |
| Pigment Red 57:1 (C.I. No. 15850:1) (Lionol Red 6B-4290G, manufactured by Toyo Ink Mfg. Co. Ltd.) | 15.0 parts |
| Dispersing Assistant (Solsperse S-20000, manufactured by I.C.I.) | 0.6 part |
| n-Propyl Alcohol | 79.4 parts |

[Composition of Coating Solution for Magenta Image Formation Layer]

| | |
|---|---|
| Above-Mentioned Magenta Pigment Dispersion Mother Liquor (Magenta pigment composition 1:Magenta pigment composition 2 = 95:5 (parts)) | 163 parts |
| Polyvinyl Butyral (Denka Butyral #2000-L, manufactured by Denki Kagaku Kogyo K. K. , Vicat softening point: 57° C.) | 4.0 parts |
| Wax Compounds | |
| (Stearic acid amide, Newtron 2, manufactured by Nippon Fine Chemical Co., Ltd.) | 1.0 part |
| (Behenic acid amide, Diamid BM, manufactured by Nippon Kasei Chemical Co., Ltd.) | 1.0 part |
| (Lauric acid amide, Diamid Y, manufactured by Nippon Kasei Chemical Co., Ltd.) | 2.0 parts |
| (Erucic acid amide, Diamid L-200, manufactured by Nippon Kasei Chemical Co., Ltd.) | 1.0 part |

-continued

| | |
|---|---|
| (Oleic acid amide, Diamid O-200, manufactured by Nippon Kasei Chemical Co., Ltd.) | 1.0 part |
| Nonionic Surfactant (Chemistat 1100, manufactured by Sanyo Chemical Industries, Ltd.) | 0.7 part |
| Rosin (KE-311, manufactured by Arakawa Kagaku Co., Ltd.) | 4.6 parts |
| Pentaerythritol Tetraacrylate (NK Ester A-TMMT, manufactured by Shin-Nakamura Kagaku Co., Ltd.) | 2.5 parts |
| Surfactant (Megafac F-176PF, solid content: 20%, manufactured by Dainippon Ink & Chemicals Inc.) | 1.3 parts |
| n-Propyl Alcohol | 848 parts |
| Methyl Ethyl Ketone | 246 parts |

The properties of the resulting image formation layer were as follows.

The surface resistance of the image formation layer was 200 g.

The smooster value of the surface is preferably from 0.5 mmHg to 50 mmHg (approximately equal to 0.0665 kPa to 6.65 kPa) at 23° C. and 55% RH, and specifically, it was 3.5 mmHg (approximately equal to 0.47 kPa).

The coefficient of static friction of the surface is preferably 0.2 or less, and specifically, it was 0.08.

The surface energy was 25 mJ/m$^2$. The contact angle of water was 98.8 degrees.

The deformation rate of the light-heat conversion layer at the time when an image is recorded at a linear speed of 1 m/sec or more with a laser beam having an optical intensity of 1000 W/mm$^2$ on an exposed face was 160%.

Preparation of Heat Transfer Sheet C

Heat transfer sheet C was prepared in the same manner as with the preparation of heat transfer sheet K described above with the exception that a coating solution for a cyan image formation layer having the following composition was used instead of the coating solution for the black image formation layer. The image formation layer of heat transfer sheet C thus obtained had a layer thickness of 0.45 $\mu$m.

[Composition of Cyan Pigment Dispersion Mother Liquor]

| | |
|---|---|
| Cyan Pigment Composition 1: | |
| Polyvinyl Butyral (Esreck B BL-SH, manufactured by Sekisui Chemical Co., Ltd.) | 12.6 parts |
| Pigment Blue 15:4 (C.I. No. 74160) (Cyanine Blue 700-10FG, manufactured by Toyo Ink Mfg. Co. Ltd.) | 15.0 parts |
| Dispersing Assistant (PW-36, manufactured by Kusumoto Kasei Co., Ltd.) | 0.8 part |
| n-Propyl Alcohol | 110 parts |
| Cyan Pigment Composition 2: | |
| Polyvinyl Butyral (Esreck B BL-SH, manufactured by Sekisui Chemical Co., Ltd.) | 12.6 parts |
| Pigment Blue 15 (C.I. No. 74160) (Lionol Blue 7027, manufactured by Toyo Ink Mfg. Co. Ltd.) | 15.0 parts |
| Dispersing Assistant (PW-36, manufactured by Kusumoto Kasei Co., Ltd.) | 0.8 part |
| n-Propyl Alcohol | 110 parts |

-continued

[Composition of Coating Solution for Cyan Image Formation Layer]

| | |
|---|---|
| Above-Mentioned Cyan Pigment Dispersion Mother Liquor (Cyan pigment composition 1:Cyan pigment composition 2 = 90:10 (parts)) | 118 parts |
| Polyvinyl Butyral (Esreck B BL-SH, manufactured by Sekisui Chemical Co., Ltd.) | 5.2 parts |
| Inorganic Pigment, MEK-ST | 1.3 parts |
| Wax Compounds | |
| (Stearic acid amide, Newtron 2, manufactured by Nippon Fine Chemical Co., Ltd.) | 1.0 part |
| (Behenic acid amide, Diamid BM, manufactured by Nippon Kasei Chemical Co., Ltd.) | 1.0 part |
| (Lauric acid amide, Diamid Y, manufactured by Nippon Kasei Chemical Co., Ltd.) | 2.0 parts |
| (Erucic acid amide, Diamid L-200, manufactured by Nippon Kasei Chemical Co., Ltd.) | 1.0 part |
| (Oleic acid amide, Diamid O-200, manufactured by Nippon Kasei Chemical Co., Ltd.) | 1.0 part |
| Rosin (KE-311, manufactured by Arakawa Kagaku Co., Ltd.) | 2.8 parts |
| Pentaerythritol Tetraacrylate (NK Ester A-TMMT, manufactured by Shin-Nakamura Kagaku Co., Ltd.) | 1.7 parts |
| Surfactant (Megafac F-176PF, solid content: 20%, manufactured by Dainippon Ink & Chemicals Inc.) | 1.7 parts |
| n-Propyl Alcohol | 890 parts |
| Methyl Ethyl Ketone | 247 parts |

The properties of the resulting image formation layer were as follows.

The surface resistance of the image formation layer was 200 g.

The smooster value of the surface is preferably from 0.5 mmHg to 50 mmHg (approximately equal to 0.0665 kPa to 6.65 kPa) at 23° C. and 55% RH, and specifically, it was 7.0 mmHg (approximately equal to 0.93 kPa).

The coefficient of static friction of the surface is preferably 0.2 or less, and specifically, it was 0.08.

The surface energy was 25 mJ/m$^2$. The contact angle of water was 98.8 degrees.

The reflection optical density was 1.59, the layer thickness was 0.45 $\mu$m, and the OD/layer thickness was 3.03.

The deformation rate of the light-heat conversion layer at the time when an image is recorded at a linear speed of 1 m/sec or more with a laser beam having an optical intensity of 1000 W/mm$^2$ on an exposed face was 165%.

Preparation of Image Receiving Sheet

A coating solution for a cushion layer and a coating solution for a image receiving layer of the following compositions:

1) Coating Solution for Cushion Layer

| | |
|---|---|
| Vinyl Chloride-Vinyl Acetate Copolymer (Main binder, MPR-TSL, manufactured by Nissin Kagaku Co., Ltd.) | 20 parts |
| Plasticizer (Paraplex G-40, manufactured by CP. HALL. COMPANY) | 10 parts |
| Surfactant (fluorine system: coating aid) (Megafac F-177, manufactured by Dainippon Ink & Chemicals Inc.) | 0.5 part |

-continued

| | |
|---|---|
| Antistatic Agent (quaternary ammonium salt) (SAT-5 Supper (IC), manufactured by Nippon Junyaku Co., Ltd.) | 0.3 part |
| Methyl Ethyl Ketone | 60 parts |
| Toluene | 10 parts |
| N,N-Dimethylformamide | 3 parts |
| 2) Coating Solution for Image Receiving Layer | |
| Polyvinyl Butyral (Esreck B BL-SH, manufactured by Sekisui Chemical Co., Ltd.) | 8 parts |
| Antistatic Agent (Sanstat 2012A, manufactured by Sanyo Chemical Industries, Ltd.) | 0.7 part |
| Surfactant (Megafac F-177, manufactured by Dainippon Ink & Chemicals Inc.) | 0.1 part |
| n-Propyl Alcohol | 20 parts |
| Methanol | 20 parts |
| 1-Methoxy-2-propanol | 50 parts |

The coating solution for a cushion layer was applied onto a white PET support (Lumirror #130E58, manufactured by Toray Industries Inc., thickness: 130 μm) with a narrow coater, and the coated layer was dried. Then, the coating solution for a image receiving layer was applied thereto, followed by drying. The amounts coated were adjusted so as to give a layer thickness of 20 μm after drying for the cushion layer, and a layer thickness of 2 μm after drying for the image receiving layer. The white PET support was a void-containing plastic support comprising a laminate (total thickness: 130 μm, specific gravity: 0.8) in which a void-containing polyethylene terephthalate layer (thickness: 116μ, the percentage of voids: 20%) was laminated with titanium oxide-containing polyethylene terephthalate layers (thickness: 7 μm, titanium oxide content: 2%) on both sides thereof. The material thus prepared was wound in the roll form, and stored at room temperature for 1 week. Then, the material was used for the following image recording using laser beams.

The properties of the resulting image formation layer were as follows.

The surface roughness Ra is preferably from 0.01 μm to 0.4 μm, and specifically, it was 0.02 μm.

The undulation of the surface of the image receiving layer is preferably 2 μm or less, and specifically, it was 1.2 μm.

The smooster value of the surface of the image receiving layer is preferably from 0.5 mmHg to 50 mmHg (approximately equal to 0.0665 kPa to 6.65 kPa) at 23° C. and 55% RH, and specifically, it was 0.8 mmHg (approximately equal to 0.11 kPa).

The coefficient of static friction of the surface of the image receiving layer is preferably 0.8 or less, and specifically, it was 0.37.

The surface energy of the image receiving layer was 29 $mJ/m^2$. The contact angle of water was 85.0 degrees.

Formation of Transferred Image

As the image formation system, there was used the system described in FIG. 3 employing a Luxel FINALPROOF 5600 recording device, and a transferred image was obtained on final paper according to the image formation sequence of this system and the final paper transfer method used in this system.

The image receiving sheet (558 mm×841 mm) prepared above was wound around a 38-cm diameter rotary drum provided with 1-mm diameter vacuum suction holes (at a surface density of 1 hole per 3 cm×8 cm), and adhered thereon by suction. Then, the above-mentioned heat transfer sheet K (black) cut to a size of 609 mm×878 mm was overlaid on the image receiving sheet so that the heat transfer sheet K was uniformly protruded from the image receiving sheet, and air was sucked through the suction holes with squeezing by the squeeze roller to adhere and laminate the sheets. The degree of pressure reduction in the state that the suction holes were stopped up was −150 mmHg (approximately equal to 81.13 kPa) per atm. The drum was driven for rotation, and a semiconductor laser beam having a wavelength of 808 nm was condensed from the outside onto a surface of the laminate on the drum so as to give a 7-μm spot on a surface of the light-heat conversion layer. Thus, laser image (scanning) recording was conducted while moving the laser beam perpendicularly to the rotational direction (main scanning direction) of the rotary drum (sub-scanning). The laser irradiation conditions were as follows. The laser beam used in this example comprises multiple laser beams two-dimensionally arranged in 5 lines in the main scanning direction and in 3 lines in the sub-scanning direction.

| | |
|---|---|
| Laser Power: | 110 mW |
| Number of Revolutions of Drum: | 500 rpm |
| Sub-Scanning Pitch: | 6.35 μm |

Environmental Temperature and Humidity: three conditions of 20° C. and 40%, 23° C. and 50%, and 26° C. and 65%

The diameter of the exposure drum is preferably 360 mm or more, and specifically, the drum having a diameter of 380 mm was used.

The image size was 515 mm×728 mm, and the resolution was 2600 dpi.

After the laser recording was completed, the laminate was removed from the drum, and the heat transfer sheet K was peeled off from the image receiving sheet by hand. As a result, it was observed that only a light-irradiated area of the image formation layer of the heat transfer sheet K was transferred to the image receiving sheet.

An image was transferred from each heat transfer sheet of the above-mentioned heat transfer sheet Y, heat transfer sheet M and heat transfer sheet C to the image receiving sheet in the same manner as described above. The transferred 4-color image was further transferred to recording paper to form a multicolor image. As a result, the multicolor image having good image quality and stable transfer density could be formed even when the laser recording was conducted at high energy by the two-dimensionally arranged multiple laser beams under different conditions of temperature and humidity.

For transfer to the final paper, the heat transfer device having a coefficient of static friction of 0.1 to 0.7 to polyethylene terephthalate, a material for the insertion table, and having a conveying speed of 15 to 50 mm/sec was used. The Vickers hardness of a material for the heat roll is preferably from 10 to 100, and specifically, it was 70.

The resulting image was satisfactory under all three conditions of temperature and humidity.

The reflection optical density was measured with an X-rite 938 densitometer (manufactured by X-rite Co.) by Y, M, C and K modes for Y, M, C and K colors, respectively, using the image transferred to "TOKURYO" art paper as final paper. The reflection optical density and the ratio of the reflection optical density/layer thickness of the image formation layer are as shown in the following table.

TABLE 1

| | Optical Density | Optical Density/Thickness of Image Formation Layer |
|---|---|---|
| Color Y | 1.01 | 2.40 |
| Color M | 1.51 | 3.97 |
| Color C | 1.59 | 3.53 |
| Color K | 1.82 | 3.03 |

Comparative Examples 1-1 and 1-2

Heat transfer sheets and image receiving sheets were prepared in the same manner as with Example 1 with the exception that the sizes of samples in recording and final paper were changed as shown in Table 2. That is to say, in Comparative Example 1-1, the size of the image receiving sheet was changed to 590×860 mm, and the size of final paper was changed to 610 mm×880 mm. In Comparative Example 1-2, the size of the image receiving sheet was changed to 525 mm×795 mm, and the size of final paper was changed to 545 mm×815 mm. That is to say, in Example 1, the longitudinal and lateral differences between the heat transfer sheet and the image receiving sheet were 51 mm and 37 mm, respectively, and the longitudinal and lateral differences between the final paper and the image receiving sheet were 20 mm and 21 mm, respectively. In Comparative Example 1-1, the longitudinal and lateral differences between the heat transfer sheet and the image receiving sheet were 19 mm and 18 mm, respectively, and the longitudinal and lateral differences between the final paper and the image receiving sheet were 20 mm and 20 mm, respectively. In Comparative Example 1-2, the longitudinal and lateral differences between the heat transfer sheet and the image receiving sheet were 84 mm and 83 mm, respectively, and the longitudinal and lateral differences between the final paper and the image receiving sheet were 20 mm and 20 mm, respectively.

The image obtained by such system constitution was evaluated in the following manner.

Using the heat transfer sheet and the image receiving sheet prepared as described above the recorded image was prepared in the sizes shown in Table 2, and the image transfer ate and wrinkles after final paper transfer were evaluated.

TABLE 2

| | Sample Size (mm) | | | Evaluation (Black) | |
|---|---|---|---|---|---|
| | Heat Transfer Sheet | Image Receiving Sheet | Final Paper | Image Transfer Rate (%) | Wrinkles after Final Paper Transfer |
| Example 1 | 609 × 878 | 558 × 841 | 578 × 861 | 96.8 | Good |
| Comparative Example 1-1 | 609 × 878 | 590 × 860 | 610 × 880 | 89.1 | Fair |
| Comparative Example 1-2 | 609 × 878 | 525 × 795 | 545 × 815 | 93.6 | Poor |

Then, details of results of performance evaluation of Example 1 and Comparative Examples 1-1 and 1-2 are shown below.

(1) Calculation of Image Transfer Rate of Black Image Area

The image transfer rate is calculated by dividing the image density of the transferred image obtained using the heat transfer sheet K by the reflection density of a black image obtained by transfer onto the image receiving sheet without laser recording by use of the heat transfer device.

In Example 1, the image transfer rate was 96.8%, which was higher than 89.1% of Comparative Example 1-1 and 93.6% of Comparative Example 1-2. As to wrinkles after final paper transfer, no wrinkles were developed in Example 1, but wrinkles were developed in a part of the sheet in Comparative Example 1-1, and wrinkles were developed throughout the sheet in Comparative Example 1-2.

Figure 13:
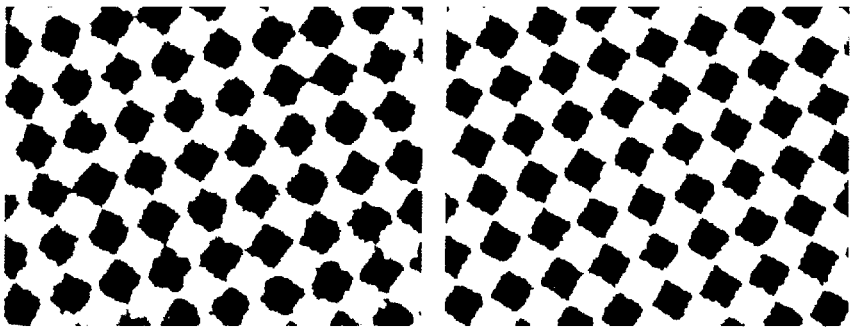
FIG. 13 shows a dot form of an image obtained in an example, and the distance between dot centers is 125 μm.
Figure 14:
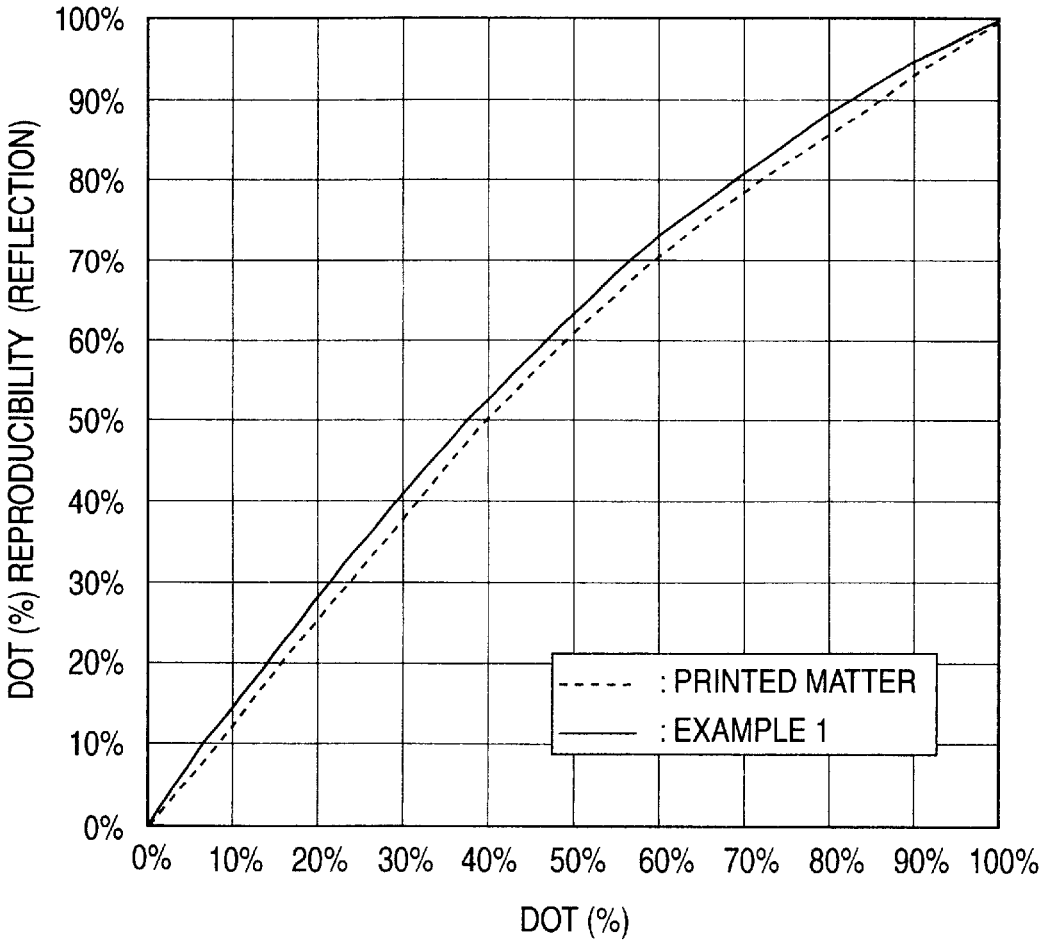
FIG. 14 is a graph showing the dot reproducibility of an image obtained in an example. The ordinate indicates the dot area rate calculated from the reflection density, and the abscissa indicates the dot area rate of an input signal.

Further, in Example 1, a halftone dot image corresponding to the number of print lines was formed at a resolution of 2400 dpi to 2540 dpi. Each halftone dot had few blurs and breaks, and the shape was very sharp, so that halftone dots over the wide range from a highlight to a shadow could be clearly formed (FIGS. 5 to 12). As a result, the high-quality halftone dot output was possible at the same resolution as that of an image setter or a CTP setter, and halftone dots and gradation good in the approximation to printed matter could be reproduced (FIGS. 13 and 14). This product provided good results even at a resolution higher than 2600 dpi.

Figure 15:
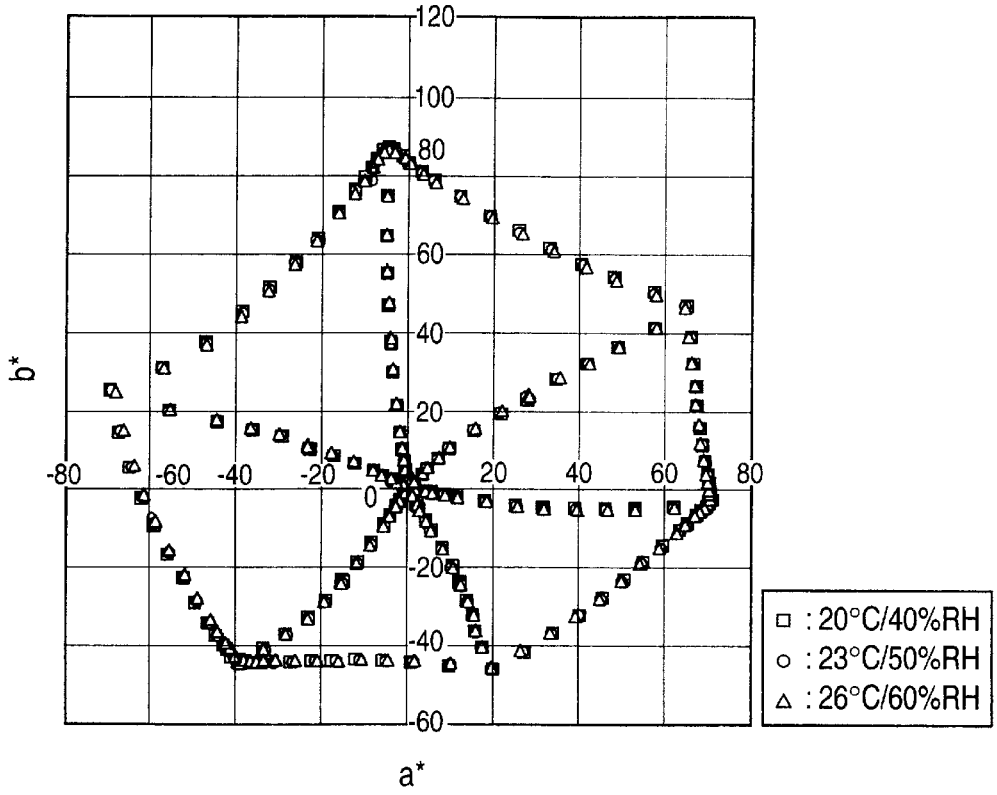
FIG. 15 is a graph indicating the cyclic reproducibility of an image obtained in an example on an a*b* plane of the L*a*b* color indication system.
Figure 16:
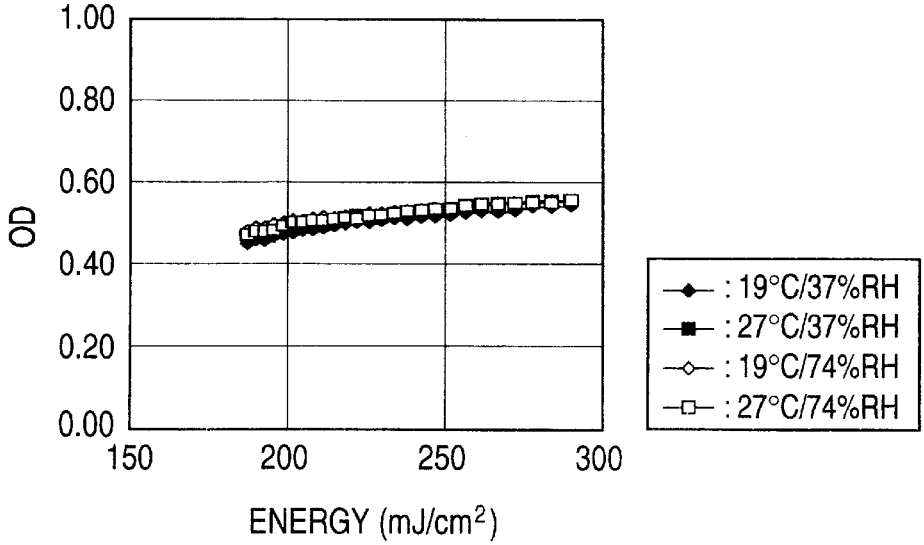
FIG. 16 is a graph showing the cyclic reproducibility of an image obtained in an example.
Figure 17:
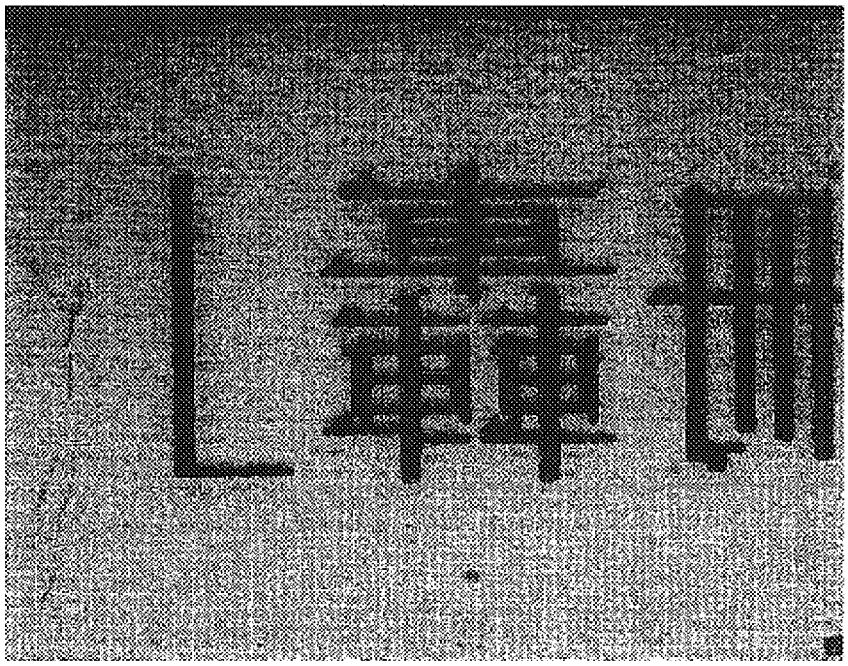
FIG. 17 is a positive image showing the 2-point character quality of an image obtained in an example.
Figure 18:
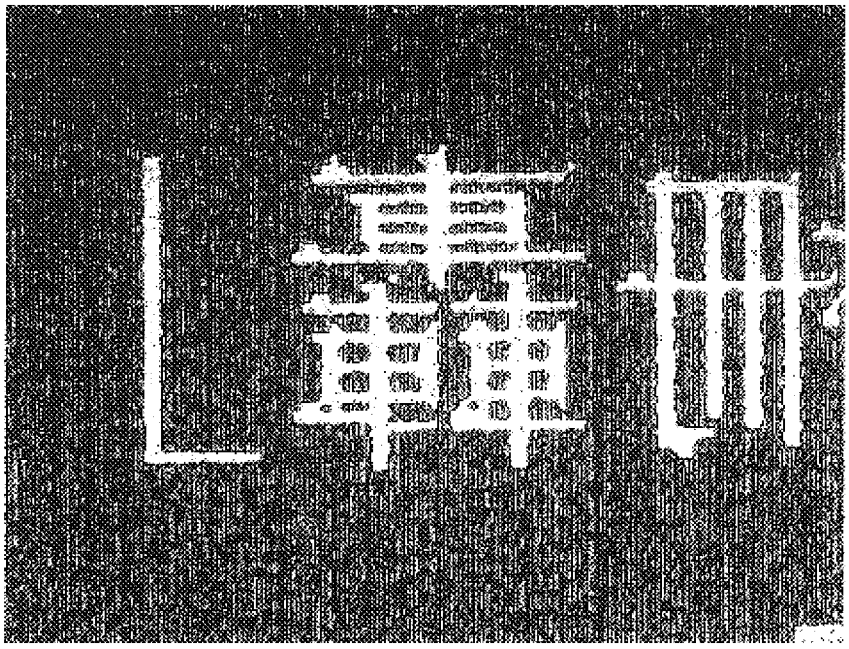
FIG. 18 is a negative image showing the 2-point character quality of an image obtained in an example.

The product of the invention obtained in Example 1 was sharp in the halftone dot form, so that the halftone dot corresponding to the laser beam could be faith fully reproduced. Further, the environmental temperature and humidity dependency of recording characteristics was very low, so that the stable cyclic reproducibility could be obtained for both hues and density (FIGS. 15 and 16).

(2) Color Reproduction

In the heat transfer sheet of Example 1, the coloring pigments used in print ink were used as the coloring materials, so that a high-accuracy CMS could be realized because of good cyclic reproducibility. The image approximately agreed in hues with Japan color, and showed changes similar to those of printed matter, also with respect to how to look in color at the time when a light source is changed to a fluorescent lamp or a incandescent lamp.

(3) Character Quality

The image obtained in Example 1 was sharp in the dot form, so that the narrow lines of the fine characters could be sharply reproduced.

The above shows that a good vacuum adhesion state is maintained between the respective sheets, and good transferring properties are obtained, by making the respective heat transfer sheets 20 mm to 80 mm larger than the image receiving sheet. Further, wrinkles caused by slippage between the samples are not developed, and the disadvantage in cost can be avoided, by making the final paper 5 mm to 100 mm larger than the image receiving sheet.

Examples 2-1 to 2-4 and Comparative Examples 1-1 and 1-2

Of multicolor image-forming materials, heat transfer sheets used were the same as used in Example 1.

Example 2-1

Preparation of Image Receiving Sheet

A coating solution for a cushion layer and a coating solution for an image receiving layer of the following compositions:

| 1) Coating Solution for Cushion Layer | |
|---|---|
| Vinyl Chloride-Vinyl Acetate Copolymer (Main binder, MPR-TSL, manufactured by Nissin Kagaku Co., Ltd.) | 20 parts |
| Plasticizer (Paraplex G-40, manufactured by CP. HALL. COMPANY) | 10 parts |
| Surfactant (fluorine system: coating aid) (Megafac F-177, manufactured by Dainippon Ink & Chemicals Inc.) | 0.5 part |
| Antistatic Agent (quaternary ammonium salt) (SAT-5 Supper (IC), manufactured by Nippon Junyaku Co., Ltd.) | 0.3 part |
| Methyl Ethyl Ketone | 60 parts |
| Toluene | 10 parts |
| N, N-Dimethylformamide | 3 parts |
| 2) Coating Solution for Image Receiving Layer | |
| Polyvinyl Butyral (binder) (Esreck B BL-1, manufactured by Sekisui Chemical Co., Ltd.) | 117 parts |
| Styrene-Maleic Acid Half Ester (binder) (Oxylack SH-128, manufactured by Nippon Shokubai Kagaku Kogyo Co., Ltd.) | 63 parts |
| Antistatic Agent (Chemistat 3033, manufactured by Sanyo Chemical Industries, Ltd.) | 1.8 parts |
| Surfactant (Megafac F-176PF, manufactured by Dainippon Ink & Chemicals Inc.) | 1.2 parts |
| n-Propyl Alcohol | 570 parts |
| Methanol | 1200 parts |
| 1-Methoxy-2-propanol | 520 parts |

The coating solution for a cushion layer was applied onto a white PET support (Lumirror #130E58, manufactured by Toray Industries Inc., thickness: 130 μm) with a wire bar coater, and the coated layer was dried. Then, the coating solution for an image receiving layer was applied thereto, followed by drying. The amounts coated were adjusted so as to give a layer thickness of 20 μm after drying for the cushion layer, and a layer thickness of 2 μm after drying for the image receiving layer. The white PET support was a void-containing plastic support comprising a laminate (total thickness: 130 μm, specific gravity: 0.8) in which a void-containing polyethylene terephthalate layer (thickness: 116μ, the percentage of voids: 20%) was laminated with titanium oxide-containing polyethylene terephthalate layers (thickness: 7 μm, titanium oxide content: 2%) on both sides thereof.

Example 2-2

An image receiving sheet was prepared in the same manner as with Example 2-1 with the exception that the amount of the antistatic agent (Chemistat 3033) in the formulation of the coating solution for the image formation layer was changed to 16 parts.

Example 2-3

An image receiving sheet was prepared in the same manner as with Example 2-1 with the exception that the amount of the antistatic agent (Chemistat 3033) in the formulation of the coating solution for the image formation layer was changed to 0.9 parts.

Example 2-4

An image receiving sheet was prepared in the same manner as with Example 2-1 with the exception that the amount of the antistatic agent (Chemistat 3033) in the formulation of the coating solution for the image formation layer was changed to 0.6 parts.

Comparative Example 1-1

An image receiving sheet was prepared in the same manner as with Example 2-1 with the exception that the amount of the antistatic agent (Chemistat 3033) in the formulation of the coating solution for the image formation layer was changed to 1.8 parts, and 3 parts of polymethyl methacrylate particles having an average particle size of 5 μm was further added.

Comparative Example 1-2

An image receiving sheet was prepared in the same manner as with Example 2-1 with the exception that the amount of the antistatic agent (Chemistat 3033) in the formulation of the coating solution for the image formation layer was changed to 0.3 parts.

The image receiving sheets prepared in Examples 2-1 to 2-4 and Reference Examples 1-1 and 1-2 were wound in the roll form, and stored at room temperature for 1 week. Then, the image receiving sheets were used together with the image transfer sheets of Example 1 for the following image recording using laser beams.

The dynamic frictional force and accumulation properties of each image receiving sheet were evaluated by the following methods. Results thereof are shown in Table 3.

Evaluation Method of Dynamic Frictional Force

The image sheet was cut into the rectangular forms, 7 cm×16 cm (lower sheet) and 5 cm×15 cm (upper sheet). The two sheets were overlaid with each other with the image receiving faces facing downward, and the lower sheet was fixed to a table. One end of the upper sheet was set on a DFG-2K type force gauge manufactured by Sinpo Co., Ltd., and a load of 125 g (diameter of bottom face: 4 cm) was placed, followed by stretching at a rate of 1500 mm/minute for 3 seconds. Then, the average maximum value per second indicated by the measurement "MIN" was read. The average value was determined from ten measurements.

The larger value shows the larger dynamic frictional force between the image receiving face and the back face.

Evaluation Method of Accumulation Properties

The heat transfer image receiving material wound in the roll form (width: 558 mm, length: arbitrary) was set on a Luxel FINALPROOF 5600 printer manufactured by Fuji Photo Film Co., Ltd., and 20 sheets were continuously accumulated at the B2 vertical size without conducting image recording. Then, the accumulated state was evaluated. As the amount of deviation, the maximum value of the deviations of upper ends of 20 sheets on an accumulation tray was measured.

Formation of Transferred Image

The image receiving sheet (56 cm×79 cm) prepared above was wound around a 38-cm diameter rotary drum provided with 1-mm diameter vacuum suction holes (at a surface density of 1 hole per 3 cm×8 cm), and adhered thereon by suction. Then, the above-mentioned heat transfer sheet K (black) cut to a size of 61 cm×84 cm was overlaid on the image receiving sheet so that the heat transfer sheet K was uniformly protruded from the image receiving sheet, and air was sucked through the suction holes with squeezing by the squeeze roller to adhere and laminate the sheets. The degree of pressure reduction in the state that the suction holes were stopped up was −150 mmHg (approximately equal to 81.13 kPa) per atm. The drum was driven for rotation, and a semiconductor laser beam having a wavelength of 808 nm was condensed from the outside onto a surface of the laminate on the drum so as to give a 7 μm spot on a surface of the light-heat conversion layer. Thus, laser image (scanning) recording was conducted while moving the laser beam perpendicularly to the rotational direction (main scanning direction) of the rotary drum (sub-scanning). The laser irradiation conditions were as follows. The laser beam used in this example comprises multiple laser beams two-dimensionally arranged in 5 lines in the main scanning direction and in 3 lines in the sub-scanning direction.

| | |
|---|---|
| Laser Power: | 110 mW |
| Ntmiber of Revolutions of Drum: | 500 rpm |
| Sub-Scanning Pitch: | 6.35 μm |

Environmental Temperature and Humidity: three conditions of 18° C. and 30%, 23° C. and 50%, and 26° C. and 65%

The diameter of the exposure drum is preferably 360 mm or more, and specifically, the drum having a diameter of 380 mm was used.

The image size was 515 mm×728 mm, and the resolution was 2600 dpi.

After the laser recording was completed, the laminate was removed from the drum, and the heat transfer sheet K was peeled off from the image receiving sheet by hand. As a result, it was observed that only a light-irradiated area of the image formation layer of the heat transfer sheet K was transferred to the image receiving sheet.

An image was transferred from each heat transfer sheet of the above-mentioned heat transfer sheet Y, heat transfer sheet M and heat transfer sheet C to the image receiving sheet in the same manner as described above. The transferred 4-color image was further transferred to recording paper to form a multicolor image. As a result, the multicolor image having good image quality and stable transfer density could be formed even when the laser recording was conducted at high energy by the two-dimensionally arranged multiple laser beams under different conditions of temperature and humidity.

For transfer to the final paper, the heat transfer device having a coefficient of static friction of 0.1 to 0.7 to polyethylene terephthalate, a material for the insertion table, and having a conveying speed of 15 to 50 mm/sec was used. The Vickers hardness of a material for the heat roll is preferably from 10 to 100, and specifically, it was 70.

The resulting image was satisfactory under all three conditions of temperature and humidity.

The image density of the transferred images obtained under the respective conditions of temperature and humidity was measured with a Macbeth reflection densitometer, RD-918 (W filter), using the heat transfer sheet K. As a result, the reflection density (OD) was as shown below.

Using a heat laminator, the heat transfer sheet K was transferred to the image receiving sheet without conducting laser recording, and the reflection density (OD) of the resulting black image was measured by the above-mentioned method. As a result, it was 1.88.

Further, the image transfer rate by laser recording was 98.4%, 96.8% and 96.3% under the conditions of 18° C. and 30%, 23° C. and 50%, and 26° C. and 65%, respectively.

TABLE 3

| | Dynamic Frictional Force (gf) | Accumulation Properties of 20 Sheets | Deviation of 20 Sheets (cm) | Note |
|---|---|---|---|---|
| Example | | | | |
| 2-1 | 40 | Good | 3.5 | |
| 2-2 | 55 | Very Good | 1 | |
| 2-3 | 80 | Good | 2.5 | |
| 2-4 | 105 | Good | 4 | |
| Comparative Example | | | | |
| 1-1 | 25 | Poor | — | Flying out |
| 1-2 | 130 | Poor | — | Jamming |

Example 3-1

Preparation of Heat Transfer Sheet

Preparation of Heat Transfer Sheet Y

[Preparation of Coating Solution for First Back Layer]

Respective components shown in the following composition of a coating solution were mixed with stirring by a stirrer, and dispersed with a paint shaker (manufactured by Toyoseikiseisaku-sho, Ltd.) for 1 hour to prepare a coating solution for a first back layer.

| [Composition of Coating Solution] | |
|---|---|
| Aqueous Dispersion of Acrylic Resin (Jurimer ET410, solid content: 20% by weight, manufactured by Nippon Junyaku Co., Ltd.) | 2.0 parts |
| Antistatic Agent (An aqueous dispersion of tin oxide-antimony oxide, average particle size: 0.1 μm, 17% by weight) | 7 parts |
| Polyoxyethylene Phenyl Ether | 0.1 part |
| Melamine Compound (Sumitex Resin M-3, manufactured by Sumitomo Chemical Co., Ltd.) | 0.3 part |
| Distilled Water to make | 100 parts |

The coating solution for a first back layer was applied onto one face of a polyethylene terephthalate film (Ra on both faces is 0.01 μm) having a thickness of 75 μm and a width of 65 cm with a wire bar, and then, the coated product was dried in an oven at 100° C. for 2 minutes to form a first back layer having a thickness of 0.04 μm on the support. The support has a longitudinal Young's modulus of 450 kg/mm2 (approximately equal to 4.4 GPa) and a lateral Young's modulus of 500 kg/mm$^2$ (approximately equal to 4.9 GPa). The support has a longitudinal F-5 value of 10 kg/mm$^2$ (approximately equal to 98 MPa) and a lateral F-5 value of 13 kg/mm$^2$ (approximately equal to 127 MPa). The degrees of heat shrinkage of the support in longitudinal and lateral directions at 100° C. for 30 minutes are 0.3% and 0.1%, respectively. The longitudinal breaking strength is 20 kg/mm$^2$ (approximately equal to 196 MPa), the lateral breaking strength is 25 kg/mm$^2$ (approximately equal to 245 MPa), and the elasticity is 400 kg/mm$^2$ (approximately equal to 3.9 GPa).

[Preparation of Coating Solution for Second Back Layer]

Respective components shown in the following composition of a coating solution were mixed with stirring by a stirrer, and dispersed with a paint shaker (manufactured by Toyoseikiseisaku-sho, Ltd.) for 1 hour to prepare a coating solution for a second back layer.

| | |
|---|---|
| Polyolefin (Chemipearl S-120, 27% by weight, manufactured by Mitsui Petrochemical Industries, Ltd.) | 3.0 parts |
| Colloidal Silica (Snowtex C, manufactured by Nissan Chemical Industries, Ltd.) | 2.0 parts |
| Epoxy Compound (Dinacol Ex614B, manufactured by Naqase Kasei Co., Ltd.) | 0.3 part |
| Distilled Water to make | 100 parts |

The coating solution for a second back layer was applied onto the first back layer with a wire bar, and then, the coated product was dried in an oven at 100° C. for 2 minutes to form a second back layer having a thickness of 0.03 μm on the first back layer.

1) Preparation of Coating Solution for Light-Heat Conversion Layer

[Preparation of Matte Agent Dispersion]

Ten parts of fine spherical silica particles having a particle size of 1.5 μm (Seahoster KE-P150, manufactured by Nippon Shokubai Kagaku Kogyo Co., Ltd.), 2 parts of a dispersing agent polymer (an acrylate-styrene copolymer, Juncril 611, manufactured by Johnson Polymer Co., Ltd.), 16 parts of methyl ethyl ketone and 64 parts of N-methylpyrrolidone were mixed, and the resulting mixture and 30 parts of glass beads having a diameter of 2 mm were placed in a polyethylene container having a volume of 200 ml, followed by dispersing for 3 hours by use of a paint shaker (manufactured by Toyoseikiseisaku-sho, Ltd.) to obtain a dispersion of fine silica particles.

| [Composition of Coating Solution for Light-Heat Conversion Layer] | |
|---|---|
| Methyl Ethyl Ketone | 20 parts |
| N-Methylpyrrolidone (NMP) | 73 parts |
| Polyimide Resin Having the Following Structure | 8 parts |

(Rikacoat SN-20F, manufactured by Shin-Nippon Rika Co., Ltd., thermal decomposition temperature: 510° C.)

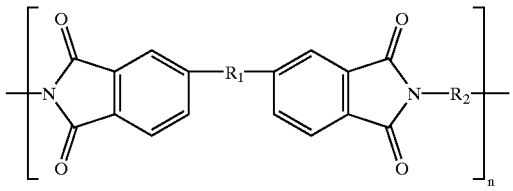

wherein $R_1$ represents $SO_2$, and $R_2$ represents

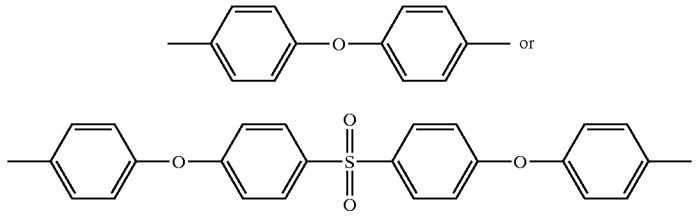

| | |
|---|---|
| Infrared Absorption Dye | 0.42 parts |

(NK-2014, manufactured by Nippon Kanko Sikiso Co., Ltd., a cyanine dye having the following structure)

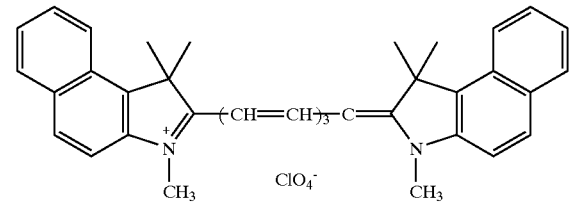

| | |
|---|---|
| Surfactant | 0.12 part |

(Megafac F-176PF, manufactured by Dainippon Ink & Chemicals Inc., surfactant of F family)

The above-mentioned respective components were mixed to dissolve the binder and the infrared absorption dye, and 0.7 part of the above-mentioned matte agent dispersion was added thereto to prepare a coating solution for a light-heat conversion layer.

2) Formation of Light-Heat Conversion Layer on Surface of Support

The coating solution for a light-heat conversion layer prepared above was applied onto one surface of a 75-μm thick polyethylene terephthalate film (support) with a wire bar, followed by drying in an oven at 120° C. for 3 minutes to form a light-heat conversion layer on the support. The optical density of the resulting light-heat conversion layer at a wavelength of 808 nm was measured with an UV spectrophotometer, UV-240, manufactured by Shimadzu Corp. As a result, the optical density (OD) was 1.06. Observation of a cross section of the light-heat conversion layer under a scanning electron microscope showed that the layer thickness was 0.33 μm on average.

3) Preparation of Coating Solution for Yellow Image Formation Layer

Respective components shown in the following composition of a pigment dispersion mother liquor were dispersed with a paint shaker (manufactured by Toyoseikiseisaku-sho, Ltd.) for 4 hour, and then, glass beads were removed to prepare a yellow pigment dispersion mother liquor. The average particle size of the pigment measured by the dynamic light scattering method (a dynamic light scattering measuring device, N-4, manufactured by Coulter Co.) was 0.31 μm.

| | |
|---|---|
| The following Compound | 12.9 parts |

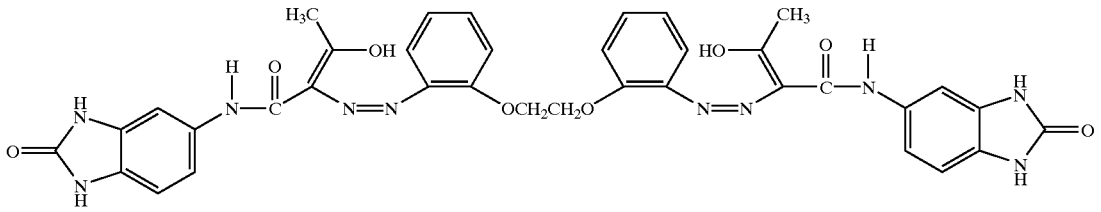

| | |
|---|---|
| Polyvinyl Butyral (Esreck B BL-SH, manufactured by Sekisui Chemical Co., Ltd.) | 7.4 parts |
| Dispersing Assistant (Solsperse S-20000, manufactured by I.C.I. Japan) | 0.6 part |
| n-Propyl Alcohol | 79.4 parts |
| Glass Beads (size: 3 mm) | 45 parts |

[Preparation of Coating Solution 1 for Yellow Image Formation Layer]

| | |
|---|---|
| Polyvinyl Butyral (Esreck B EL-SB, manufactured by Sekisui Chemical Co., Ltd.) | 0.42 parts |
| Rosin Ester (KE-311, manufactured by Arakawa Kagaku Co., Ltd., component: resin acid 80–97%; resin acid component: abietic acid 30–40%, neoabietic acid 10–20%, dihydroabietic acid 14%, tetrahydroabietic acid 14%) | 0.2 part |
| Behenic Acid (NAA-222S, manufactured by Nippon Oil & Fats Co., Ltd.) | 0.2 part |
| Surfactant (Megafac F-176PF, solid content: 20%, manufactured by Dainippon Ink & Chemicals Inc.) | 0.1 part |
| Methyl Ethyl Ketone | 18 parts |
| n-Propyl Alcohol | 70 parts |

The above-mentioned components were heated at 60° C. to dissolve them. Then, after cooling to room temperature, 11 parts of the above-mentioned yellow pigment dispersion mother liquor was added thereto, followed by sufficient stirring to prepare a coating solution 1 for a yellow image formation layer.

4) Formation of Yellow Image Formation Layer

The coating solution 1 for a yellow image formation layer was applied onto a surface of the light-heat conversion layer with a wire bar, and then, the coated product was dried at 100° C. for 3 minutes to prepare a heat transfer sheet Y in which a yellow image formation layer was formed on the light-heat conversion layer.

The layer thickness of the yellow image formation layer of the heat transfer sheet Y was 0.42 μm on average.

The properties of the resulting image formation layer were as follows.

The smooster value of the surface is preferably from 0.5 mmHg to 50 mmHg (approximately equal to 0.0665 kPa to 6.65 kPa) at 23° C. and 55% RH, and specifically, it was 2.3 mmHg (approximately equal to 0.31 kPa).

The coefficient of static friction of the surface is preferably 0.2 or less, and specifically, it was 0.1.

Example 3-2

A heat transfer sheet was prepared in the same manner as with Example 3-1 with the exception that the dispersing time of the yellow pigment dispersion mother liquor was changed to 6 hours. The average particle size of the dispersion mother liquor was 0.24 m.

Reference Example 2-1

A heat transfer sheet was prepared in the same manner as with Example 3-1 with the exception that the dispersing time of the yellow pigment dispersion mother liquor was changed to 1 hour. The average particle size of the dispersion mother liquor was 0.41 μm.

Reference Example 2-2

A heat transfer sheet was prepared in the same manner as with Example 3-1 with the exception that the dispersing time of the yellow pigment dispersion mother liquor was changed to 30 minutes. The average particle size of the dispersion mother liquor was 0.79 μm.

Example 3-3

A heat transfer sheet was prepared in the same manner as with Example 3-1 with the exception that a coating solution 2 for a yellow image formation layer was used instead of the coating solution 1 for a yellow image formation layer. The dispersing time of the yellow pigment dispersion mother liquor was changed to 1 hour.

[Preparation of Coating Solution 2 for Yellow Image Formation Layer]

| | |
|---|---|
| Polyvinyl Butyral (Esreck B BL-SH, manufactured by Sekisui Chemical Co., Ltd.) | 0.42 parts |
| Rosin Ester (KE-311, manufactured by Arakawa Kagaku Co., Ltd., component: resin acid 80–97%; resin acid component: abietic acid 30–40%, neoabietic acid 10–20%, dihydroabietic acid 14%, tetrahydroabietic acid 14%) | 0.2 part |

-continued

| [Preparation of Coating Solution 2 for Yellow Image Formation Layer] | |
|---|---|
| Behenic Acid | 0.2 part |
| Monoglycerol Ester of $C_{15}H_{31}COOH$ | 0.25 part |
| Surfactant (Megafac F-176PF, solid content: 20%, manufactured by Dainippon Ink & Chemicals Inc.) | 0.1 part |
| Methyl Ethyl Ketone | 18 parts |
| n-Propyl Alcohol | 70 parts |

The above-mentioned components were heated at 60° C. to dissolve them. Then, after cooling to room temperature, 11 parts of the above-mentioned yellow pigment dispersion mother liquor was added thereto, followed by sufficient stirring to prepare a coating solution 2 for a yellow image formation layer.

The performances of the above-mentioned heat transfer sheets were evaluated according the following. Results thereof are shown in Table 4.

[Scratch Resistance]

The scratch Resistance was determined by the above-mentioned method.

[Performance of Heat Transfer Sheet]

As the image receiving sheet, there was used the same image receiving sheet as with Example 1 with the exception that the size thereof was changed as shown below.

Formation of Transferred Image

The image receiving sheet (56 cm×79 cm) prepared above was wound around a 25-cm diameter rotary drum provided with 1-mm diameter vacuum suction holes (at a surface density of 1 hole per 3 cm×8 cm), and adhered thereon by suction. Then, the above-mentioned heat transfer sheet of Example 3-1 cut to a size of 61 cm×84 cm was overlaid on the image receiving sheet so that the heat transfer sheet was uniformly protruded from the image receiving sheet, and air was sucked through the suction holes with squeezing by the squeeze roller to adhere and laminate the sheets. The degree of pressure reduction in the state that the suction holes were stopped up was −150 mmHg (approximately equal to 81.13 kPa) per atm. The drum was driven for rotation, and a semiconductor laser beam having a wavelength of 808 nm was condensed from the outside onto a surface of the laminate on the drum so as to give a 7-μm spot on a surface of the light-heat conversion layer. Thus, laser image (scanning) recording was conducted while moving the laser beam perpendicularly to the rotational direction (main scanning direction) of the rotary drum (sub-scanning). The laser irradiation conditions were as follows. The laser beam used in this example comprises multiple laser beams two-dimensionally arranged in 5 lines in the main scanning direction and in 3 lines in the sub-scanning direction.

| | |
|---|---|
| Laser Power: | 110 mW |
| Main Scanning Speed | 6 m/sec |
| Sub-Scanning Pitch: | 6.35 μm |

Environmental Temperature and Humidity: three conditions of 18° C. and 30%, 23° C. and 50%, and 26° C. and 65%

After the laser recording was completed, the laminate was removed from the drum, and the heat transfer sheet Y was peeled off from the image receiving sheet by hand. As a result, it was observed that only a light-irradiated area of the image formation layer of the heat transfer sheet Y was transferred to the image receiving sheet.

The diameter of the exposure drum is preferably 360 mm or more, and specifically, the drum having a diameter of 380 mm was used.

Images were transferred from the heat transfer sheets of other Examples and Reference Examples onto the image receiving sheets in the same manner as described above.

As to each solid image thus obtained, a sample of 10 $m^2$ was visually examined to determine the number of image defects caused by scratches. A scratch having a length of 1 mm or more was taken as an image defect. There was no difference in image quality or sensitivity of the resulting samples.

TABLE 4

| Sample | Scratch resistance (g) | Number of Image Defects |
|---|---|---|
| Example 3-1 | 225 | 1 |
| Example 3-2 | 265 | 0 |
| Reference Example 2-1 | 175 | 8 |
| Reference Example 2-2 | 125 | 13 |
| Example 3-3 | 230 | 1 |

The results shown in Table 4 indicate that the samples of Examples have few image defects and provide good images.

The proof products developed in the invention have realized sharp halftone dots by the thin film heat transfer system containing various techniques described above, for solving new problems in the laser heat transfer system, based on the thin film transfer technique and further improving image quality, and the invention has succeeded in developing the DDCP laser heat transfer recording system comprising the image-forming material of final paper transfer, actual halftone dot output, pigment type and B2 size, the output device and the high-quality CMS soft. As described above, according to the invention, the system constitution which can sufficiently exhibit the ability of the high-resolution material has been realized. Specifically, corresponding to the filmless of the CTP age, the contract proof alternative to proof printing and the analog type color proof can be provided, and this proof can reproduce the color reproducibility agree with proof printing and the analog type color proof for obtaining approval of customers. The DDCP system can be provided in which the same pigment colorant as used in print ink is used, transfer to final paper is possible, and no moiré is developed. Further, according to the invention, the large-sized (A2/B2 or more) digital direct color proof system can be provided in which transfer to final paper is possible, the same pigment colorant as used in print ink is used, and the approximation to printed matter is high. The invention is a system in which the laser thin film heat transfer system is used, the pigment colorant is used, and final paper transfer can be conducted by actual halftone dot recording. The multicolor image-forming material and the multicolor image formation method can be provided in which even when laser recording is conducted at high energy by two-dimensionally arranged multiple laser beams under different conditions of temperature and humidity, the image quality is good, and the image having stable transfer density can be formed on the image receiving sheet.

Further, according to the invention, there are provided the multicolor image-forming material and the multicolor image formation method in which vacuum adhesion is good, and no wrinkles are developed in final paper transfer.

Furthermore, according to the invention, there are provided the image receiving sheet excellent in conveying properties and accumulation properties, and bringing about high process stability, and further the heat transfer sheet which can form the image having few image defects on the image receiving sheet even when the image area is large, at stable transfer density.

The entire disclosure of each and every foreign patent application from which the benefit of foreign priority has been claimed in the present application is incorporated herein by reference, as if fully set forth.

What is claimed is:

1. A multicolor image-forming material comprising:

an image-receiving sheet having an image-receiving layer and a support; and at least four thermal transfer sheets each including a support, a light-to-heat converting layer and an image-forming layer, in which each of the thermal transfer sheets has a different color, wherein a multicolor image is formed by: superposing the image-forming layer in each of the at least four thermal transfer sheets on the image-receiving layer in the image-receiving sheet, in which the image-forming layer is opposed to the image-receiving layer; irradiating the image-forming layer in each of the at least four thermal transfer sheets with a laser beam; transferring the irradiated area of the image-forming layer onto the image-receiving layer in the image-receiving sheet to form an image; and transferring the image on the image-receiving layer onto an actual printing paper, and each of the at least four thermal transfer sheets has a recording area being defined by a product of a length of 515 mm or more and width of 728 mm or more, and each of the at least four thermal transfer sheets is larger in each of a length-wise and a width-wise direction than the image-receiving sheet by 20 mm to 80 mm, and the actual printing paper is larger in each of a length-wise and a width-wise direction than the image-receiving sheet by 5 mm to 100 mm.

2. The multicolor image-forming material according to claim 2, wherein each of the at least four thermal transfer sheets has a recording area being defined by a product of a length of 515 mm or more and width of 728 mm or more.

3. The multicolor imaging-forming material according to claim 1, wherein a surface of the image-forming layer in each of the at least four thermal transfer sheets has a scratch resistance of 30 g or more, when the surface is scratched at a rate of 1 cm/second with a needle having a curvature radius of 0.25 mm.

4. The multicolor imaging-forming material according to claim 3, wherein the scratch resistance is 220 g or more.

5. The multicolor image-forming material according to claim 1, wherein the irradiated area of the image-forming layer is transferred onto the image-receiving layer in the image-receiving sheet in a thin film.

6. The multicolor image-forming material according to claim 1, wherein the at least four thermal transfer sheets contain yellow, magenta, cyan and black thermal transfer sheets.

7. The multicolor image-forming material according to claim 1, wherein each of the image-forming layers in the at least four thermal transfer sheets has a ratio of an optical density (OD) to a layer thickness: OD/layer thickness ($\mu$m unit) of 1.50 or more, and the transferred image onto the image-receiving layer has a resolution of 2400 dpi or more.

8. The multicolor image-forming material according to claim 1, wherein the transferred image onto the image-receiving layer has a resolution of 2600 dpi or more.

9. The multicolor image-forming material according to claim 1, wherein each of the image-forming layers in the at least four thermal transfer sheets has a ratio of an optical density (OD) to a layer thickness: OD/layer thickness ($\mu$m unit) of 1.80 or more.

10. The multicolor image-forming material according to claim 1, wherein the image-forming layer in each of the at least four thermal transfer sheets and the image-receiving layer in the image-receiving sheet each has a contact angle with water of from 7.0 to 120.0°.

11. The multicolor image-forming material according to claim 1, wherein each of the image-forming layers in the at least four thermal transfer sheets has a ratio of an optical density (OD) to a layer thickness: OD/layer thickness ($\mu$m unit) of 1.80 or more, and the image-receiving layer in the image-receiving sheet has a contact angle with water of 86° or less.

12. The multicolor image-forming material according to claim 1, wherein each of the image-forming layers in the at least four thermal transfer sheets has a ratio of an optical density (OD) to a layer thickness: OD/layer thickness ($\mu$m unit) of 2.50 or more.

13. The multicolor image-forming material according to claim 1, wherein each of the at least four thermal transfer sheets has a recording area being defined by a product of a length of 594 mm or more and width of 841 mm or more.

14. A method for forming a multicolor image, which comprises:

preparing: an image-receiving sheet having an image-receiving layer and a support; and at least four thermal transfer sheets each including a support, a light-to-heat converting layer and an image-forming layer, in which the at least four thermal transfer sheets have at least four colors including yellow, magenta, cyan and black, in which each of the at least four thermal transfer sheets has a different color, and each of the at least four thermal transfer sheets has a recording area being defined by a product of a length of 515 mm or more and width of 728 mm or more, and each of the at least four thermal transfer sheets is larger in each of a length-width and a width-wise direction than the image-receiving sheet by 20 mm to 80 mm;

superposing the image-forming layer in each of the at least four thermal transfer sheets on the image-receiving layer in the image-receiving sheet, in which the image-forming layer is opposed to the image-receiving layer;

irradiating the image-forming layer in each of the at least four thermal transfer sheets from the side of the support with a laser beam; and transferring the irradiated area of the image-forming layer onto the image-receiving layer in the image-receiving sheet to form a image; and transferring the image on the image-receiving layer onto an actual printing paper, wherein the actual printing paper is larger in each of a length-wise and a width-wise direction than the image-receiving sheet by 5 mm to 100 mm.

* * * * *